US006634641B2

(12) United States Patent
Yamakawa et al.

(10) Patent No.: US 6,634,641 B2
(45) Date of Patent: Oct. 21, 2003

(54) SHEET DISCHARGE APPARATUS, SHEET FINISHING APPARATUS AND IMAGE FORMING APPARATUS EQUIPPED WITH THE SAME

(75) Inventors: Takehiro Yamakawa, Yamanashi-ken (JP); Shinya Sasamoto, Nirasaki (JP)

(73) Assignee: Nisca Corporation, Yamanashi-ken (JP)

( * ) Notice: Subject to any disclaimer, the term of this patent is extended or adjusted under 35 U.S.C. 154(b) by 0 days.

(21) Appl. No.: 10/076,595

(22) Filed: Feb. 19, 2002

(65) Prior Publication Data

US 2003/0062669 A1 Apr. 3, 2003

(30) Foreign Application Priority Data

Feb. 19, 2001 (JP) ..... 2001-042188

(51) Int. Cl.[7] ..... B65H 3/26
(52) U.S. Cl. ..... 271/220; 270/58.01
(58) Field of Search ..... 271/220, 221, 271/224, 227, 258.01, 265; 270/58.01, 58.02, 58.17

(56) References Cited

U.S. PATENT DOCUMENTS

| | | | | |
|---|---|---|---|---|
| 5,931,460 | A | * | 8/1999 | Kadowaki et al. ..... 271/220 |
| 6,042,098 | A | * | 3/2000 | Kubota et al. ..... 270/58.02 |
| 6,170,821 | B1 | * | 1/2001 | Kubota ..... 271/288 |
| 6,339,685 | B1 | * | 1/2002 | Okamoto et al. ..... 399/16 |
| 6,382,614 | B1 | * | 5/2002 | Fukatsu et al. ..... 270/58.11 |
| 6,412,774 | B1 | * | 7/2002 | Saito et al. ..... 271/220 |
| 6,568,669 | B2 | * | 5/2003 | Hosaka ..... 270/58.12 |

* cited by examiner

*Primary Examiner*—Donald P. Walsh
*Assistant Examiner*—Kenneth W Bower
(74) *Attorney, Agent, or Firm*—Kanesaka & Takeuchi

(57) ABSTRACT

An apparatus prevents unwanted stop caused by erroneous detection of a sheet when the sheet bends during a sheet bundle alignment or stapling. The apparatus includes a control device for ignoring a sheet presence detection result by a sensor lever and a sheet presence sensor when aligning by a paddle and an alignment plate or binding by a staple unit.

12 Claims, 39 Drawing Sheets

SHEET DISCHARGE APPARATUS, SHEET FINISHING APPARATUS AND IMAGE FORMING APPARATUS EQUIPPED WITH THE SAME

BACKGROUND OF THE INVENTION AND RELATED ART STATEMENT

The present invention relates to a sheet discharge apparatus to stack sheets with images thereon discharged from an image forming apparatus, such as a copier or printer, and an image forming apparatus with this sheet discharge apparatus, a sheet finishing apparatus that performs finishing process to stacked bundles of sheets and an image forming apparatus with this sheet finishing apparatus.

An apparatus that stacks sheets formed with images using an image forming apparatus, such as a copier or printer, onto a tray and to perform processes like aligning bundles of sheets stacked on the tray and to staple or punch holes into aligned sheet bundles, is well known.

However, in the conventional apparatuses, bending can develop in the sheet bundles, as shown in FIG. 26, when aligning the sheet S in the direction traversing the sheet transport direction by an aligning face 340 for moving the sheet S toward an aligning reference wall 341. Furthermore, as can be seen in FIG. 25, bending can develop in the sheet bundle when aligning the sheet bundle in the transport direction by an aligning belt 180 for moving the sheet bundle toward the reference wall 290. Still further, as can be seen in FIG. 27, when stapling a sheet bundle, the sheet bundle is lifted from the tray. Thus, sensors 30 and 31 for detecting the sheets on the tray are unable to accurately detect the presence of the sheet bundle which results in their erroneously detecting that the sheet bundle is not present based upon the signals from the sensors 30 and 31, regardless of whether or not there is a sheet bundle present on the tray.

In such cases, the sheets from the subsequent job are discharged to the tray while aligning the sheet bundle or while stapling to cause those sheets by the subsequent job to become mixed into and processed with the sheet bundle of the current job which has already been discharged to the tray. So there are problems that the sheets from the subsequent job are discharged while aligning the sheet bundle or while stapling, to thereby strike the aligning means or the stapler to cause jams, or to crease paper, or the machine determines that the sheets had been removed from the tray and a sheet removing jam has occurred which will then cause the entire apparatus to stop operation.

Thus, in view of the situations described above, an object of the instant invention is to provide a sheet discharge apparatus to alleviate the above defects, to prevent jams or creasing of paper by accurately detecting the presence of sheets on the tray and to eliminate unnecessary apparatus stops.

SUMMARY OF THE INVENTION

In order to attain the above objectives, the sheet discharge apparatus of the present invention is equipped with sheet storage means for receiving sheets, discharge means for discharging the sheets transported from an image forming apparatus to the aforementioned sheet storage means, sheet detection means for detecting the presence of sheets on the aforementioned sheet storage means, aligning means for aligning the sheets discharged to the sheet storage means and control means that ignores the detection result of the aforementioned sheet detection means when aligning by using the aforementioned aligning means.

In order to attain the above objectives, the sheet finishing apparatus of the invention is equipped with sheet storage means for receiving sheets, discharge means for discharging the sheets transported from image forming apparatus to the aforementioned sheet storage means, sheet detection means for detecting the presence of the sheets on the aforementioned sheet storage means, aligning means for aligning the sheets discharged to the sheet storage means, finishing means for executing the prescribed finishing process on a sheet bundle aligned by the aforementioned aligning means and control means that ignores the detection results of the aforementioned sheet detection means when aligning by using the aforementioned aligning means or finishing by using the aforementioned finishing means.

In order to attain the aforementioned objectives, in the sheet discharging apparatus of the invention, the above sheet detecting means outputs signals used in the control of the discharge of the sheets from the aforementioned image forming apparatus.

In order to attain the aforementioned objectives, in the sheet finishing apparatus of the invention, the above sheet detecting means outputs signals used in the control of the discharge of the sheets from the aforementioned image forming apparatus.

In order to attain the aforementioned objectives, in the sheet discharging apparatus of the invention, the above sheet detecting means outputs signals used in the control to stop either the image forming apparatus or the sheet discharging apparatus.

In order to attain the aforementioned objectives, in the sheet finishing apparatus of the invention, the above sheet detecting means outputs signals used in the control to stop either the image forming apparatus or the sheet discharging apparatus.

In order to attain the above objectives, the image forming apparatus of the invention is equipped with sheet storage means for receiving sheets, discharge means for discharging the sheets transported from an image forming apparatus to the aforementioned sheet storage means, sheet detection means for detecting the presence of the sheets on the aforementioned sheet storage means, aligning means for aligning the sheets discharged to the sheet storage means and control means for ignoring the detection results of the aforementioned sheet detection means when aligning by using the aforementioned aligning means.

In order to attain the aforementioned objectives, in the image forming apparatus according to the invention, the aforementioned sheet detecting means outputs signals used in the control of the discharge of the sheets from the aforementioned image forming apparatus.

In order to attain the aforementioned objectives, in the image forming apparatus according to the invention, the aforementioned sheet detecting means outputs signals used in the control to stop either the aforementioned image forming apparatus or the aforementioned sheet discharge apparatus.

In order to attain the above objectives, the image forming apparatus of the instant invention is equipped with sheet storage means for receiving sheets, discharge means for discharging the sheets transported from an image forming apparatus to the aforementioned sheet storage means, sheet detection means for detecting the presence of the sheets on the aforementioned sheet storage means, aligning means for aligning the sheets discharged to the sheet storage means, a sheet finishing apparatus comprising finishing means for executing a prescribed finishing process on a sheet bundle aligned by the aforementioned aligning means, and control means for ignoring the detection results of the aforementioned sheet detection means when aligning by using the aforementioned aligning means or finishing by using the aforementioned finishing means.

In order to attain the aforementioned objectives, in the image forming apparatus according to the invention, the aforementioned sheet detecting means outputs signals used in the control of the discharge of the sheets from the aforementioned image forming apparatus.

In order to attain the aforementioned objectives, in the image forming apparatus according to the invention, the aforementioned sheet detecting means outputs signals used in the control to stop the aforementioned image forming apparatus or the aforementioned sheet discharge apparatus.

The other objectives and features of the invention will be made clear by a detailed description below, according to the accompanying drawings.

DETAILED DESCRIPTION OF PREFERRED EMBODIMENTS

The invention relates to a sheet storage apparatus with improved stacking performance when temporarily stacking sheets before discharging with improved placing performance. The following will describe embodiments according to the drawings.

Figure 1:
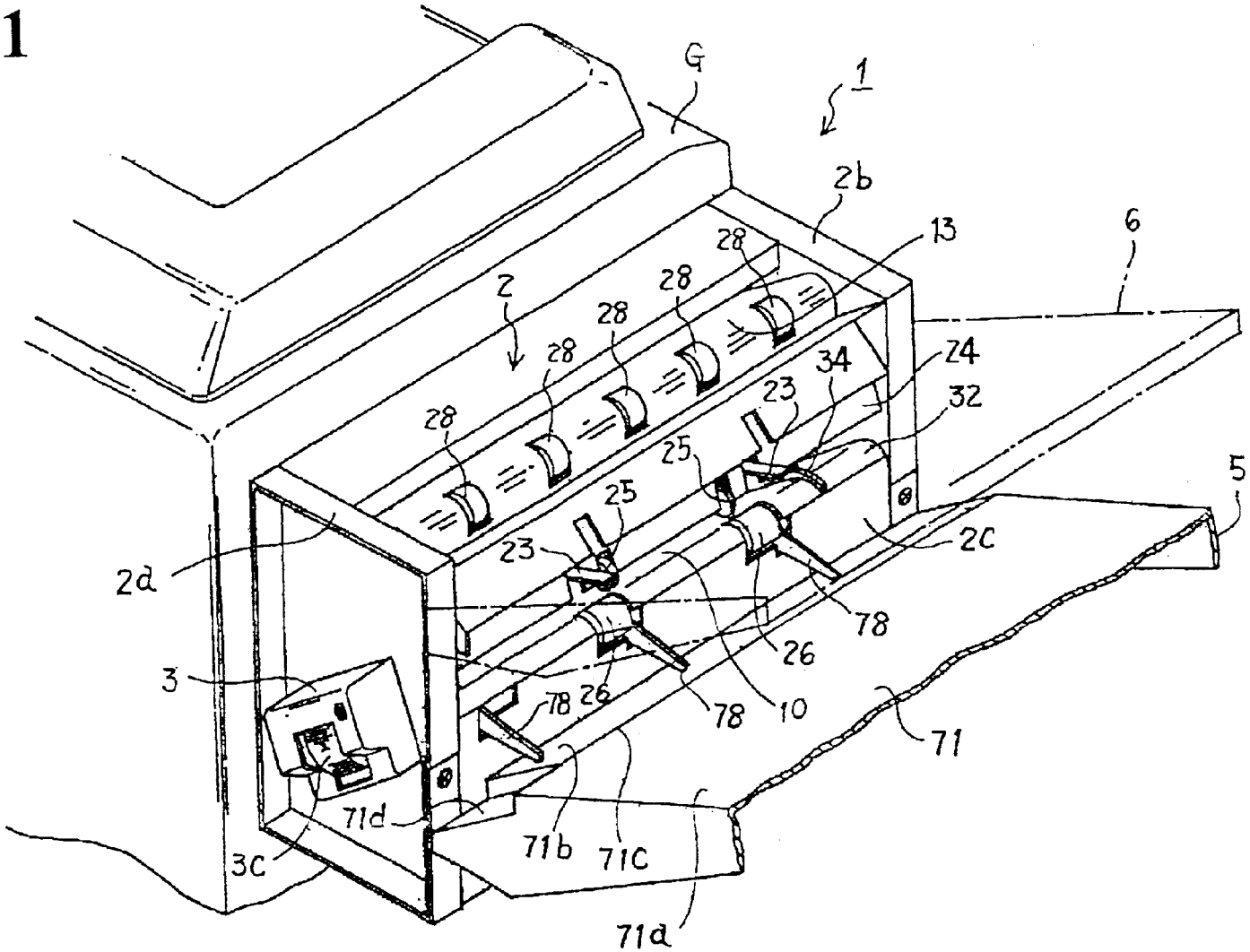
FIG. 1 shows a general perspective view of a part of a sheet storage apparatus of the first type of an embodiment of the present invention.
Figure 2:
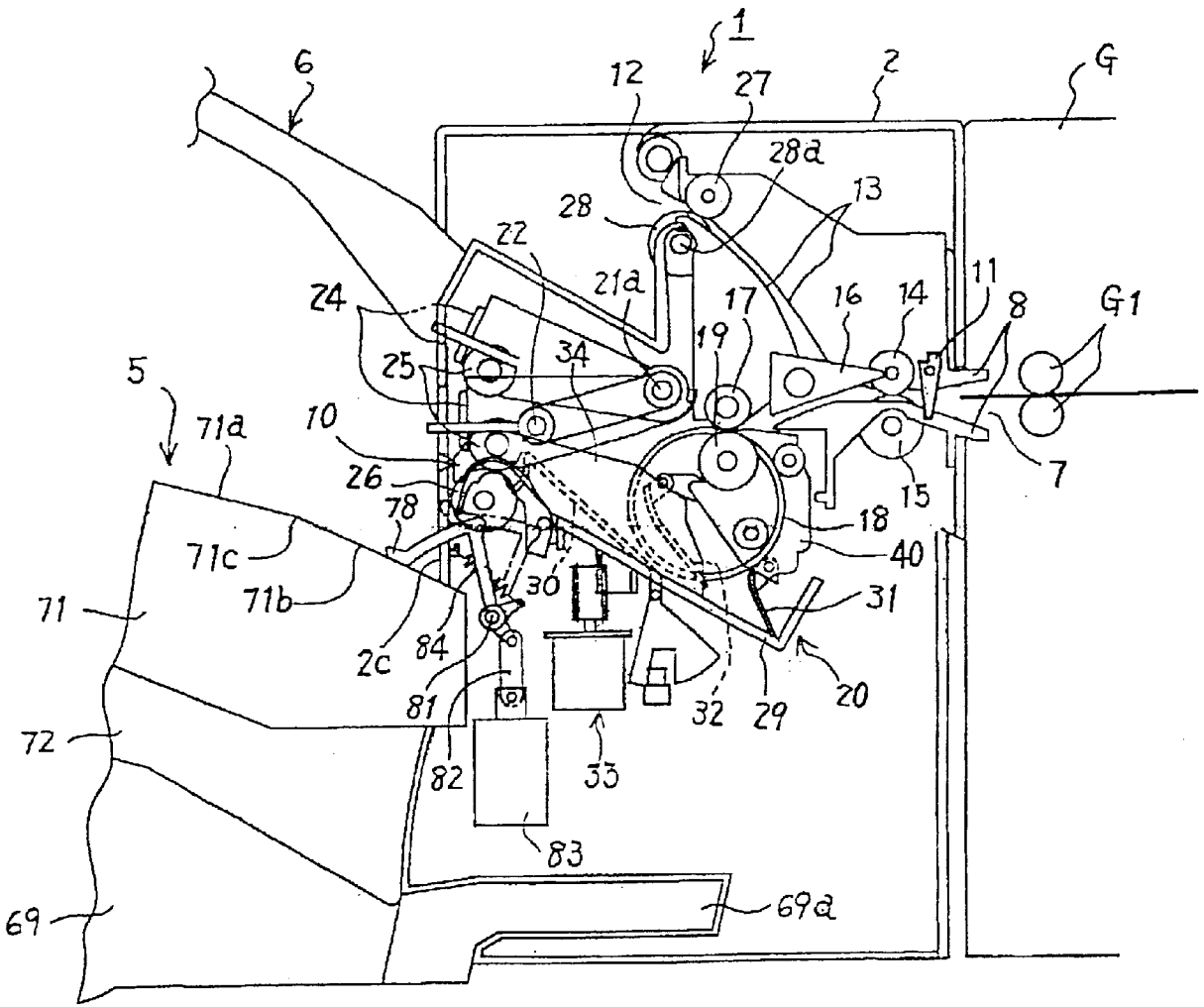
FIG. 2 is a sectional view of the general internal structure of the apparatus shown in FIG. 1.
Figure 3:
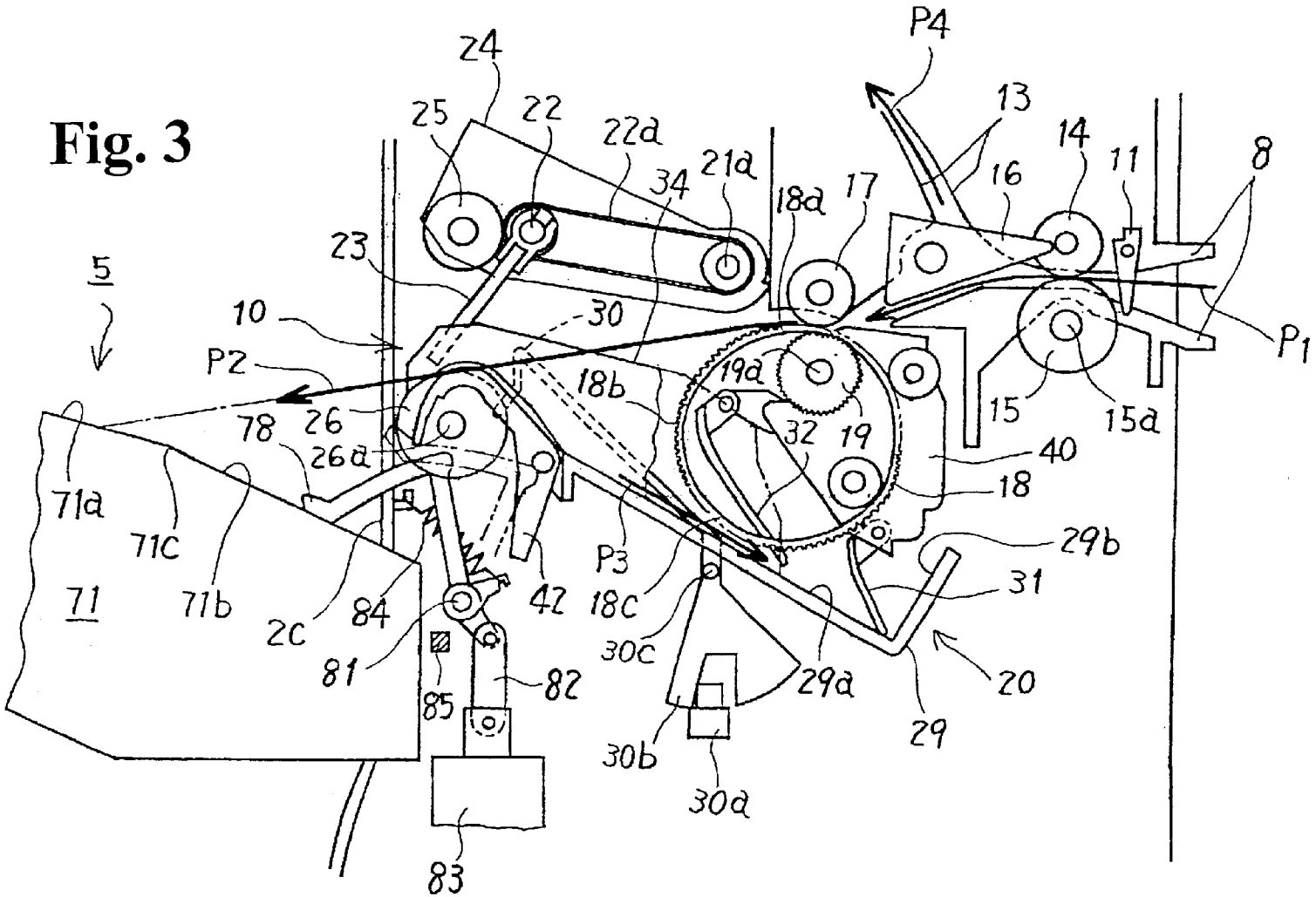
FIG. 3 is an enlarged view of the parts shown in FIG. 2.

In FIGS. 1 to 3, as the sheet storage apparatus, a finisher apparatus 1 is disposed next to an image forming apparatus G, such as a copier or printer. In this case, preferably, it is removably mounted to the image forming apparatus G.

The image forming apparatus G comprises a photosensitive drum that can form a latent image on its outer circumference using an optical system, not shown in the drawings, a developer to develop a toner image of the latent image formed on the photosensitive drum, a cleaner to clean the photosensitive drum, transfer rollers to transfer the toner image formed on the outer circumference of the photosensitive drum in contact with the photosensitive drum through the sheet, and image forming means composed of a fixer to heat the toner transferred to a sheet and to fix it thereto to form the images on the sheets using this image forming means.

The sheets formed with the images using this image forming apparatus are discharged to the finisher apparatus 1 by discharge means, such as discharge rollers, which are not shown in the drawings.

This finisher apparatus 1 is equipped with a main apparatus 2, a staple unit 3 which is mounted to a side frame 2*a* on one side of the main apparatus 2, a drive transmission system 4 (see FIG. 9 and FIG. 10), described later, arranged on a side frame 2*b* on the other side of the main apparatus 2, an inlet 8 to which a sheet S formed with the images and discharged from the image forming apparatus G is supplied, a discharge outlet 10 formed on the side opposing the inlet 8, a stacking tray 5 that protrudes from the front of the main apparatus 2 to stack the sheet S discharged from the discharge outlet 10 and an escape tray 6 positioned above the stacking tray 5 to store the sheets discharged from the second discharge outlet 12.

As is shown in FIG. 3, internally disposed on the main apparatus 2 are a first transport path P1 that leads the sheet S from the inlet 7 inside, a second transport path P2 that connects from the first transport path P1 directly to the stacking tray 5 through the discharge outlet 10 and via a discharge path, a third transport path P3 to switchback the direction of transport of the sheet S with a space with respect to the second transport path P2 to the processing tray 29 as the temporary stacking tray for temporary storage, and a fourth transport path P4 that branches from the aforementioned first transport path P1 to lead the sheet S to a second discharge outlet 12.

In other words, the invention comprises a "pass-through mode" wherein the sheet S passes from the first transport path P1 to the second transport path P2 to discharge it to the stacking tray 5; a "staple mode" wherein the sheet S is switched back and transported from the second transport path P2 along the third transport path P3, and a plurality of sheets is aligned on the processing tray 29 and is bound using the staple unit 3, and the sheet bundle is discharged to the stacking tray; and an "escape mode" wherein the sheet S is transported from the first transport path P1 to the fourth transport path P4 and is discharged to the escape tray 6.

In the first transport path P1, there are disposed transport guides 8 to guide and transport the sheet S supplied from the inlet 7, an inlet sensor 11 to detect that the sheet has been supplied, a transport drive roller 15 cooperating with a follower roller 14 to send the sheet S further downstream and a rotating type flapper 11 that switches transport path to guide the sheet S transported by the transport drive roller 15 toward endless transport belts 18 as sheet transport means to feed the sheet further forward or to guide the sheet S toward the fourth transport path P4.

The aforementioned endless transport belts 18 transport the sheet S to the second transport path P2 in cooperation with the follower roller 17. Note that the transport belt 18 is composed of an endless ring type belt and it is rotated by a belt drive roller 19 that is fastened to a drive shaft 19*a*. It is flexible to allow it to be deformed in the up and down directions or directions traversing thereto in FIG. 2 and FIG. 3.

Below the endless transport belts 18, there is disposed a processing tray unit 20. This processing tray unit 20 is for temporarily holding the sheets S to be stapled by a staple unit 3 placed in order thereupon.

Note that in the present embodiment, the processing tray unit 20 is described for stapling to bind a determined number of sheets but it is also perfectly acceptable to punch holes in the sheets or to temporarily hold a plurality of sheet S to align them before discharging to the stacking tray 5.

Also, above the aforementioned second transport path P2, there is established a rotating unit 24 that moves up and down using a paddle drive roller shaft 21*a* as a pivot. The rotating unit 24 is positioned in the downward position, which is shown in the position of the line in FIG. 2, when discharging the sheet S from the first transport path P1 to the stacking tray 5 passing directly through the discharge outlet 10 or when discharging a plurality of sheet bundles in the aforementioned processing tray unit to the stacking tray 5. When leading the sheet S to the third transport path P3 inside the processing tray 29, it is positioned in the upward position shown as the dotted line in FIG. 2.

Inside of the rotating unit 24, there are established a rubber paddle 23 disposed on a paddle rotation shaft 22 to follow the rotation of the paddle drive roller 21 on the paddle drive roller shaft 21*a,* and a follower discharge roller 25 established on the free end of the rotating unit 24. This follower discharge roller 25 works in cooperation with a discharge roller 26 positioned below to discharge the sheet bundles from the discharge outlet 10 to the stacking tray 5.

The aforementioned discharge roller 26 that is rotationally driven by a drive shaft 26*a* in opposition to the follower discharge roller 25 is disposed on the discharge outlet 10 of the main apparatus 2.

At the bottom of the aforementioned discharge roller 26, a front frame of the main apparatus 2 is integrally formed with a sheet abutting surface 2*c* in one unit as a sheet edge regulating member to restrict the edge of the sheet S stacked in the stacking tray 5. A sheet holding lever 78 is disposed to appear by protruding toward the aforementioned stacking tray 5 from the upper position of the sheet abutting surface 2*c* near the discharge roller 26 on the sheet abutting surface 2*c*. This sheet holding lever 78 moves to protrude toward the stacking tray 5 whenever the sheet S or bundle of the sheet S is discharged by the follower discharge roller 25. Therefore, the sheet holding lever 78, which is described in further detail below, holds the edges of the sheets that are stacked. This improves the stacking performance of the sheets S in the stacking tray 5 and prevents the jamming of the sheets S when the edge of the sheet S discharged and stacked into the stacking tray 5 curls and the leading edge of subsequently discharged sheet S comes into contact with them.

Note that the sheet holding lever 78 according to the invention is driven by a holding lever solenoid 83 which is positioned behind the sheet abutting surface 2*c* to appear from inside the sheet abutting surface 2*c*.

A transport guide 13 is disposed in the fourth transport path P4 and is equipped with a second discharge roller 28 that cooperates with the follower roller 27 to discharge the sheet S from the second discharge outlet 12 into the escape tray 6 when the sheet S having images formed thereupon is not to be finished by using the stapling or sorting functions, or when a special sheet of a non-standard size is used.

The above description is a general explanation of the main apparatus 2. The following will describe the configuration of each unit and each mechanism according to FIG. 2 to FIG. 7.

Figure 4:
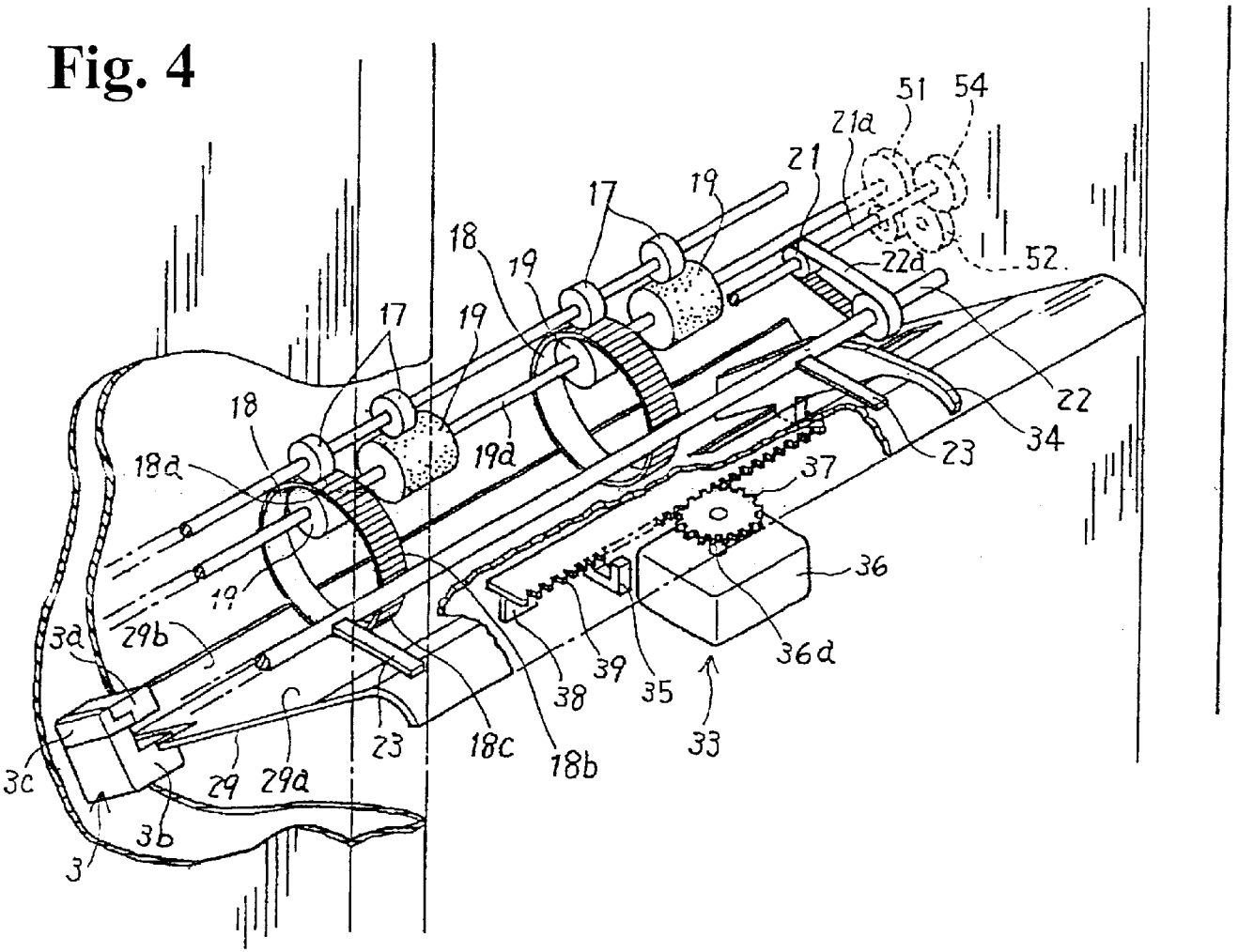
FIG. 4 is a general perspective view of a part of the sheet temporary stacking tray of the apparatus shown in FIG. 1.

As is clearly shown in FIG. 3 and FIG. 4, the processing tray unit 20 is provided with a processing tray 29 as the temporary stacking tray for temporarily stacking the sheets to staple them, a sensor lever 30*a* to detect the sheet S being discharged to the processing tray 29, a sheet holder 31 as sheet pressure means disposed in two locations, front and back, positioned in the direction of sheet transport to touch the upper most surface of the sheet on the processing tray 29, and an alignment plate 34 as the aligning means for aligning the sheet S stacked upon the processing tray 29.

The processing tray 29 is formed into a unified body with a sheet stacking portion 29*a* which is inclined upward in the leading edge direction of the discharge of the sheet bundle after binding and a process sheet leading edge restricting portion 29*b* as a reference member to align the edge of the sheet by abutting against the edge thereof on the sheet stacking portion 29*a,* that rises from the back edge of the sheet stacking portion 29*a.*

Furthermore, the width of the processing tray 29 is larger than the size of the width of the maximum size sheet S, but it is possible for the length of the sheet transport direction to be short, in other words, the distance from the inlet 7 to the discharge outlet 10, regardless of the sheet size. This is because the structure enables the sheets to be stacked while overlapping the processing tray 29 and the stacking tray 5.

One edge of a sensor lever 30 extends into the second transport path P2 on the discharge outlet 10 side and is rotationally supported by a sensor rotation shaft 30*c* below the processing tray 29 and comprises a sensor flag 30*b* that detects by the sheet presence sensor 30*a* on the other edge. When no sheet S is present, one edge extends into the second transport path P2 separating from the sheet stacking portion, as can be seen in FIG. 2 and FIG. 3.

The sensor lever 30 detects the status of the sheet S when the sheet S is not transported into the second transport path P2 and when it is not stacked in the sheet stacking portion 29*a* on the processing tray 29.

Therefore, when the sheet S is not stacked in the sheet stacking portion 29*a,* and when one sheet at a time passes through from the first transport path P1 to the second transport path P2 to the stacking tray 5, it functions as the transport through sensor for the sheet S, detecting the trailing edge of the sheet S being discharged.

Furthermore, even when discharging the bundle from the processing tray 29, it can detect as the sheet S bundle discharge through sensor. The pass through detection signal generated by the sensor lever 30 is used as a holding lever solenoid 83 activation signal to activate the sheet holding lever 78, described above.

A sheet middle support guide 42 is disposed on the discharge outlet 10 side of the sheet stacking portion 29*a* positioned slightly upward from the outer circumference of the discharge roller 26.

Note that the finisher apparatus 1 switches back the sheet S from the second transport path P2 to the third transport path P3 and places it on the processing tray 29, in which the sheet S is placed at one time to overlap the processing tray 29 and the stacking tray 5 because the processing tray 29 is set to be shorter than the length of the sheet S transport direction, as described above.

Therefore, to shift the sheet in the width direction substantially traversing the transport direction of the sheet S to align the sheet on the processing tray 29, it is preferred that the sheet S does not contact the discharge roller 26 formed of a material of a high coefficient of friction, such as rubber, and that the sheet S has firmness forming a bend at the top of the discharge roller.

On the other hand, when discharging the sheet S directly to the stacking tray 5 from the first transport path P1 to the second transport path P2 without placing it on the sheet stacking portion 29*a,* it is preferred that the discharge roller 26 and sheet S should not contact when the leading edge of the sheet S passes through the discharge roller 26. The above sheet middle support guide 42 is disposed to achieve this.

Note that the sheet middle support guide 42, in association with the up and down movements of the rotation unit 24, is positioned further inside from the surface of the outer circumference of the discharge roller 26 when the rotating unit is in the downward position indicated by the line in FIG. 2.

As can be seen in FIG. 4, the aligning unit 33 includes an alignment plate 34 arranged in a position traversing the transport direction of the sheet S, an alignment plate drive motor 36, a pinion gear 37 fastened to an output shaft 36*a* on the alignment plate drive motor 36, a rack gear 39 meshing with a pinion gear 37 established on the bottom of the alignment plate 34, an alignment plate position detection sensor 35 to detect the position of the alignment plate 34 below the rack gear 39, and an alignment plate flag 38 which is unitized with the rack gear 39 to interrupt the sensor.

Therefore, the alignment plate 34 moves to touch the sheet S in the direction traversing the direction of transport of the sheet S by the rotational drive of the alignment plate drive motor 36 whenever the sheet S is transported along the third transport path P3 to the processing tray 29. This touches the sheet S against the main apparatus side frame 2*a* to which the staple unit 3 is mounted in a position opposing the direction of travel of the alignment plate 34.

Note that in the present embodiment, the alignment plate 34 is disposed on only one side in the width direction of the sheet S, but it is also perfectly acceptable to align the sheet S using paired alignment plates that approach to and separate from each other on both sides in the width direction of the sheet S.

The following will describe the endless transport belts 18. As described above, the sheet S is transported in the direction of the second transport path P2 in cooperation with the follower roller 17, but this is configured in the third transport path P3 to transport the sheet S toward the sheet leading restricting portion 29*b*.

In other words, as can be seen in FIG. 3 and FIG. 4, the endless transport belts 18 act as the sheet feeding portion to transport the sheet S further in the third transport path P3, by forming fine teeth on the surface abutting against the sheet S and the portion 18*a* in the drawings acts as the sheet draw-in transport portion to draw in the sheet from the first transport path P1. A part 18*b* cooperates with the paddle 23, described below, acts as a pushing portion to push the trailing edge in the direction of the transport of the sheet S from the second transport path P2 to the third transport path P3. The endless transport belt 18 is composed of a flexible and deformable material so the sheet feeding portion 18*c* rises according to the thickness of the sheet S even if the sheets S are stacked on the stacking portion 29*a*.

To describe the positional relationships of the endless transport belts 18 and the aforementioned alignment plate 34, the sheet feeding portions 18*c* on the endless transport belts 18 are positioned within the range of the length in the transport direction of the alignment plate 34, as can be seen in FIG. 3 and FIG. 4. The alignment plate 34 shifts to move the sheet S in the width direction after the endless transport belts 18 transport the edge of the sheet S to reach the sheet leading restricting portion 29*b*. However, because the sheet S and the sheet feeding portion 18*c* are in contact when aligning, rotation force acts on the sheet S around the sheet drawing portion 18*c* when the sheet drawing portion 18*c* is positioned on the outside of the alignment plate 34 to prevent mal-alignment. Also, by arranging the sheet drawing portion 18*c* inside the alignment plate 34, it is possible to shorten the overall length of the main apparatus 2 in the direction of sheet transport to make the apparatus more compact.

Figure 5:
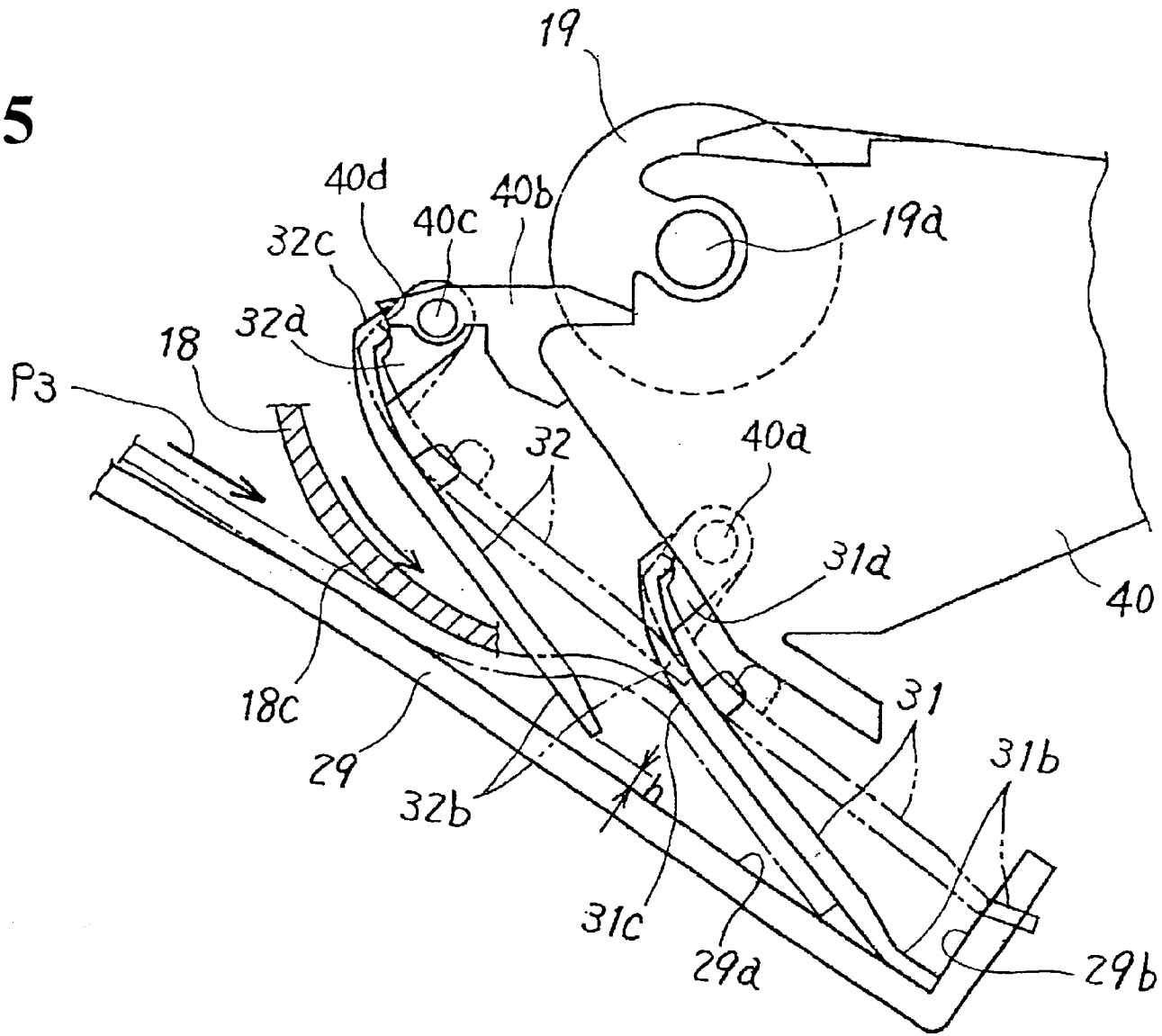
FIG. 5 is a front sectional view of sheet pressing means on a sheet temporary stacking tray of the apparatus shown in FIG. 1.
Figure 6:
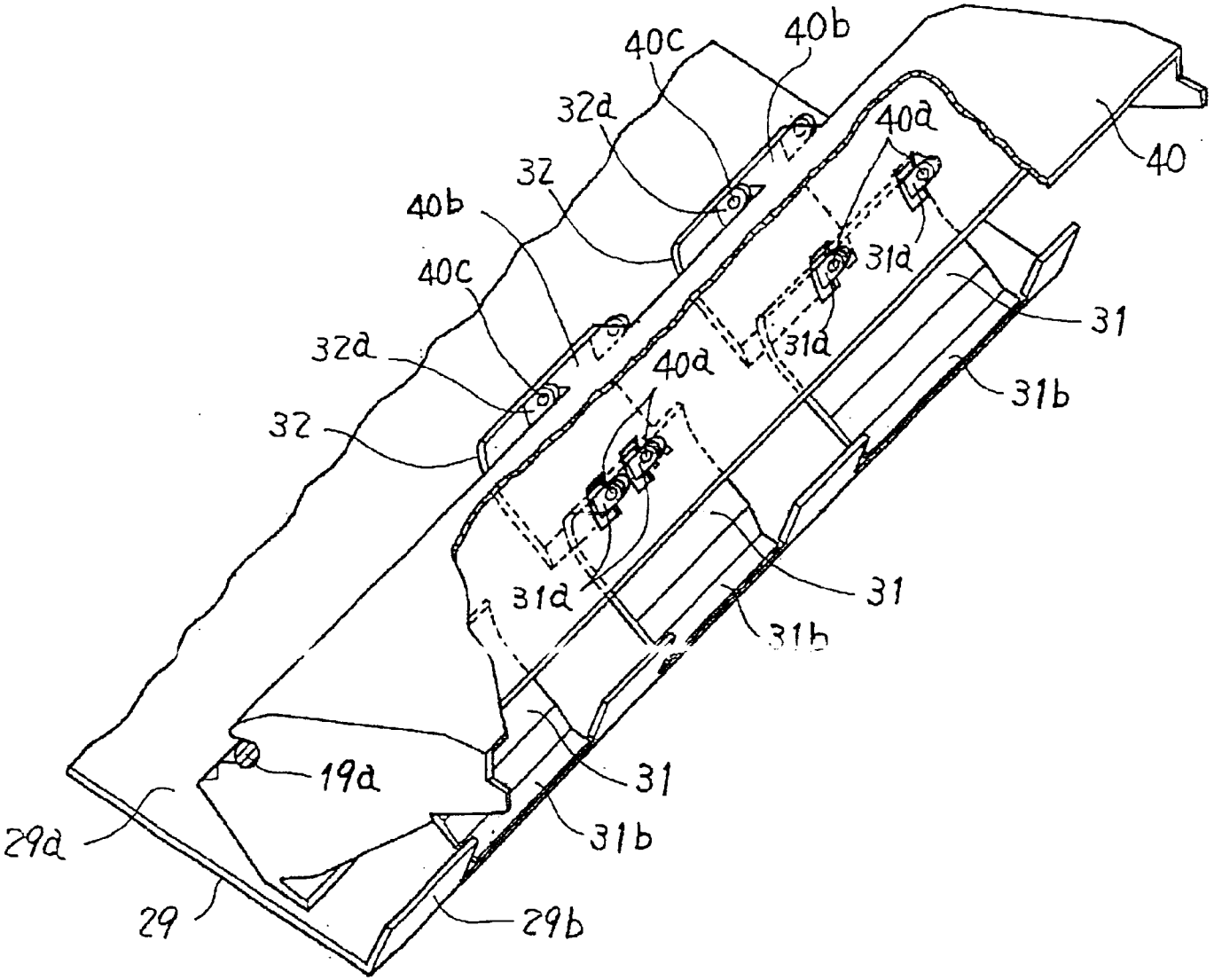
FIG. 6 is a general perspective view of the sheet pressing means on the sheet stacking tray shown in FIG. 5.

The following will describe the sheet pressing members 31 and 32 that are arranged above the sheet stacking portion 29*a* according to FIG. 5 and FIG. 6. As described above, the sheet S to be placed on the processing tray 29 is fed sequentially to the sheet stacking portion 29*a* by the endless transport belts 18 along the third transport path P3. At this time, the sheet S is transported while being pushed against the sheet stacking portion 29*a* by the first sheet pressing member 31 and the second sheet pressing member 32 that are rotationally mounted to the support member 40 above the processing tray 29. Even if the sheet S curls after its leading edge reaches the sheet leading restricting portion 29*b* on the processing tray 29, it will not result in preventing the subsequent sheet from being transported in or good alignment for later finishing processes such as binding by staples.

In other words, the first sheet pressing member 31 hangs down to a position touching the sheet stacking portion 29*a* with a reference portion 31*a* rotationally mounted to a support shaft 40*a* on a support member 40 inside the support member 40 and the leading edge portion 31*b* adjacent to the sheet leading restricting portion 29*b* on the processing tray. Furthermore, the reference portion 31*a* on the first sheet pressing member 31 is positioned to overlap a portion of the sheet leading restricting portion 29*b* on the processing tray. This overlap prevents the edge of the sheet S from passing over the gap between the leading edge portion 31*b* and the sheet leading restricting portion 29*b*.

Next, the second sheet pressing member 32 is rotationally mounted to a second support shaft 40*c* in which the reference portion 32*a* is mounted to the support member 40, the leading edge portion 32*b* hangs downward toward the sheet stacking portion 29*a* from the endless transport belts 18.

As can be seen in FIG. 5, a stopper portion 32*c* touches a restricting portion 40*d* disposed on the support portion 40*b* so the second sheet pressing member 32 maintains the distance h with the sheet stacking portion 29*a*. Therefore, the leading edge portion 32*b* does not touch the sheet S if the thickness of the sheet S stacked on the sheet stacking portion 29*a* does not exceed the aforementioned h distance.

In this way, the lead edge 32*b* on the second sheet pressing member 32 is made to separate from the sheet stacking portion 29*a* to reduce the resistance and damage to the sheet S when there is a fewer number of the sheets S and to touch the sheets S to create a bundle thereof when the prescribed number of sheets (more than the distance h) is reached or there is a curl in the sheet S that exceeds the distance of h.

Therefore, when there is a small number of sheets S to be stacked on the sheet stacking portion 29*a* or when there is a smaller curl thereof, the sheet S is pushed by the first sheet pressing member 31 alone. As the number of sheet S to be stacked increases or when curling is large, the second sheet pressing member 32 pushes the sheet S.

When the curl in the sheet S is large, like the sheet S indicated by the dotted line in FIG. 5, the leading edge portion 32*b* on the second sheet pressing member 32 touches and abuts against the rear portion 31*c* on the first sheet pressing member 31. Thus, when a curl occurs in the sheet S that exceeds a predetermined amount, the weight of the first sheet pressing member 31 is applied to the leading edge portion 32*b* on the second sheet pressing member 32 to quickly alleviate this curl.

Note that the second sheet pressing member 32 whose leading edge portion 32*b* separates from the sheet stacking portion 29*a* is positioned further upstream in the direction of the sheet transport relative to the first sheet pressing member 31 when the sheet S is transported into the processing tray 29. According to the present embodiment, when there is a fewer number of the sheets S transported in, only the first sheet pressing member 31 near the sheet leading restricting portion 29*b* pushes the sheet S. As the number of the sheet S transported in increases, both the first sheet pressing member 31 and the second sheet pressing member 32 act to push the sheets S. Furthermore, as the number of the sheets S increases, so does the pushing force on the sheets and the stacking performance of the sheets is improved.

Furthermore, as can be seen in FIG. 6, the first sheet pressing member 31 and the second sheet pressing member 32 are arranged in series along the width direction of the sheet S and are arranged to push the edges of the sheets stacked on the sheet stacking portion 29*a*. Therefore, finishing processes on the sheet edges, such as binding the sheet bundle using the staple unit 3 can be performed with the edges of the sheets correctly aligned.

Furthermore, according to the aforementioned embodiment, the leading edge portion 31*b* on the first sheet pressing member 31 is arranged so that it rests on the sheet stacking portion 29*a* when there is no sheet stacked thereupon, but it is also perfectly acceptable to have it not touch the aforementioned sheet stacking portion. In such a case, it is possible to set the distance of the leading edge portion 31*b* of the first sheet pressing member 31 with respect to the sheet stacking portion 29*a* to be smaller than the distance h for the leading edge portion 32*b* of the second sheet pressing member 32 with respect to the sheet stacking portion 29*a*.

Also, although the first sheet pressing member 31 and the second sheet pressing member 32 are aligned in series of two in the direction of sheet transport, it is possible to use 3 or 4 series to vary the pushing pressure applied to the sheet S or in the same line.

Figure 7:
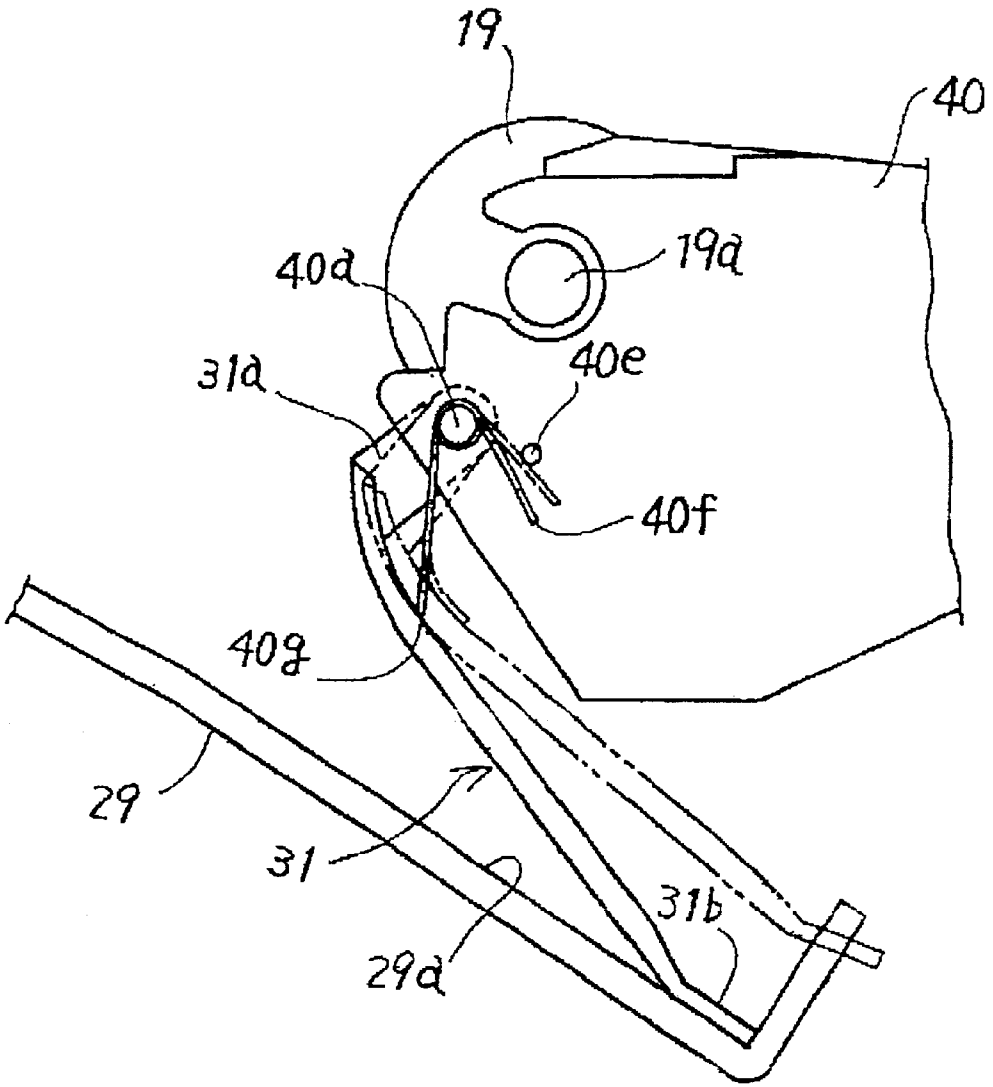
FIG. 7 is a sectional view of another embodiment of the sheet pressing means shown in FIG. 5.

Furthermore, it is acceptable to omit the second sheet pressing member 32, as shown in the FIG. 7, and to dispose the coil spring 40*f* between the support member 40 and the first sheet pressing member 31. One end of the coil spring 40*f* is positioned on the spring pin 40*e* disposed on the support member 40 and the other end of the spring touching portion 40*g* on the back side of the first sheet pressing member 31. Therefore, when there is a fewer number of the sheets S, there is no action of the elastic force of the coil spring 40*f* but as the number of the sheet S increases, so does the strength of the elastic force of the coil spring 40*f* to increase the pressing force against the sheet S.

The sheets S stacked on the processing tray 29 are bound by the staple unit 3, but the staple unit 3 according to the present embodiment is arranged obliquely in substantially the same angle as the sheet stacking portion 29*a* on the processing tray 29 and is mounted to the side frame 2*a*. This staple unit is disposed with a drive head portion 3*a* to drive the staples into the front edge of the sheet S, facing the sheet stacking portion 29*a* positioned inside from the main frame 2, and an anvil portion 3*b* that bends the staple drive by the drive head portion 3*a*. It is further equipped with the replaceable cartridge 3*c* that stores the staples in the rear which is the outer side of the main apparatus frame 2.

Note that the staple unit 3 drives the staple from the top surface of the sheets on the sheet stacking portion 29*a* but it is perfectly acceptable to reverse the positions of the drive head portion 3*a* and the anvil portion 3*b* to drive the staple from the undersurface of the sheet S.

Figure 8:
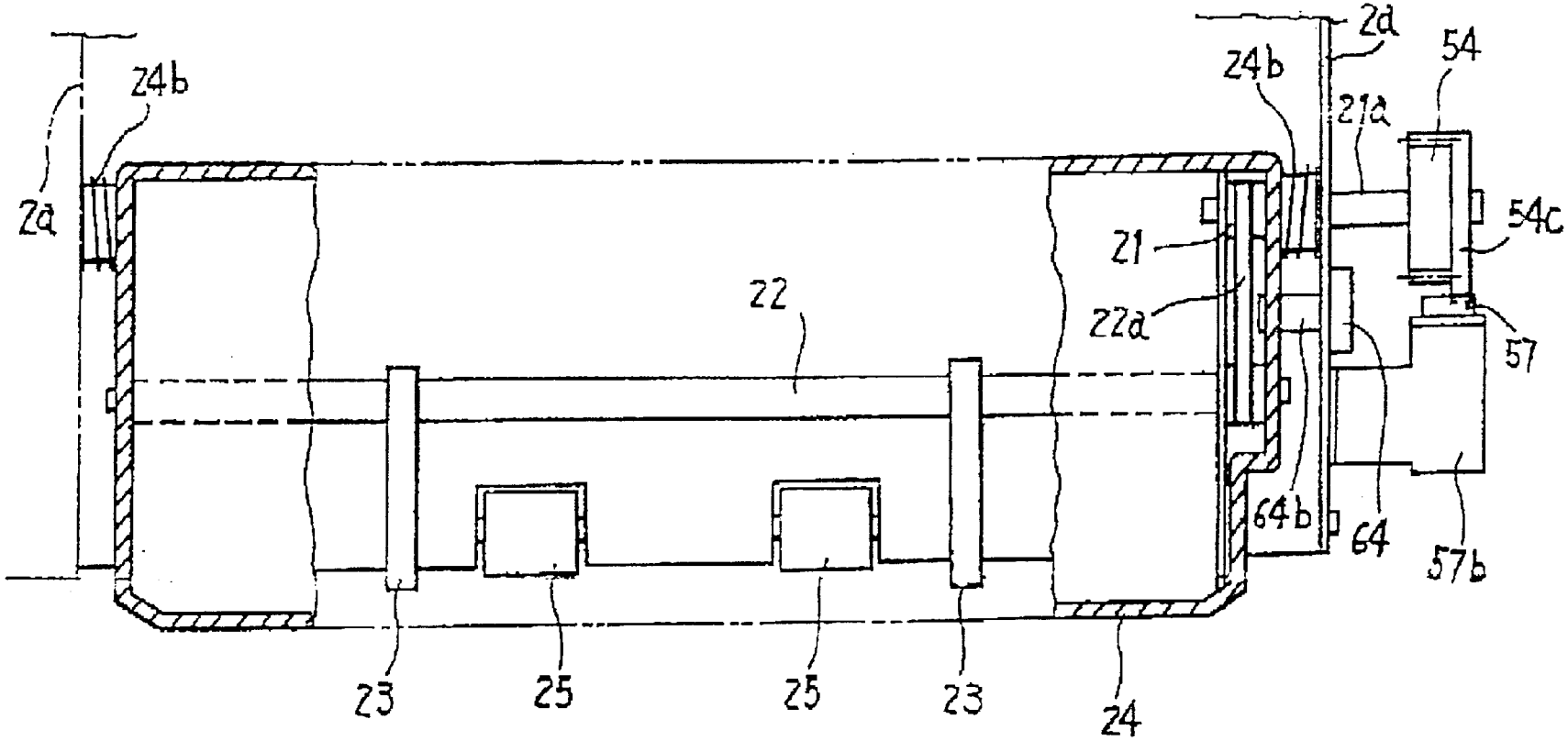
FIG. 8 is a partly sectional plan view of the general structure of a rotating unit of the apparatus shown in FIG. 1.

Next, the description is made for the rotating unit 24 which is positioned above the sheet discharge outlet of the processing tray 29 in FIG. 3. As can be seen in the plan view of FIG. 8, this rotating unit 24 is equipped with the paddle 23, a paddle rotation shaft 22 that rotates the paddle 23, a paddle drive belt 22*a* that transmits driving power to the paddle rotation shaft 22, a paddle drive roller 21 that drives the paddle drive belt 22*a* and the follower discharge roller 25 that cooperates with the discharge roller 26 on the main apparatus frame 2 positioned at the discharge outlet 10 to discharge the sheet S. The paddle drive roller 21 is rotationally driven by the paddle drive roller shaft 21*a* that is rotationally driven by the paddle drive transmission gear 54 which is a part of the drive transmission system 4 established on the main apparatus side frame 2*a*. Also, the rotating unit 24 swings up and down to a position near the discharge roller 26 and a position away from the discharge roller 26 by using the paddle drive roller shaft 21*a* as the pivot. These up and down swinging actions are made by engaging the elevator pin 46*b* that protrudes from the elevator lever 64 disposed on the drive transmission system 4, with the rotating unit 24.

The rotating unit 24 is mounted on the shaft pivot of the paddle drive roller shaft 21*a* on one side attached to the main apparatus frame 2, the other being constantly urged to the downward side of the discharge roller 26 by the rotating unit spring 24*b* that touches the rotating unit 24 frame, but the up and down swingings are controlled by the aforementioned elevator lever 64 in resistance to this urging force.

The main apparatus 2 includes the "pass-through mode" wherein the sheet S passes from the first transport path P1 to the second transport path P2 to discharge it to the stacking tray 5; the "staple mode" wherein the sheets S are transported backwardly from the second transport path P2 along the third transport path P3, aligned on the processing tray 29, bound by using the staple unit 3 and discharged to the stacking tray; and the "escape mode" wherein the sheet S is transferred from the first transport path P1 to the fourth transport path P4 and discharged to the escape tray 6.

The following describes the system that drives the transport drive roller 15, the endless transport belts 18, the discharge roller 26, the paddle 23, the elevator unit 24, and the second discharge roller 26.

Figure 9:
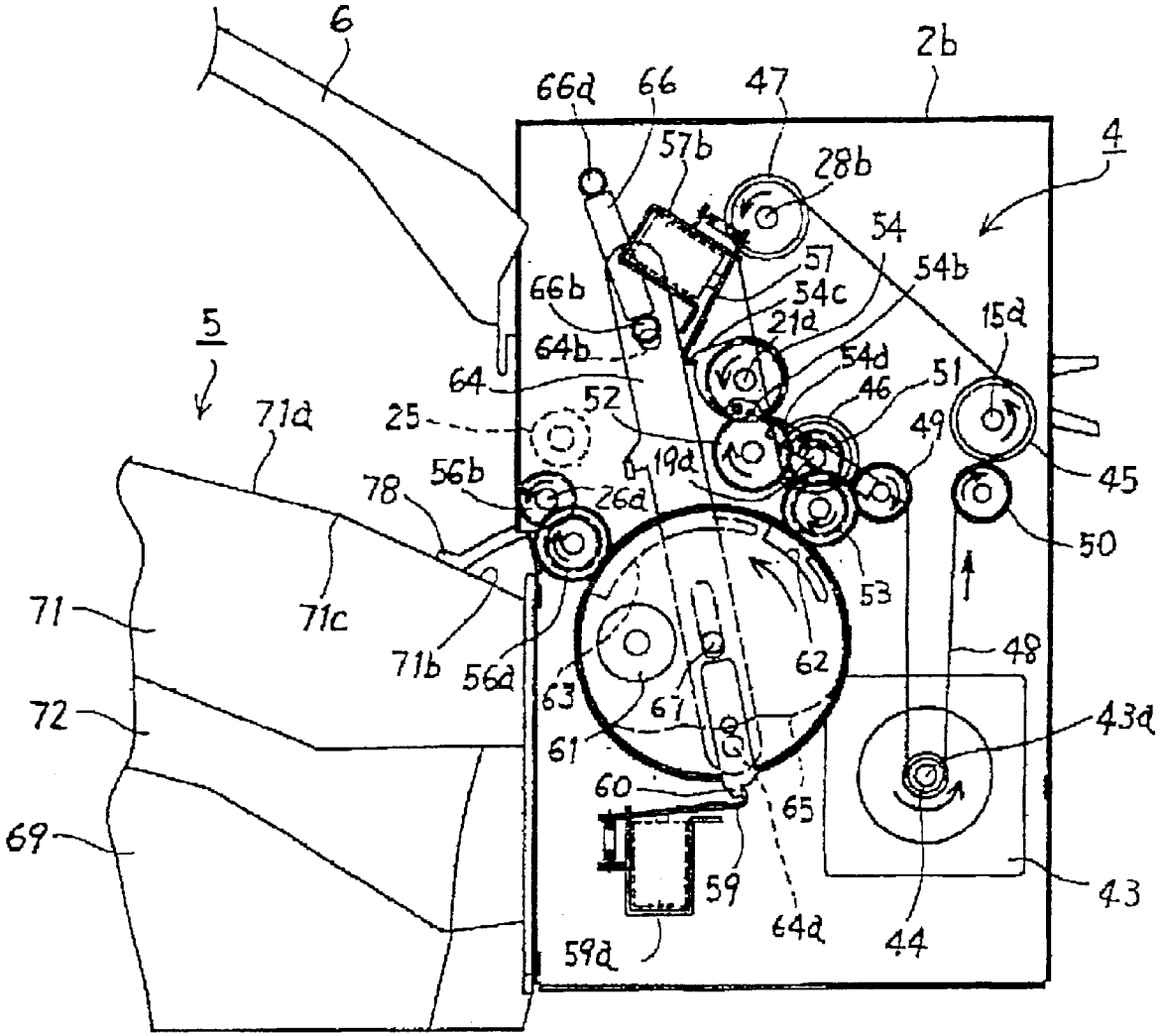
FIG. 9 is a sectional view of a drive transmission system of the apparatus shown in FIG. 1.
Figure 10:
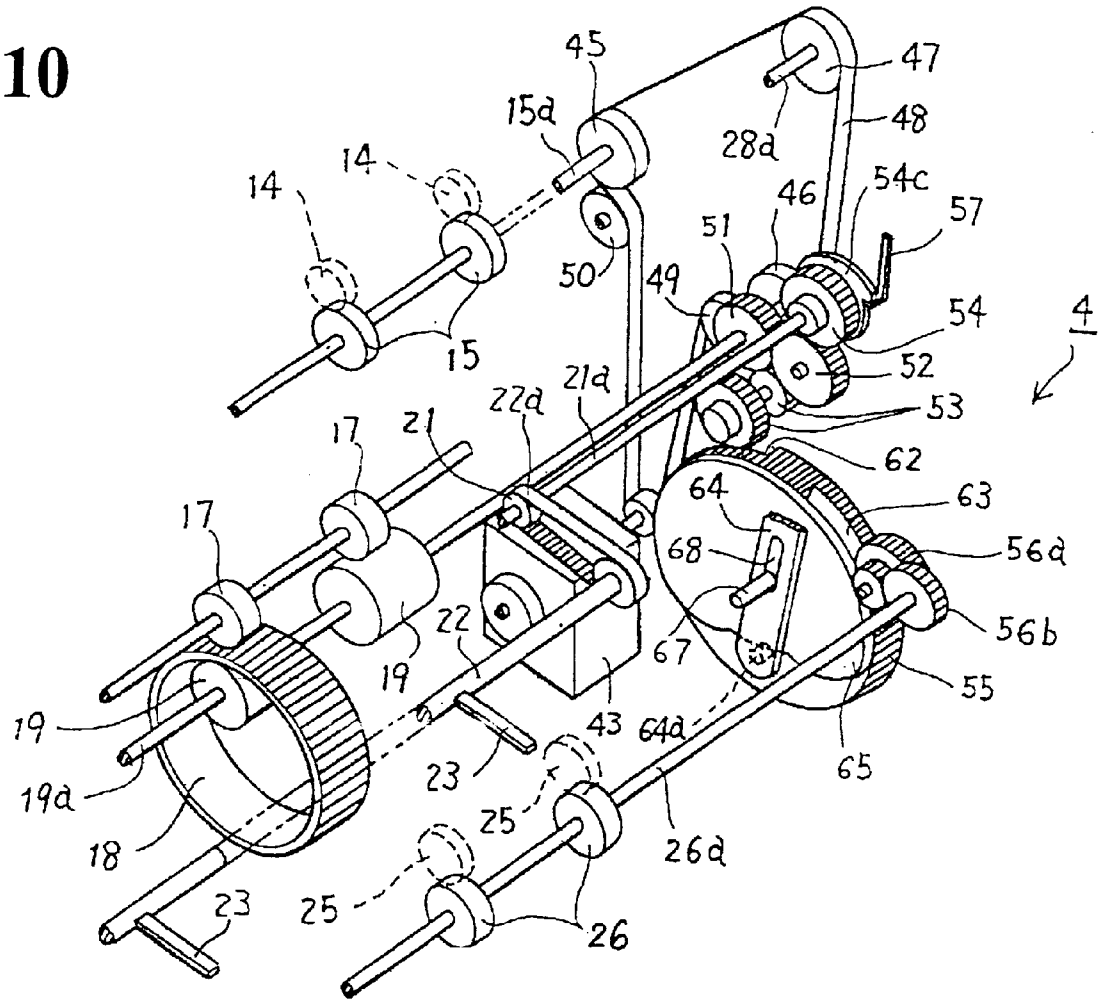
FIG. 10 is a conceptual perspective view of a part of the drive transmission system shown in FIG. 9.

As is shown in FIG. 9 and FIG. 10, the drive transmission system 4 according to the instant invention comprises one of drive motors 43, an output pulley 44 that rotates in the counter-clockwise direction disposed on an output shaft 43*a* on this one drive motors 43, a drive pulley 45 disposed on the rotation shaft 15*a* on the transport drive roller 15 arranged on the inlet 10 side, a drive pulley 47 disposed on the rotating shaft 28*a* on the second discharge roller 26, a drive pulley 46 disposed on the rotation shaft 19*a* on the drive roller 19 to rotationally drive the endless transport belts 18, a rotation belt 48 to transmit the drive from the output pulleys to each of the drive pulleys 45, 46 and 47, a large diameter timing gear 55 connected to a transmission gear 51 via a follower transmission gear 53 disposed on the rotation shaft 19*a* which is the same shaft as the drive pulley 46, a transmission gear 56*b* that is connected via the timing gear 55 and the intermediate gear 56*a* disposed on the rotation shaft 26*a* on the discharge roller 26, a paddle transmission gear 54 that is equipped with a rocking plate 54*c* on the outer circumference connected to the transmission gear 51 which is the same shaft as the follower transmission gear 52 and the drive pulley 46, established on the paddle drive roller shaft 21*a* to rotationally drive the paddle drive roller 21 while supporting the rotating unit 24 to swing up and down, a paddle drive belt 22*a* that connects the paddle rotation shaft 2 that supports the paddle drive roller 21 and the paddle 23, a cam 65 mounted on the timing gear 55, and an elevator lever 64 that engages the rotating unit 24 by a pin 64*b* to swing the rotating unit 24 up and down with the rotation of the cam 65.

In the drawings, numbers 49 and 50 are the tension rollers that apply tension to the rotating belt 48.

The sheet S is fed from the inlet on the main apparatus 2. When the inlet sensor 8*b* detects that the machine is in operation by detection the leading edge of the sheet S, the transport drive motor 43 starts up and the rotating belt 48 rotates the transport drive roller 15 connected to the drive pulley 45, the second discharge roller 26 connected to the drive pulley 47 and the drive roller 19 to drive the endless transport belts 18 connected to the drive pulley 46, to continuously rotate in the direction of sequentially feeding the sheets, i.e. in the sheet transport direction.

When processing the sheet S using the "pass-through mode", the timing drive gear 55 is rotated without rotationally driving the paddle 23. This rotation moves the elevator lever 64 downward shown in the drawing thereby moving the rotating unit 24 also to the side of the follower discharge roller 26 to touch to the follower discharge roller 26 inside the rotating unit 24. Along with this, the discharge roller 26 rotates via the intermediate gear 56*a* and the transmission gear 56*b*, and the timing drive gear 55 discharges the sheet S one by one to the stacking tray 5 along the second transport path P2.

Alternatively, in the "staple mode", when the trailing edge of the sheet S passes the inlet sensor 11 and the sensor turns OFF (S1001, as indicated in the flow chart in FIG. 35), it sets the prescribed pulse to start up the paddle 23 (S1002) and begins to count down the pulse that was set (S1101).

The prescribed pulse to start up the paddle 23 is set for the trailing edge of the sheet S to pass the endless belt drive roller 19 and the follower roller 17, so that when the aforementioned set prescribed pulse is counted down to 0 (S1102), the paddle 23 starts (S1103) and the activating pulse is set to operate the paddle 23 at substantially the same time (S1104) and rotates in the direction opposite to the direction of sheet transport (the opposite direction of the drive roller 19) to feed the sheet S from the second transport path P2 to the processing tray 29 along the third transport path P3.

The activating pulse set after the aforementioned startup pulse is surpassed is counted down (S1105) to continuously rotate the paddle 23 until the activating pulse count is counted down to O(S1106), and then it stops (S1107).

Figure 35:
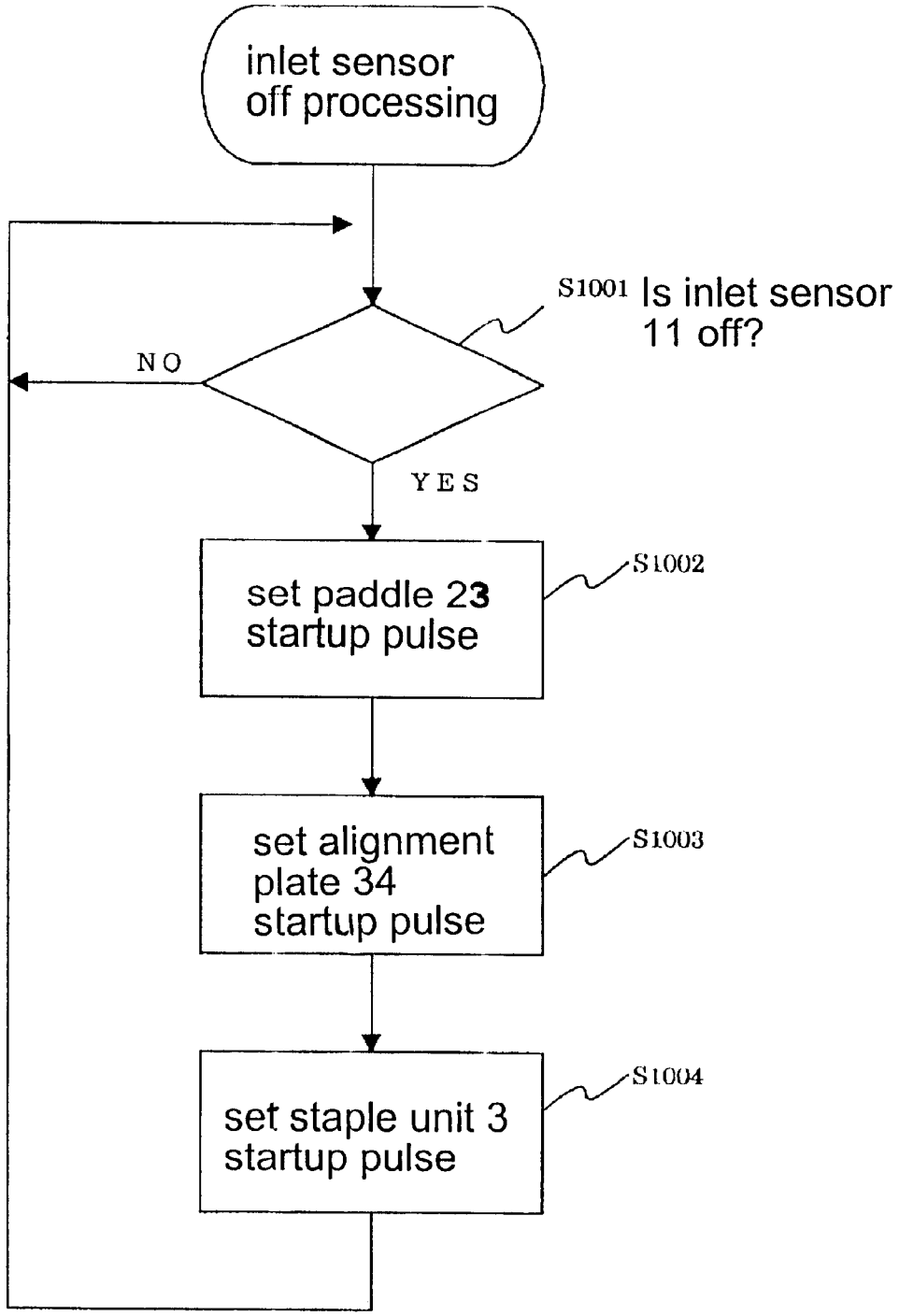
FIG. 35 is a flowchart showing the control of the apparatus after the sheet inlet sensor is OFF.
Figure 36:
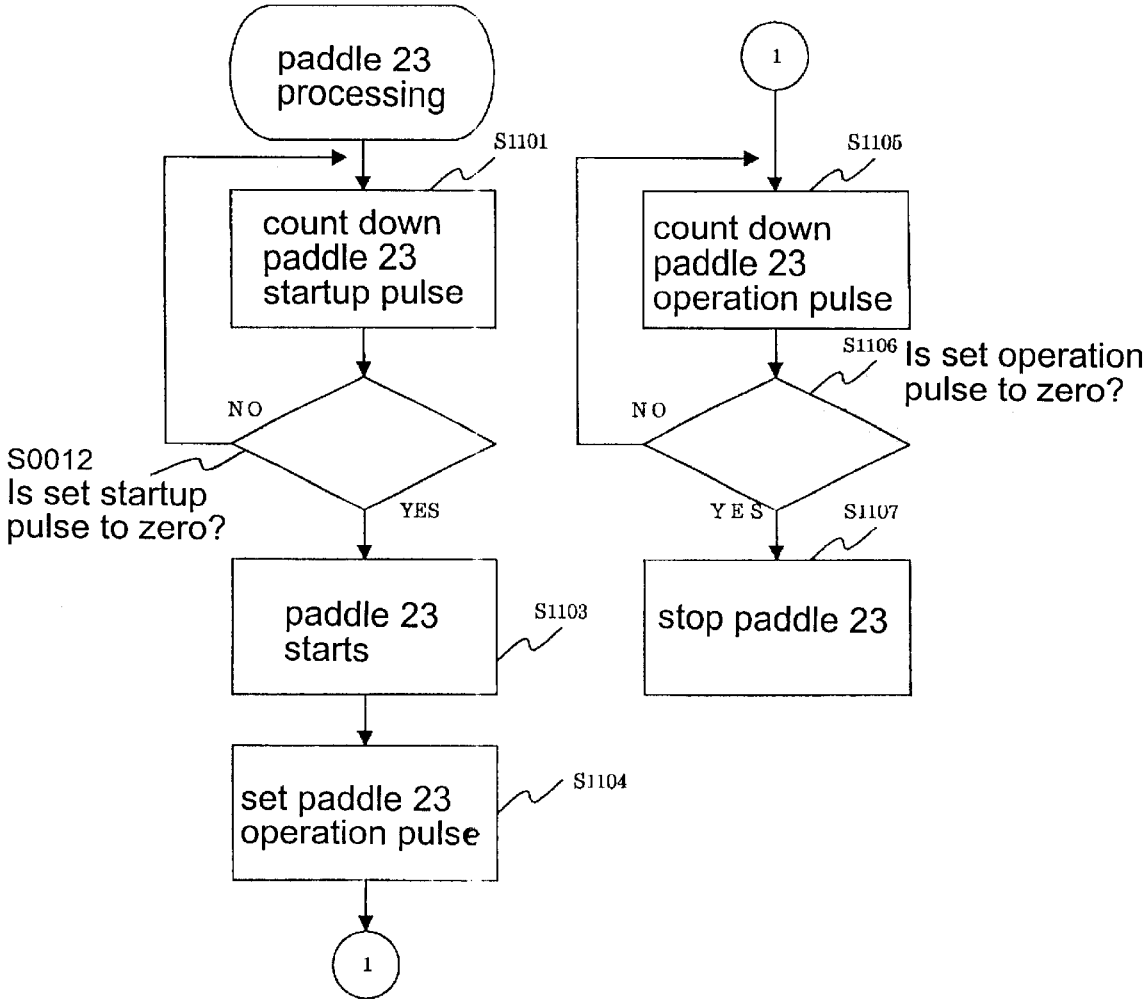
FIG. 36 is a flowchart showing the control of a paddle after the sheet inlet sensor is OFF.
Figure 37:
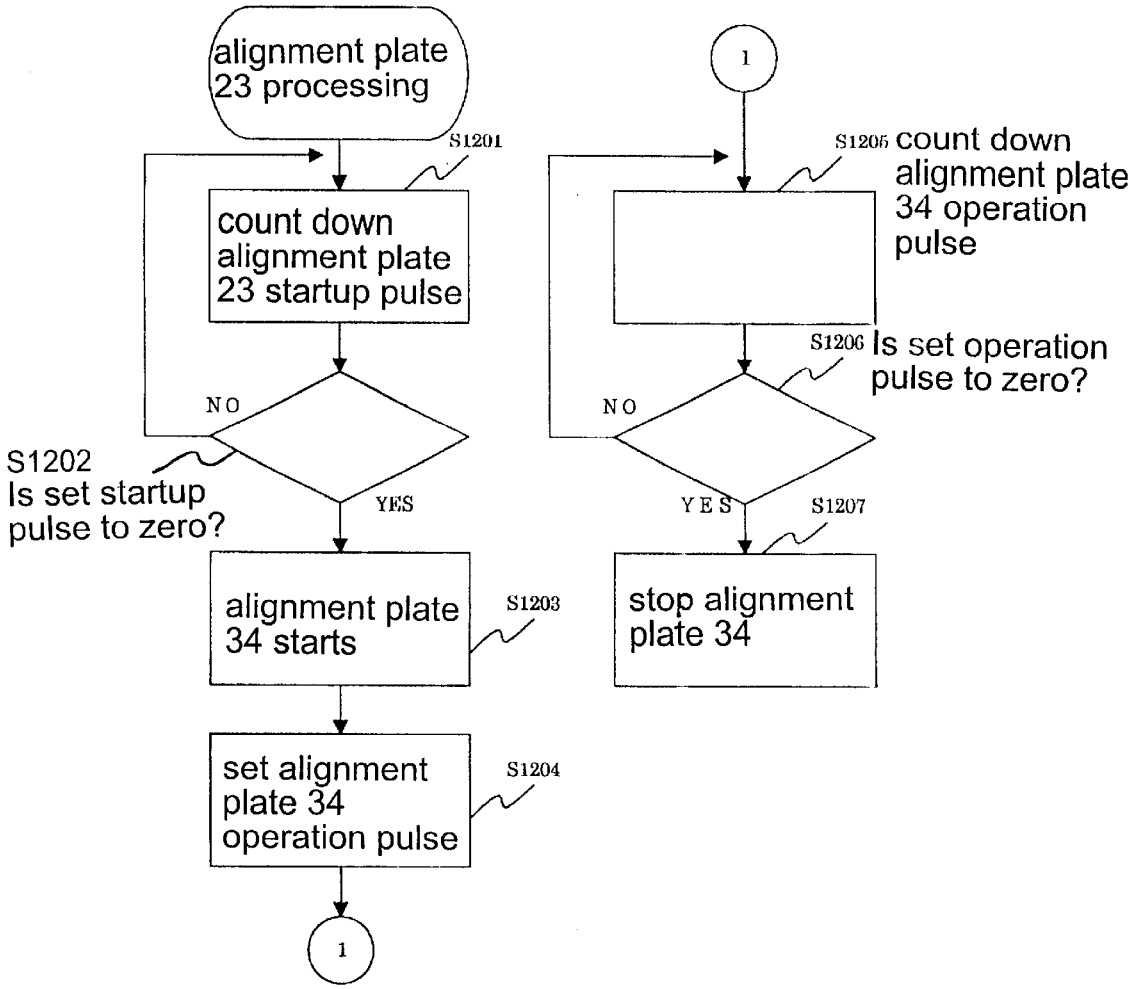
FIG. 37 is a flowchart showing the control of an aligning plate after the sheet inlet sensor is OFF.
Figure 38:
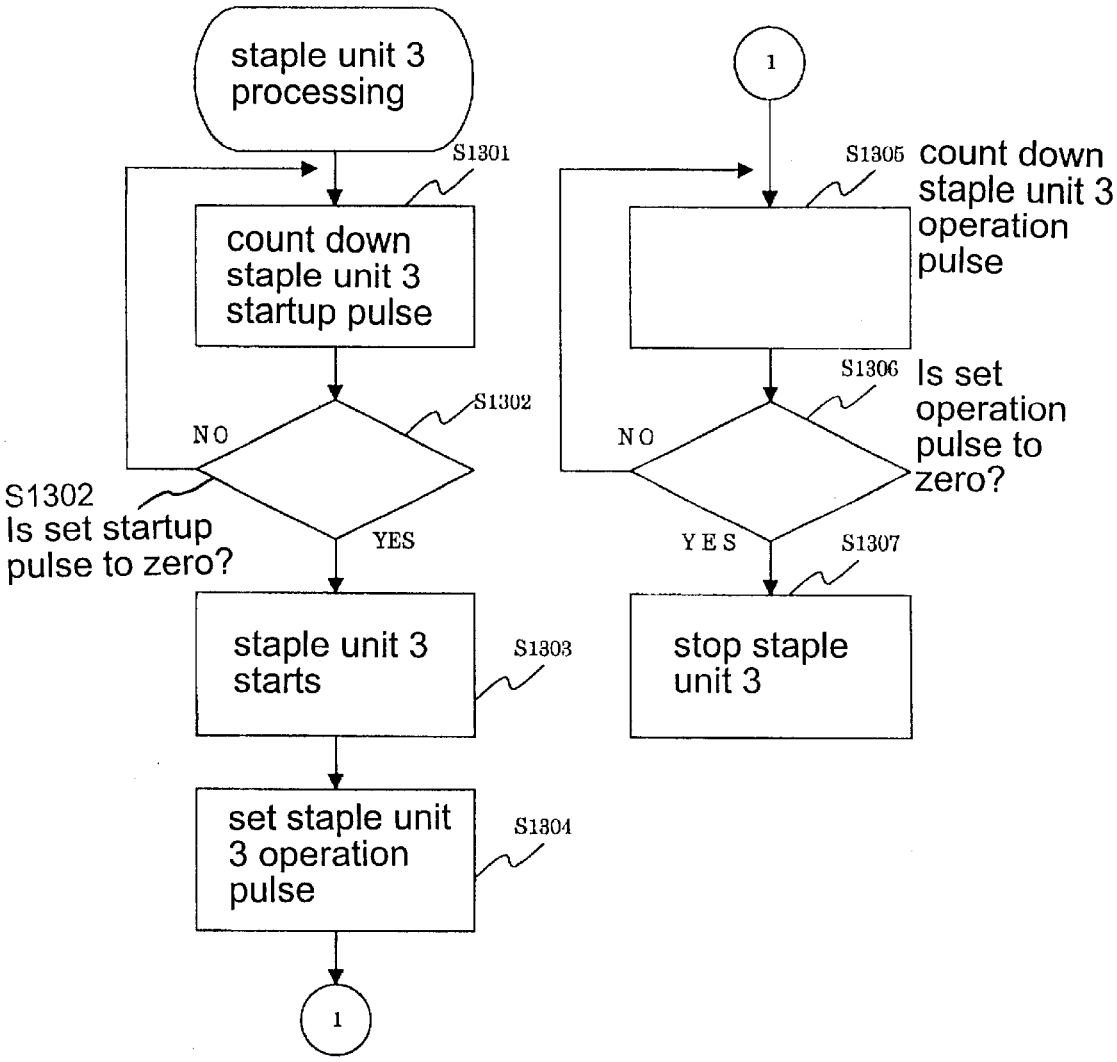
FIG. 38 is a flowchart showing the control of a staple unit after the sheet inlet sensor is OFF.

The startup pulse for the alignment plate 34 is set after setting the startup pulse for the aforementioned paddle 23, as shown in FIG. 35 (S1003).

Note that if there is a plurality of sheets discharged to the processing tray 29, after the alignment plate 34 starts from its prescribed home position to align the sheets, it moves to an idling position closer to the edge of the sheets than the home position and returns to its home position from the idling position after aligning the second and subsequent sheets.

The startup pulse for the aforementioned alignment plate 34 is set to start after the edge of the sheet S reaches the sheet leading restricting portion 29*b* on the processing tray 29 by the paddle 23.

Then, when the startup pulse for the alignment plate 34 is counted down (S1201) to 0 (S1202), the activating pulse required is set to move the alignment plate 34 from its prescribed home position for the first sheet and from the aforementioned idling position for the second and subsequent sheets, and at substantially the same time, the alignment plate 34 is started (S1203) to push each sheet against the main apparatus side frame 2*a* for each sheet (S1204).

At the point (S1206) where the aforementioned activating or operation pulse is counted down to 0 (S1205), the alignment plate 34 is stopped at either the idling position or the home position according to the activating pulse (S1207) and clears the alignment plate 34 activating pulse.

This control is repeated until the final sheet is aligned, and the alignment plate 34 returns to its home position and stops to complete the alignment of the sheet bundle for the prescribed number of sheets. Operations using the aforementioned paddle 23 and the alignment plate 34 are repeated until the prescribed number of the sheets S has been stacked.

After the alignment operation using the alignment plate 34 has been completed, it checks for the staple operation using the staple unit 3 (S1406). Regardless of whether or not there will be a binding operation, the sensor lever 30 and the sheet presence sensor 30*a* detect the presence of the sheets (S1407 and S1411). If no sheet is detected, it sets a waiting pulse to switch the sheet presence sensor 30*a* from no sheet to sheet presence and begins counting down (S1408).

If the sheet presence sensor 30*a* continues to detect no sheet until the wait pulse is counted to 0 (S1409), it determines that the sheet bundle has been pulled out of the processing tray and stops the finisher apparatus 1 as a sheet pull-out jam (S1410) and sends a jam signal to the main apparatus.

When it is confirmed that sheet bundle is to be finished by binding (S1406), the sensor lever 30 and the sheet presence sensor 30*a* detect whether or not there are sheets on the processing tray 29 (S1411). If there is no sheet, it determines as a pull-out jam as just described (S1408, S1409, S1410) or if there are sheets detected on the processing tray 29 (S1411), the sheet bundle on the processing tray 29 is finished by stapling using the staple unit 3.

In this case, as shown in FIG. 35, after setting the startup pulse of the paddle 23 and the startup pulse for the alignment plate 34 to the final sheet, the startup pulse for the staple unit 3 is set (S1004).

Then, subsequent to the counting down to 0 for the aforementioned startup pulse (S1301 and S1302), it starts up the staple unit 3 (S1303) and sets the startup pulse to activate the staple unit 3 at substantially the same time (S1304) to staple using the staple unit 3. The binding operation using the staple unit 3 continues until the activating pulse set after the aforementioned startup pulse is surpassed is counted down (S1305 and S1306) to 0, and then it stops.

After activating the staple unit 3 in this way to finish the sheet bundle on the processing tray 29, the timing drive gear 55 is rotated. This rotation moves the elevator lever 64 downward shown in the drawing thereby moving the rotating unit 24 also to the discharge roller 26 side to touch the follower discharge roller 25 inside the rotating unit 24 to the sheet bundle. Along with this, the timing gear 55 rotates the discharge roller 26 via the intermediate gear 56*a* and the transmission gear 56*b* to discharge the sheet bundle to the stacking tray 5.

The sheets are moved by the paddle 23, the alignment plate 34 and the staple unit while counting down the operation pulse for the aforementioned paddle 23 or the alignment plate 34 (while aligning) or while operating the staple unit 3, so that it is impossible for the sensor lever 30 and the sheet presence sensor 30*a* to accurately detect the presence of sheets because it is easy for the sheets to become bent. By controlling the finisher apparatus 1 and the main apparatus 2 according to the inaccurate detection results of the sensor lever 30 and the sheet presence sensor 30*a,* the finisher apparatus 1 and the main apparatus 2 will stop each time it is detected that there is no sheet when moving the sheet using the paddle 23 or the alignment plate 34 or when binding using the staple unit 3 regardless of whether or not there are sheets on the processing tray 29. There could also be the problem of subsequent sheets being discharged to the processing tray 29 regardless of the sheets being moved by the paddle 23 or the alignment plate 34 or being bound by the staple unit 3.

Figure 39:
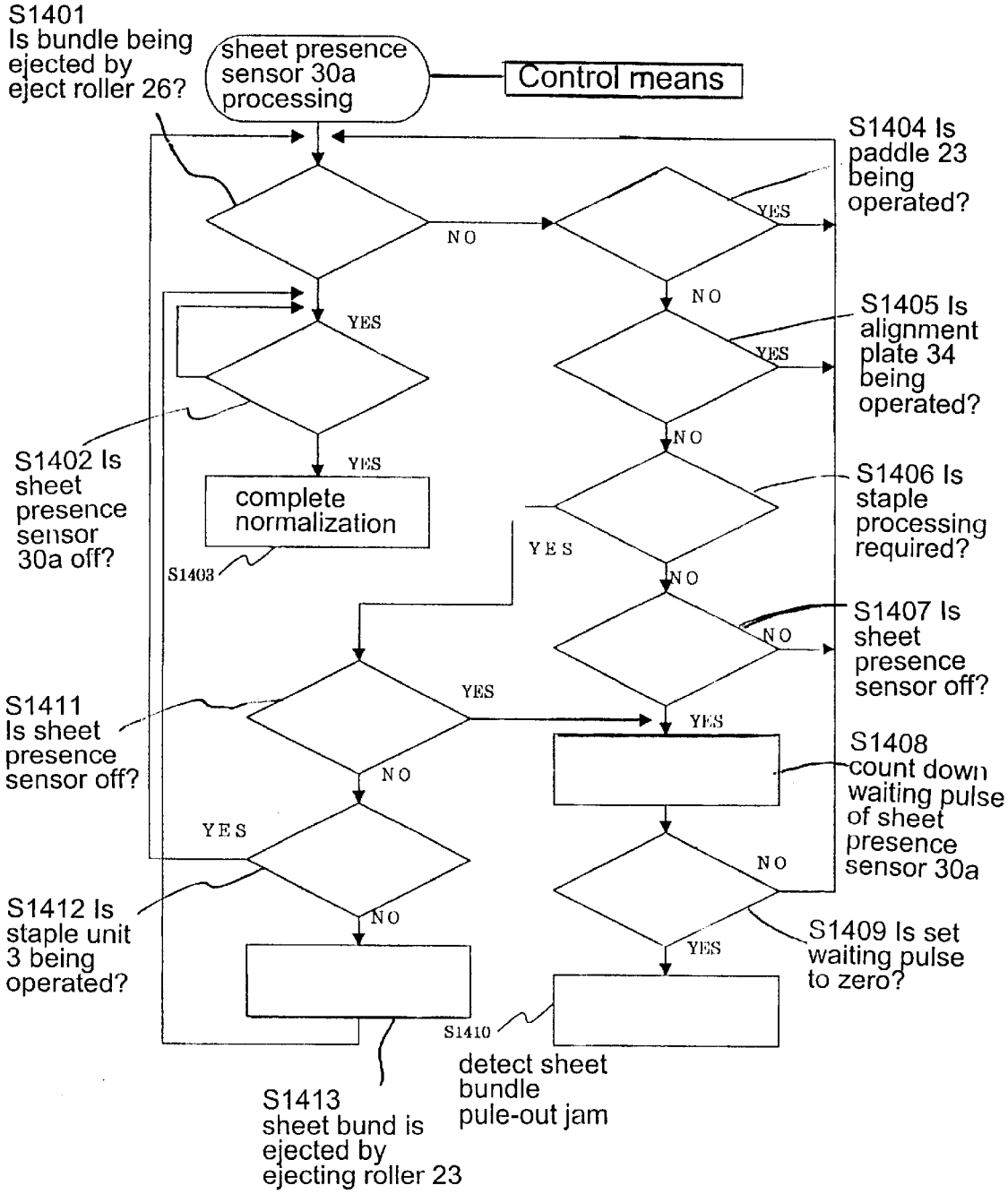
FIG. 39 is a flowchart showing the control of a presence sensor.

Therefore, in the finisher apparatus 1 of the invention, control means in FIG. 39 controls by ignoring the sheet presence detection results of the sensor lever 30 and the sheet presence sensor 30*a* during the count down of the activating or operation pulse of the aforementioned paddle 23 (S1404), the count down of the activating pulse of the alignment plate 34 (S1405) or the count down of the activating pulse of the staple unit 3 (S1412).

According to this embodiment of the invention, the results of the sheet presence detection by the sensor lever 30 and the sheet presence sensor 30*a* are ignored only while the alignment plate 34 is moving for alignment. However, the time for the series of alignments from the first sheet to the completion of the alignment of the final sheet and the alignment plate 34 returns to its home position is considered as the aligning process time. It is acceptable to ignore the sheet presence detections by the sensor lever 30 and the sheet presence sensor 30*a* during this series of alignment operations or to consider only the time while the alignment plate 34 is actually engaging the sheets as the processing time and to ignore the sheet presence detections by the sensor lever 30 and the sheet presence sensor 30*a* only during those times.

In the same way, according to this embodiment of the invention, only when the paddle 23 feeds the sheet S from the second transport path P2 to the processing tray 29 along the third transport path P3, in other words, while the paddle 23 is rotating in the direction opposing the sheet transport direction (the direction opposing the drive roller 19), it is considered to be the aligning time and the results of the sheet presence detections by the sensor lever 30 and the sheet presence sensor 30*a* are ignored. However, the time for reverse transport of all sheets from the first sheet to the final sheet by the paddle 23 may be considered as the series of aligning operations and it is acceptable to ignore the sheet presence detection results by the sensor lever 30 and the sheet presence sensor 30*a* during that time.

According to this embodiment of the invention, the control means for ignoring the sheet presence detection results by the sensor lever 30 and the sheet presence sensor 30*a* while counting the activating pulses of the aforementioned paddle 23, during the counting of the activating pulses of the alignment plate 34 and while counting the activating pulses of the staple unit 3, is disposed on the finisher apparatus 1, but it is also perfectly acceptable to employ the control means on the main apparatus side to ignore the aforementioned sheet presence detection results.

Further, according to this embodiment of the instant invention, the finishing apparatus comprising the staple unit 3 is disposed, but it is possible without saying that such unit could also be employed in the apparatuses such as a sorter or discharge tray that do not comprise the staple unit 3 to be suitable for this invention.

The sheet presence sensor that employs the sensor lever is used as the actuator on the finishing apparatus according to this embodiment of the invention, but again, it is perfectly acceptable to have a finishing apparatus that uses an optical sensor that does not use a sensor lever for the embodiment of the instant invention.

The following shall describe the drive transmission to selectively drive the paddle 23. A lock plate 54*c* that rotates together with the follower gear 54 connected to the paddle drive roller shaft 21*a* to drive the paddle 23 constantly abuts against a reciprocally variable lock pawl 57 by a solenoid 57*b* to stop rotation. In this state, a notched gear 54*b* disposed on the follower gear 54 causes a transmission follower gear 52 to idle. Then, by releasing the engagement of the lock plate 54*c* and a lock pawl 57 by the solenoid drive, the elastic force of a spring 54*d* disposed on the lock plate 54*c* rotates the follower gear 54 which causes the follower gear 54 and the transmission follower gear 52 to mate to rotate the follower gear 54. One rotation thereof allows the lock plate 54 to engage the lock pawl to stop rotation.

In other words, in a condition that the lock plate 54*c* engages the lock pawl 57, the drive from the transmission follower gear 52 does not rotate the follower gear 54 because the notched gear 54*b* opposes the transmission follower gear 52. So the paddle 23 engaging the follower gear 54 is not rotationally driven unless the lock pawl 57 is released from engaging the lock plate 54*c*.

Note that it is acceptable to eliminate the stapling process using the staple unit 3 in the aforementioned staple mode, and to discharge the sheets to the stacking tray 5 after only aligning the discharged sheets at the processing tray using the alignment plate 34 and to jog sheets for stacking by shifting them on the stacking tray 5 by alternately discharging the sheets to the stacking tray 5 in the aforementioned pass-through mode.

The jog process is acceptable for one sheet aligned by the alignment plate 34 discharged to the processing tray 29. In that case, the alignment plate 34 aligns the sheet from the aforementioned prescribed home position and returns to its prescribed home position to stop.

In this jog process, it is possible to apply the control means for ignoring the detection results of the sensor lever 30 and the sheet presence sensor 30*a* while aligning the aforementioned paddle 23 and the alignment plate 34.

Therefore, in the pass-through mode, the paddle 23 is stopped without releasing the engagement of the lock plate 54*c* and the lock pawl 57 to lower the rotating unit 24 and discharge the sheet S to the stacking tray 5. In the staple mode, when the trailing edge of the sheet S passes the endless belt drive roller 19 and the follower roller 17, the lock pawl 57 is released from the lock plate 54*c* to rotate the paddle 23 to enable feeding the sheet S into the processing tray 29.

The following will describe the timing drive gear 55 that operates the elevator lever 64 used in raising and lowering the rotating unit 24.

This timing drive gear 55 is equipped with a locking pawl 60 disposed on one side in FIG. 9 of the timing drive gear 55 to constantly engage the reciprocally variable lock pawl 59 by the solenoid 59*a* to stop the rotation of the timing drive gear 55, a wheel 61 to rotate the timing drive gear 55 in the counter-clockwise direction when the engagement of the lock pawl 59 and locking pawl 60 is released, notched gears 62 and 63 that idle the rotating unit 24 and the follower roller drive transmission gear 56*a,* and a cam 65 that reciprocates along the shaft direction of the elevator lever 64 and engages the leading edge 64*a* on the elevator lever 64 which is disposed on the other side of the timing drive gear 55 to rotate the rotating unit 24. On the elevator lever 64, a leading edge 64*a* is constantly urged to the elastic contact direction of the cam 65 by a spring 66, and in the initial state, the engagement of the leading edge 64*a* and the oblong hole 68 allows the leading edge 64*a* to separate from the cam 65.

Next, explanation will be made for the operation of the timing drive gears according to FIG. 11(A) to FIG. 12(B) as an example of finishing the sheet S. As described above, the processing mode for the sheet S comprises the staple mode and the pass-through mode. The method used to feed the sheet S varies according to the mode, so in the following, the staple mode is first described.

In the staple mode, stapling is made as a post processing for finishing the sheet bundle, and the number of originals processed on the image forming apparatus unit G is counted when reading images. The binding process occurs based upon the count and the number of created sheet bundle. These bound sheet bundle is then stacked in this mode.

In other words, when a first sheet in one unit or bundle is supplied to the inlet 7, the sheet inlet sensor 11 disposed between the inlet 7 and the transport roller 15 detects the sheet. Based on the detection result of this sensor, the drive motor 43 begins to drive thereby rotating the rotating belt 48 which in turn rotates the transport roller 15, the discharge roller 28 and the endless transport belt drive roller 19.

Figure 11A:
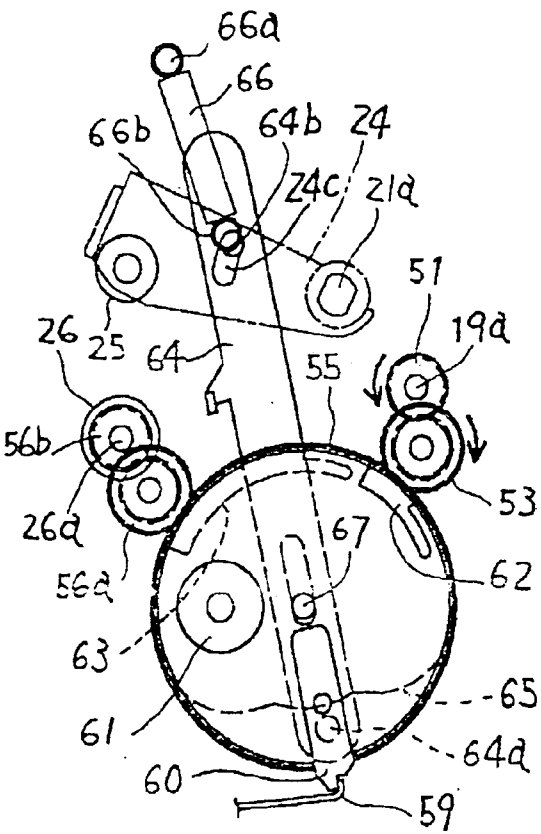
FIGS. 11(A)–11(C) are explanatory views showing the operation of a drive transmission system (1) shown in FIG. 9.

At this time, the transmission follower gear 52 also rotates, but the follower gear 54 is opposed to the notched gear 54*b* so that drive is not transmitted and it stops rotating. Furthermore, as shown in FIG. 11(A), the follower transmission gear 53 also rotates, but the notched gear 62 on the timing drive gear 55 opposes the follower transmission gear 53 so the lock pawl 59 and the abutting portion 60 engage to stop the rotation of the timing drive gear 55 and the discharge drive transmission gear 56*a*.

Also, the sheet S is transported toward the level of the first transport path P1 in the transport guide 8 by the cooperation of the follower roller 14 and transport roller 15, and the cooperation of the follower roller 17 and the endless transport belts 18. When the sheet inlet sensor 11 detects the trailing edge of the sheet S in the direction of transport thereof, after a prescribed amount of time has passed, when the leading edge of the sheet S is positioned from the discharge outlet 10 onto the stacking tray 5, the trailing edge of the sheet S exits from between the follower roller 17 and the endless transport belts 18 wherein it faces the direction of the third transport path P3 by the drop portions 18*b* on the endless transport belts 18.

In this state, to permit the rotation of the paddle 23, the solenoid 57*b* activates to release the engagement of the lock plate 54*c* on the follower gear 54 and the lock pawl 57. The rotation of the follower gear 54 begins by the spring 54*d*. In association with this rotation, the follower gear 54 and the transmission follower gear 52 mesh to rotate the follower gear 54, which is disposed on the paddle drive roller shaft 19*a* thereby rotating the paddle 23.

This paddle 23 returns the sheet S in the direction opposing the direction of transport fed up to that point and feeds it to the sheet stacking portion 29*a* and the endless transport belts 18. The edge of the sheet S then touches the sheet leading restricting portion 29*b* on the processing tray 29.

Then, the alignment plate drive motor 36 drives to move the alignment plate 34 to align the sheet S by touching it against the main apparatus side frame 2*a* to which the staple unit 3 is mounted in a position opposing the direction of travel of the alignment plate 34.

At that point, the operations describe above are performed for each sheet S transport. When the prescribed number of sheets has been stacked, the staple unit 3 drives to bind the sheet S with the staple.

Figure 11B:
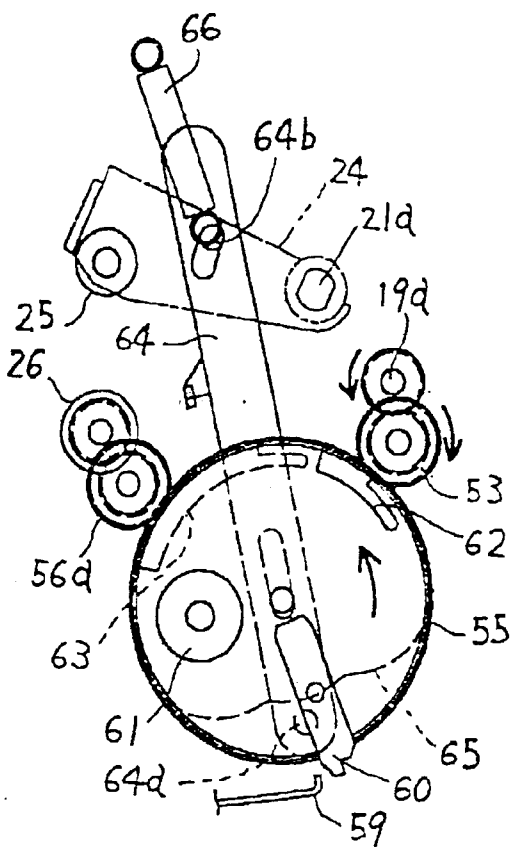

When the staple binding operation is executed, to allow the rotation of the timing drive gear 55, the timing solenoid 59*a* activates, as shown in FIG. 11(B), to release the engagement of the lock pawl 59 and the abutting portion 60 on the timing drive gear 55 and the timing drive gear 55 is rotated in the counter-clockwise direction by the weight of the wheel 61.

This rotation causes the follower transmission gear 53 to separate from the notched gear 62 and to mesh with the timing drive gear 55. Drive from the follower transmission gear 53 is received to start rotating the timing drive gear 55.

Figure 11C:
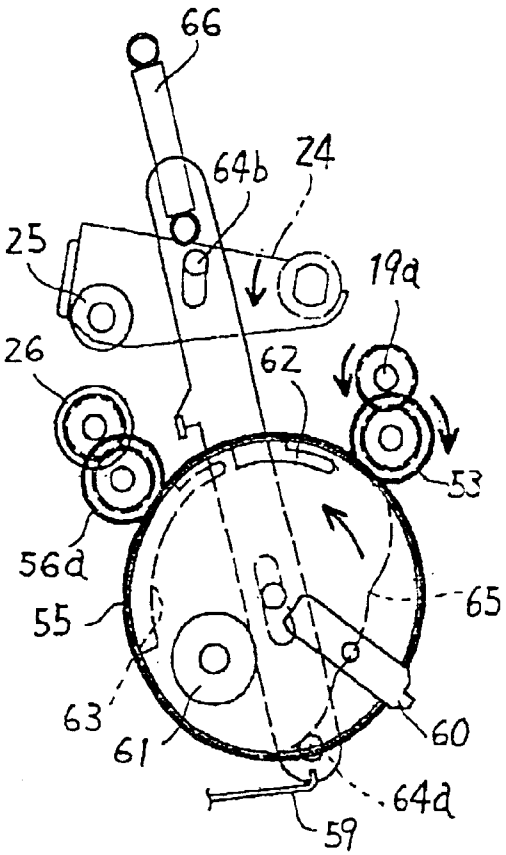

Then, as can be seen in FIG. 11(C), the leading edge cam follower portion 64*a* on the elevator lever 64 positioned on the back side of the timing drive gear 55 resists the urging force in the upward direction of the drawing of the spring 66 by the shape of the cam, in elastic contact with the timing drive gear 55 and the cam portion 65 to start the downward direction movement of the elevator lever 64 in the drawing. By the elevator lever 64 moving downward, the elevator pin 64*b* engages the slit 24*c* on the rotating unit 24 and also lowers thereby starting the downward movement of the rotating unit 24 in the drawing. In FIG. 11(A) to FIG. 12(B), the slit 24*c* on the rotating unit and the elevator pin 64*b* are positioned on the back side of the elevator lever 64, but in these drawings they are shown as solid lines for explanatory purposes.

After the rotating unit 24 starts its downward movement, the discharge roller drive transmission gear 56*a* separates from the notched gear 63 on the timing drive gear 55 and meshes the timing drive gear 55 to start rotating the discharge roller drive transmission gears 56*a* and 56*b*, thereby starting the rotation of the discharge roller 26.

Figure 12B:
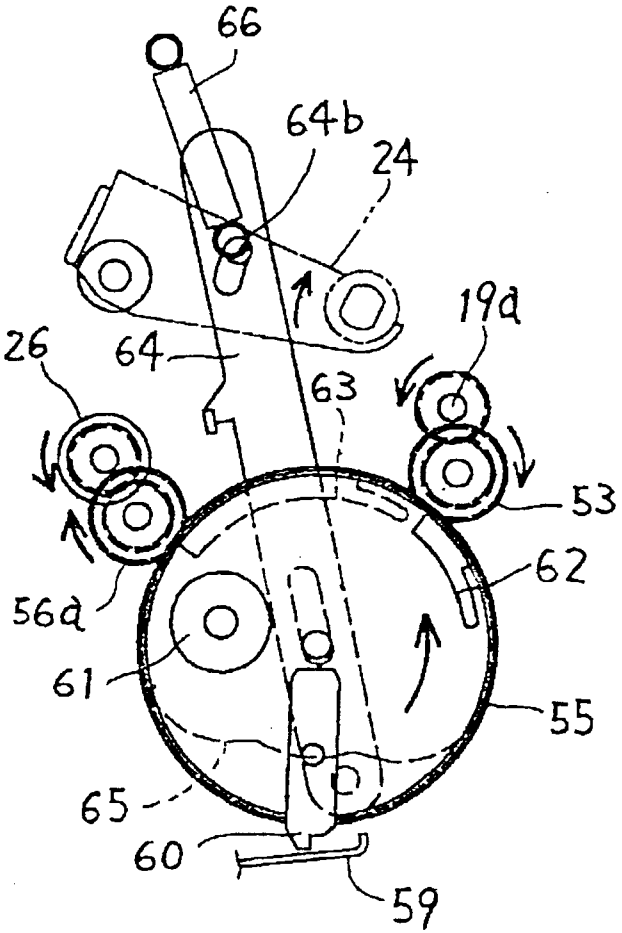
FIGS. 12(A) and 12(B) are explanatory views showing the operation of a drive transmission system (2) shown in FIG. 9.
Figure 12A:
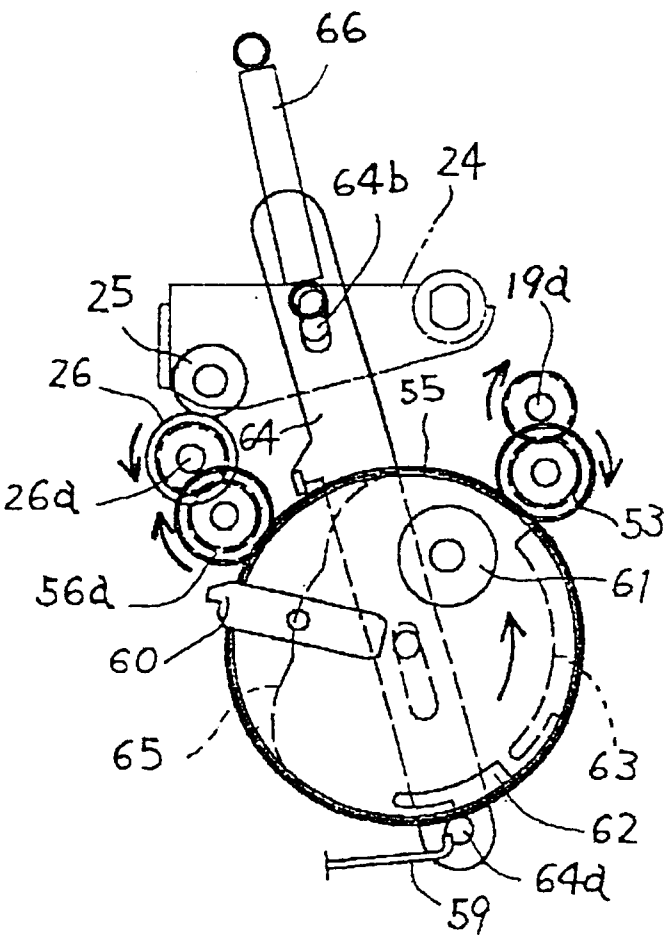

Next, as shown in FIG. 12(A), when the leading edge 64*a* on the elevator lever 64 elastically contacts the outermost circumference of the cam portion 65 having a diameter substantially equivalent to the timing drive gear 55, the discharge roller 26 and the follower roller 25 on the leading edge side of the rotating unit 24 nip the sheet S bundle and bind them, subsequently discharging the sheet bundle to the stacking tray 5. The completion of the discharging of the sheet S is detected by the sheet presence sensor 30*a* for detecting the upward return of the sensor lever 30 which is positioned at the leading edge of the processing tray 29 shown in FIG. 2 and FIG. 3.

When the sheet S bundle is discharged to the stacking tray 5 after binding, the elastic contact of the leading edge 64*a* on the elevator lever 64 and the cam portion 65 is released, as shown in FIG. 12(B), and the rotating unit 24 begins rotating in the upward origin direction. After the follower roller 25 separates from the discharge roller 26, the notched gears 62 and 63 on the timing drive gear 55 move to a position that resists the intermediate gear 56*a* that transmits drive force to the transmission follower gear 53 and the discharge roller 26 and return to their original positions, as shown in the status of FIG. 11(A).

The explanation will be made for the pass-through mode. This mode transfers the sheet S discharged from the image forming apparatus G directly into the stacking tray 5 from the first transport path P1 via the second transport path P2 and the sheet S is not bound using the staple unit. This mode is applied to stack large quantities of the sheet S. The operational differences of this mode and the staple mode are that the paddle 23 is not constantly rotated and the starting of the rotation of the timing drive gear 55 is early in accordance with the timing of the transport of the sheets.

In other words, when the sheet S is supplied to the inlet 7, the sheet inlet sensor 11 disposed between the inlet 7 and the transport roller 15 detects the sheet. Based on the detection result of this sensor, the drive motor 43 begins to drive thereby rotating the rotating belt 48 which in turn rotates the transport roller 15, the discharge roller 28 and the endless transport belt drive roller 19.

At this time, as shown in FIG. 11(A), the follower transmission gear 53 also rotates, but the notched gear 62 on the timing drive gear 55 opposes the follower transmission gear 53, so that the lock pawl 59 and the abutting portion 60 engage to stop the rotation of the timing drive gear 55 and the discharge drive transmission gear 56*a*.

After the sheet inlet sensor 11 detects the leading edge of the sheet S, for a slight delay, to permit the rotation of the timing drive gear 55, the timing solenoid 59*a* activates, as shown in FIG. 11(B), to release the engagement of the lock pawl 59 and the abutting portion 60 on the timing drive gear 55, and the timing drive gear 55 is rotated in the counter-clockwise direction by the weight of the wheel 61.

This rotation causes the follower transmission gear 53 to separate from the notched gear 62 and to mesh with the timing drive gear 55. Drive from the follower transmission gear 53 is received to start rotating the timing drive gear 55. The operations after that are performed in the same manner as those in the staple mode from FIG. 11(C) to FIG. 12(B). Therefore, the rotating unit 24 operates up and down for each time the sheet S is transported into the main apparatus 2 and is discharged to the stacking tray 5. The completion of the discharging of the sheet S is detected by the sheet presence sensor 30*a* detecting the resetting of the sensor lever 30 which is positioned at the leading edge of the processing tray 29 shown in FIG. 2 and FIG. 3.

Note that because the paddle 23 is not rotated, the solenoid 57*b* does not activate when executing the pass-through mode, and the lock plate 54*c* on the follower gear 54 and the lock pawl 57 are in the engaging state.

Finally, the escape mode discharges a special sheet, such as non-standard size sheet, to the escape tray 6. The rotating flapper 16 is rotated counter-clockwise from the state shown in FIG. 2 and FIG. 3 to transport the sheet S from the first transport path P1 to the fourth transport path P4 and to the escape tray 6 by the second discharge roller 28.

In this case, the escape mode is preset to rotate the flapper 16 to be positioned to guide the sheet S into the fourth transport path P4. In this state, the sheet inlet sensor 11 detects the sheet S when it is supplied from the inlet 7 and the drive motor 43 starts driving. The result is that the transport roller 15 and the second discharge roller 28 are drivingly rotated to discharge the sheet S to the escape tray 6.

Since the rotations of the paddle 23 and the timing drive gear 55 are unnecessary, the solenoid 59*a* that permits the rotation of the paddle 23 and the timing drive gear 55 is not activated.

In these operations, the sheet S is discharged from the discharge outlet 10 on the main apparatus 2, but in the following, explanation is made for the stacking tray 5 that stacks the discharged sheet S.

Figure 13A:
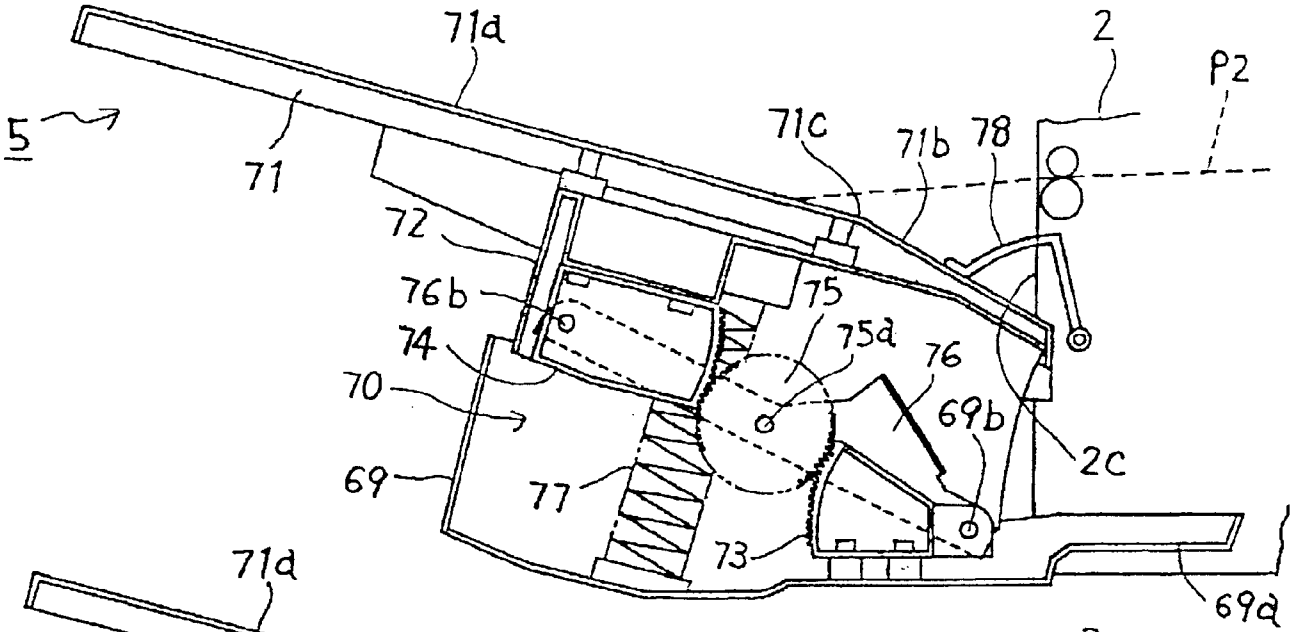
FIGS. 13(A) and 13(B) are front sectional views of the general stacking tray.
Figure 13B:
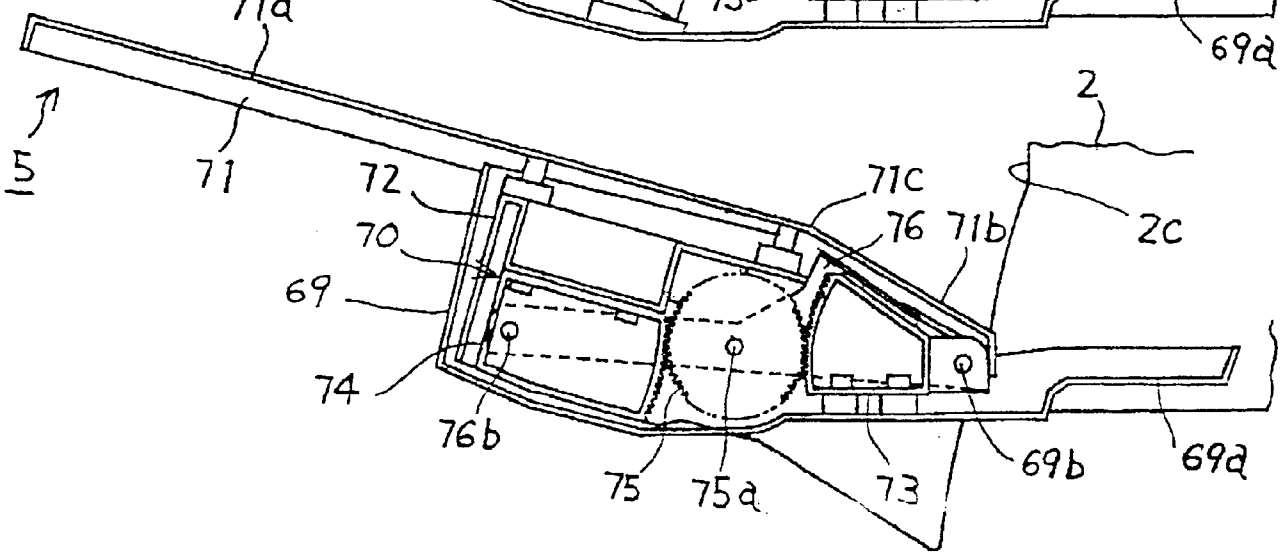

As can be seen in FIG. 13(A) and FIG. 13(B), the stacking tray 5 includes a base 69 having a mounting portion 69*a* detachable to the main apparatus 2, a sheet storage portion 71 held to move up and down via an elevator control unit 70 to the base 69, and a support bracket 72 fastened to the bottom of the sheet storage portion 71. The support bracket is fastened to the top of a movable gear 74.

The elevator control unit 70 is equipped with a cylindrical fastening gear 73 fastened to the base 69, the movable circular arc gear 74 fastened to the support bracket 72, a planetary gear 75 that meshes the gears 73 and 74 to displace, a shaft arm 76 that is connected to the gears 73 and 74 and the planetary gear 75 for fixing each of the relative distances, and a coil spring 77 that constantly urges the sheet storage portion 71 upward and disposed between the top surface of the base 69 and the bottom surface of the support bracket 72.

There are two coil springs 77 disposed to sandwich the gears 73 and 74 and the gear 75. They displace the sheet storage portion 71 according to the weight of the sheet S stacked sequentially on the top of the sheet storage portion 71. The spring constant is set so that it is possible to sequentially stack the subsequent sheets on top of the sheet S to have substantially a constant height.

When the sheet storage portion 71 that is the support surface for the sheets is displaced downward in resistance to the urging forces of the coil springs 77, the upper surface of the sheet storage portion 71 mounted via the support bracket 72 on the upper surface of the movable gear 74 moves in a parallel state from the upper position shown in FIG. 13(A) downward to the lower position shown in FIG. 13(B) as the weight of the sheets S increases. Therefore, the sheet storage portion 71 lowers according to the weight of the stacked sheets while the upper surface of the sheet storage portion 71 and the sheet restricting surface 2*c* that restricts the edges of the stacked sheets, disposed on the front of the main apparatus 2, constantly maintain substantially the same state without large variations in the angle created, thereby enabling a substantially constant height distance between the stacked sheet upper surface and the discharge roller 26.

The upper surface of the sheet storage portion 71 is made to allow the sheets that are stacked thereupon to slide under their own weight. Furthermore, it is formed to have an angle from the sheet restricting surface 2*c* on the main apparatus 2 to gradually increase toward the upstream direction in the sheet discharge direction. Still further, the degree of the angle near the sheet restricting surface 2*c* is set to be different from the angle at the upstream side thereof.

In other words, the angle created by a line SP extending in the direction of the discharge of the sheet that is restricted by the discharge roller 26 and the discharge follower roller, and the upper surface of the sheet storage portion 71*a* forming the upper surface support portion of the first support surface 71*a*, has a relatively small angle $\alpha$ and the second support surface 71*b* on the sheet restricting surface side is set with the angle $\beta$ which is larger than the angle $\alpha$.

Therefore, the level for the sheet restricting surface 2*c* is set to be large with respect to the discharge roller 26, so even if the trailing edge of the sheet that is stacked on the sheet storage portion (the edge of the sheet restricting surface) curls upward, in the drawing, the edges of the subsequently discharged sheet S will have less chance to touch the trailing edge of the previously discharged sheet and thereby preventing the leading edge of the sheet S to be caught to the curled sheet that was discharged.

Note that according to the test, when using the copy sheet used in a conventional apparatus, it is preferred that the angle $\alpha$ formed by the aforementioned line SP extending in the direction of sheet transport and the upper surface of the sheet storage portion 71 be within a range of 15° to 23° and more than 25° for the larger angle $\beta$. However, these angles vary according to the thickness and material quality of the sheet used and are not particularly limited to these angle values. If necessary, it is also perfectly acceptable to make the angle a larger than the angle of $\beta$.

The drawing shows the second support surface 71*b* that is angled and connected continuously to the first support surface 71*a* via a bend portion 71*c*, but it is also possible to eliminate the levels, i.e. step, and to connect the first support surface 71*a* and the second support surface 71*b* to gradually change the angle of the bend portion 71*c* in a circular arc surface. In other words, it is acceptable to have a large level between the discharge outlet 10 and the second support surface 71*b*, rather than simply extending the upper surface of the first support surface 71*a* to the sheet restricting surface 2*c*.

Furthermore, the apparatus of the present embodiment alleviates the problems of upward and downward curls when overlapping the sheet over the processing tray 29 and the aforementioned sheet storage portion 71, because the leading edge of the sheet on the sheet storage portion side is set to be positioned further upstream in the sheet discharge direction than the aforementioned bend portion 71*c* even when using the minimum size of sheet that can be stacked.

Also, the staple unit side on the second support surface 71*b* is disposed with a notched portion 71*d* as can be seen in FIG. 1. This notched portion 71*d* is to prevent the stapled side of the sheet bundles from rising due to the size of the staples, even when the sheet bundles that have been stapled are stacked.

As shown in FIG. 2 and FIG. 3, the sheet holding lever 78 to push the trailing edge of the sheet S (the edge by the sheet restricting surface 2*c*) from above the second support surface 71*b* on the sheet storage portion 71 is made to appear from the sheet restricting surface 2*c*. Therefore, even if a large curl is formed in the sheet S on the second support surface, it will securely stack on the sheet storage portion 71.

The sheet holding lever 78 rotates by using a rotating shaft 82 as the shaft pivot. When a sheet stack volume detection sensor 85 is detecting the lever end on the sheet holding lever 78 while it is holding the sheet, it determines that it is positioned at the lower limit of the sheet storage portion 71 and outputs a stop signal to the image forming apparatus G.

The following describes the sheet S stacking operation when discharged from the main apparatus 2 according to FIGS. 14(A) to 15(B).

Figure 14A:
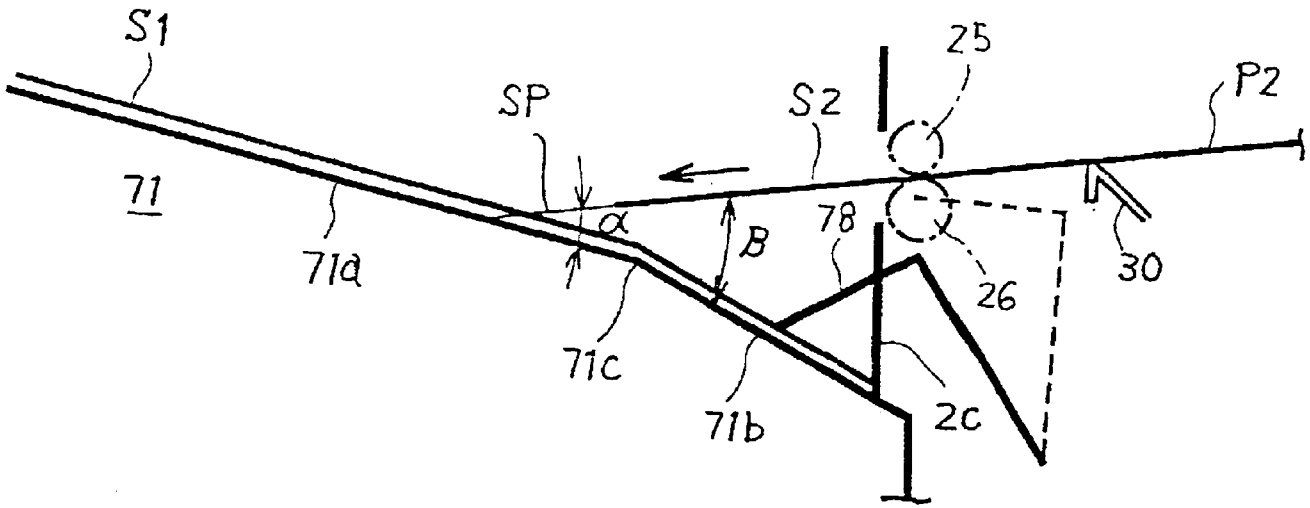
FIGS. 14(A) and 14(B) are explanatory views showing the operation of the sheet stacking on a stacking tray (1)

Initially, the first sheet S1 discharged, shown in FIG. 14(A), is stacked on the upper surface of the sheet storage portion 71 and the end thereof is pressed by the sheet holding lever 78 onto the second support surface 71*b*. Subsequently, the sheet S2 is transported along the second transport path P2 to be discharged along the discharge path by the discharge roller 26. The sheet S2 is discharged along the line SP extending in the direction of the discharge of the sheet, but this line SP traverses the first sheet support surface of the sheet storage portion 71, the angle thereof being set to the comparatively smaller angle $\alpha$. Therefore, even if the leading edge of the sheet S2 curls downward, this angle is smaller, so that the leading edge of the sheet S is not transported with its bend toward the second sheet support surface but is guided downstream in the sheet discharge direction along the first support surface 71*a*.

Also, because the trailing edge of the initially stacked sheet S is being held to the second support surface 71*b* by the sheet holding lever 78, the sheet S will not be moved by the sheet S2.

Figure 14B:
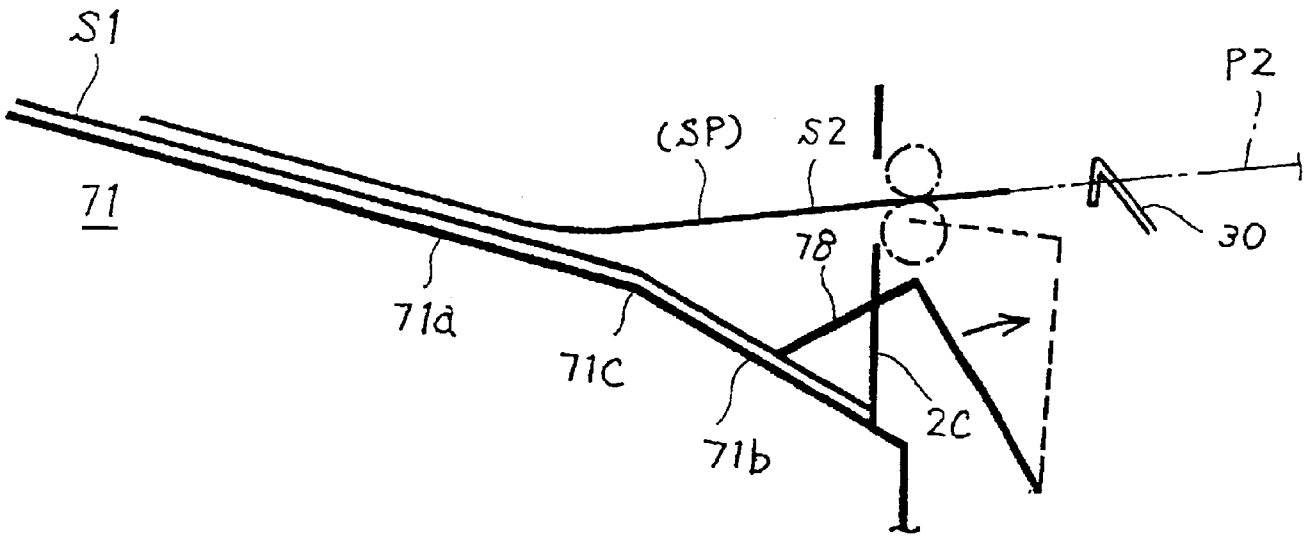

FIG. 14(B) shows the trailing edge of the sheet S passing through the sensor lever 30. After a prescribed small amount of time since the passing signal, the trailing edge of the sheet S2 is discharged from the discharge roller 26 and it begins to fall toward the second support surface 71*b*. At substantially the same time as the discharge, the pressing solenoid 83 shown in FIG. 2 activates for retracting the sheet holding lever 78 into the sheet restricting surface 2*c* as shown by the direction of the arrow in FIG. 14 (B).

Figure 15A:
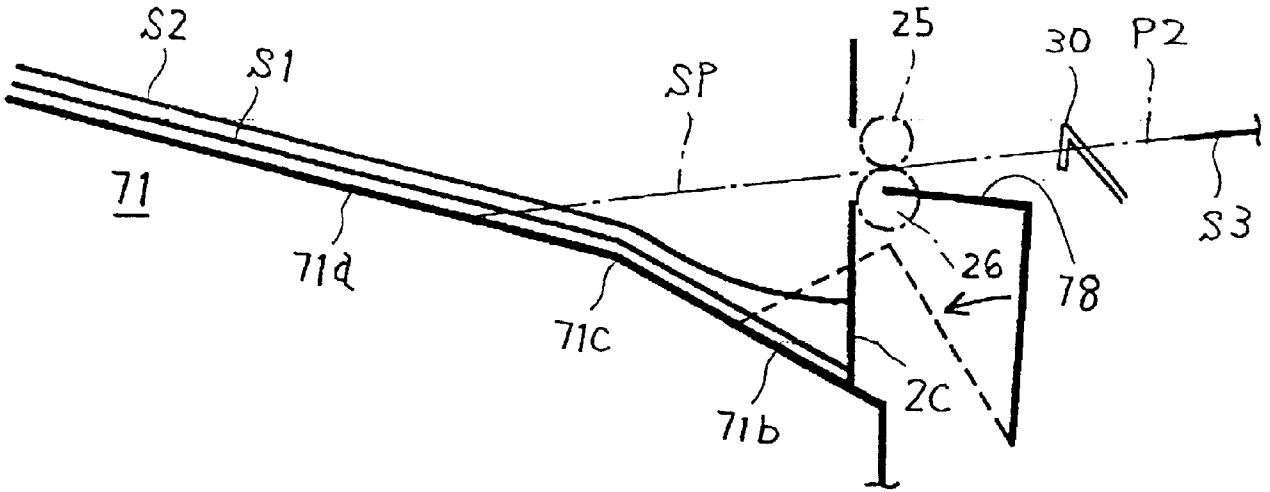
FIGS. 15(A) and 15(B) are explanatory views showing the operation of the sheet stacking on a stacking tray (2)
Figure 15B:
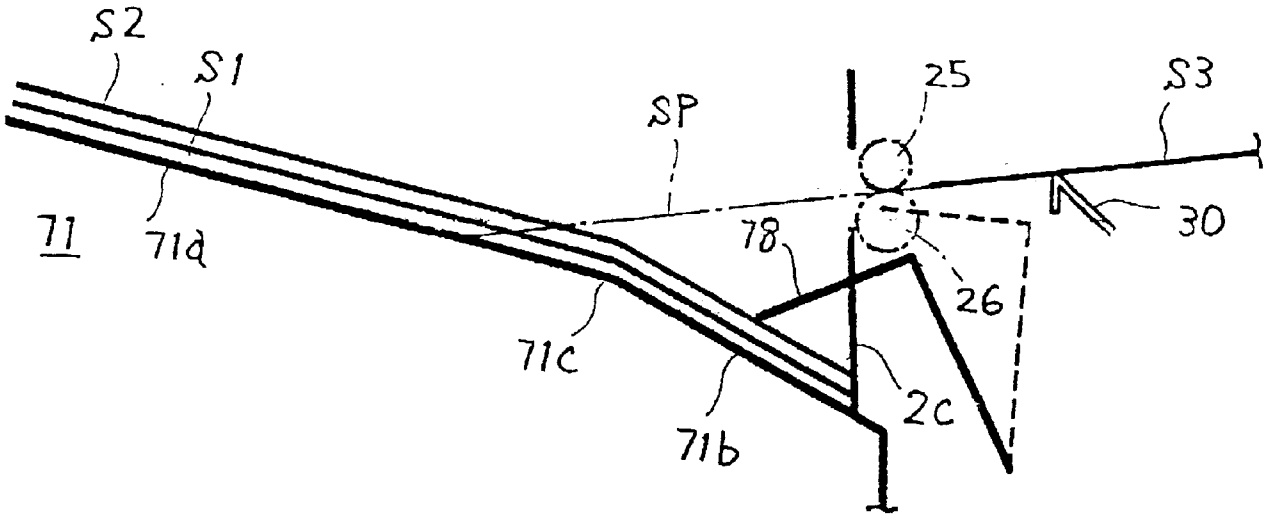

After retracting, the sheet S2 falls toward the second support surface 71*b,* as can be seen in FIG. 15(A), but there is a delay in the falling time and the lever solenoid is deactivated with the delay. This deactivation returns the sheet holding lever 78 by the spring 84 to move toward the second support surface in the direction of the arrow in the drawing. Then, in the state shown by FIG. 15(B), it presses the edge at the sheet restricting surface 2*c,* i.e. the trailing edges of the sheet S1 and sheet S2.

Because, as described above, the angle $\alpha$ formed by the line extending in the direction of sheet discharge for the sheet S and the first support surface is smaller than the angle $\beta$ formed by the second support surface on the sheet restricting surface 2*c* side, it is possible to make a long distance between the discharge roller 26 and the second support surface and push the sheets from above, so that the stacked sheets do not jam and the stacking performance is improved.

Also, when discharging the bundles of the sheets S, the same operations are performed as in the single sheet, so in this case, the stacking performance for the sheet bundles is also improved. As the volume of the sheets S stacked upon the stacking tray 5 increases, the coil springs 77 compress to allow the stacking tray 5 to maintain substantially a constant height for the uppermost sheet of the sheets S.

Then, when the sheet is straddling between the stacking tray 5 and the processing tray 29, the sheet is shifted in the width direction by the aligning plate, but because the sheets in the stacking tray 5 are held by the sheet holding lever 78, there is no disturbance to the alignment of the sheets already stacked in that tray.

Figure 16:
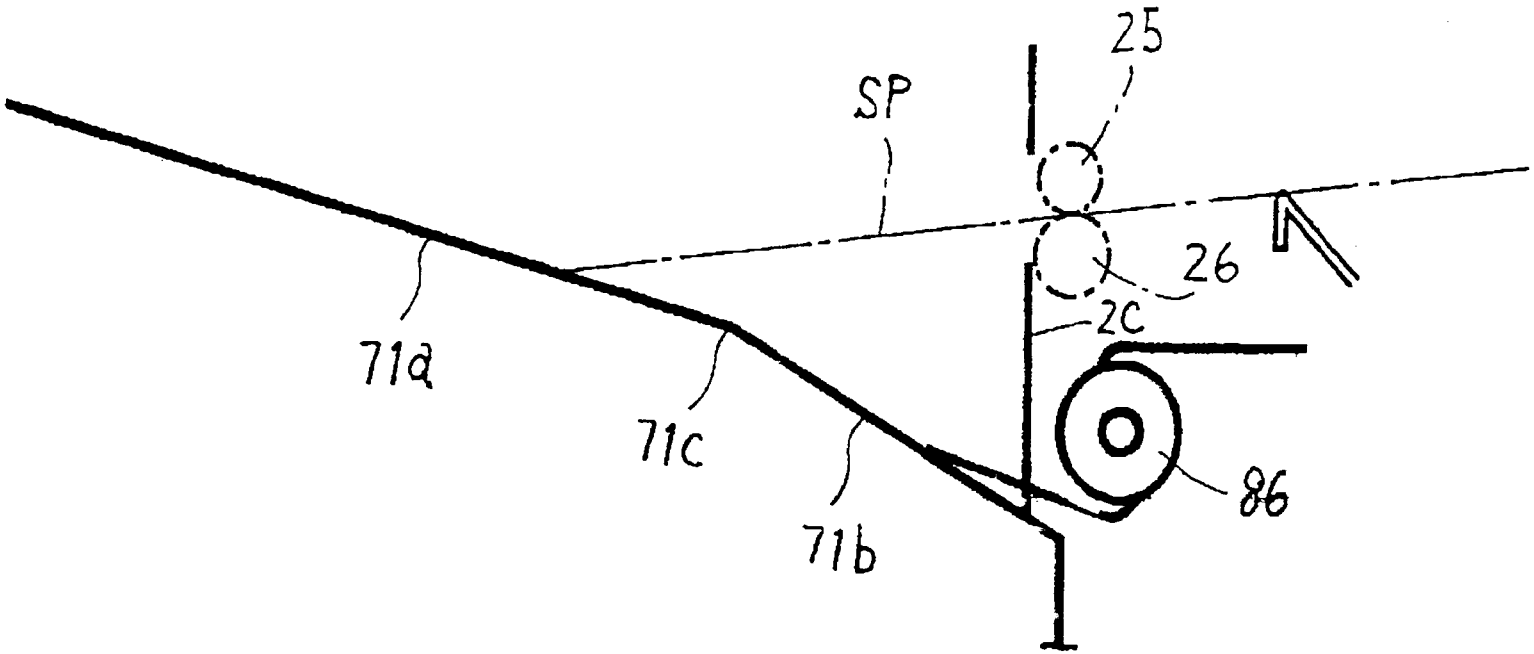
FIG. 16 is a conceptual view of another embodiment of a pressing lever that presses the sheets on the stacking tray shown in FIG. 2.
Figure 17:
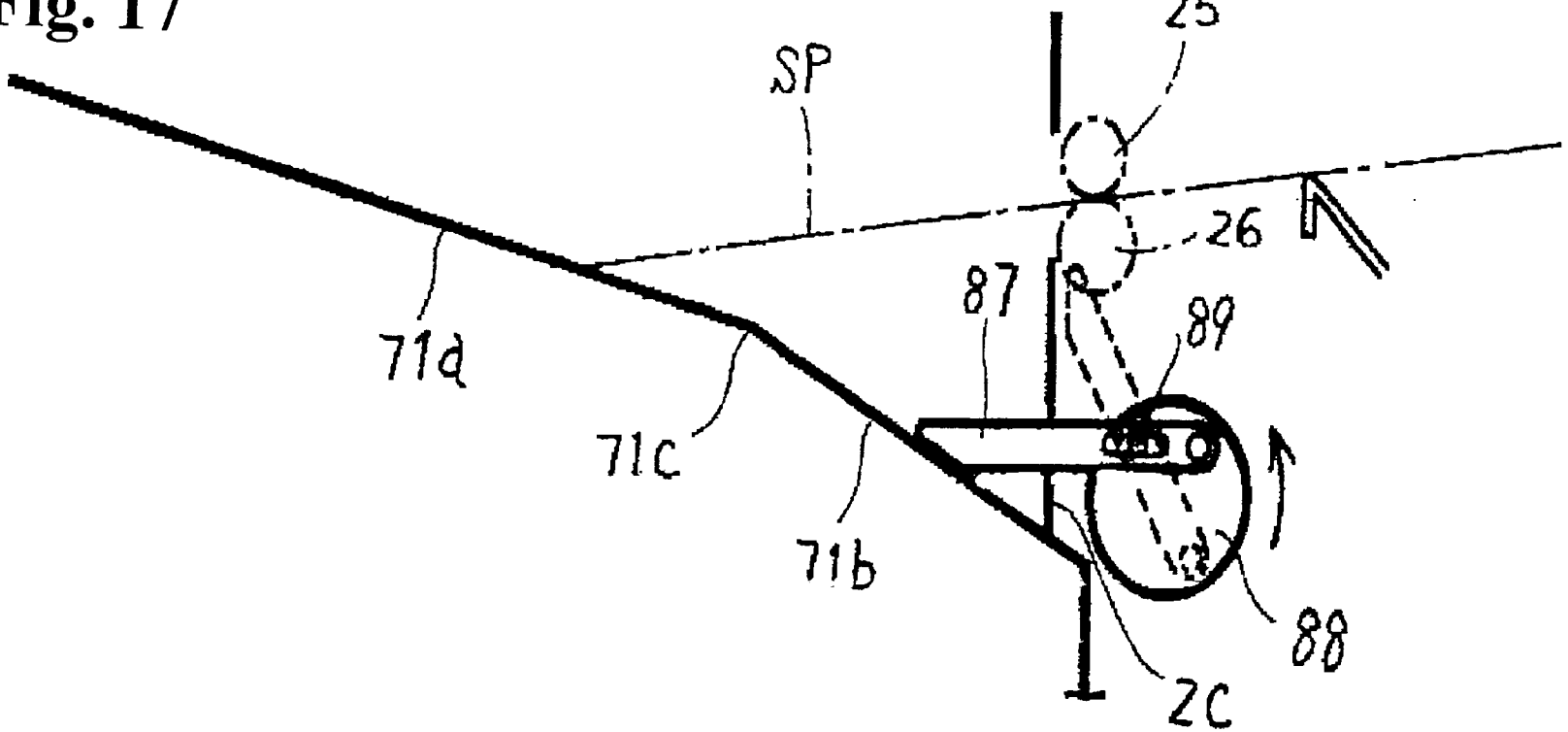
FIG. 17 is a conceptual view of another embodiment of the pressing lever that presses the sheets on the stacking tray shown in FIG. 2.

Note that in the explanation above for the present embodiment, the sheet holding lever 78 is disposed to be moved by the solenoid as the sheet holding means. However, it is acceptable to rotationally drive, by a motor or another source of force not shown in the drawings, a holding paddle roller 86 mounted with an elastic side composed of rubber, etc, as shown in the FIG. 16, to appear from the side of the sheet restricting surface 2*c* in correspondence to the sheet discharge timing. Also, as shown in FIG. 17, it is acceptable to hold the sheet with a structure such that an end of a sheet holding lever 87 is mounted to a cam plate 88 rotated by a motor, not shown in the drawing, and is linked by a fixed pin 89 into a slit on the sheet holding lever 87.

In other words, it is acceptable for any means to hold the sheet end by retracting only at the time of the discharge of the sheet S from the discharge roller 26.

The explanation above describes the first embodiment according to FIG. 1 to FIG. 17. The following describes the second embodiment according to FIG. 18 to FIG. 24. However, the portions of this second embodiment are the same as those of the first embodiment and have the same numbers, and the description thereof will be omitted.

Figure 18:
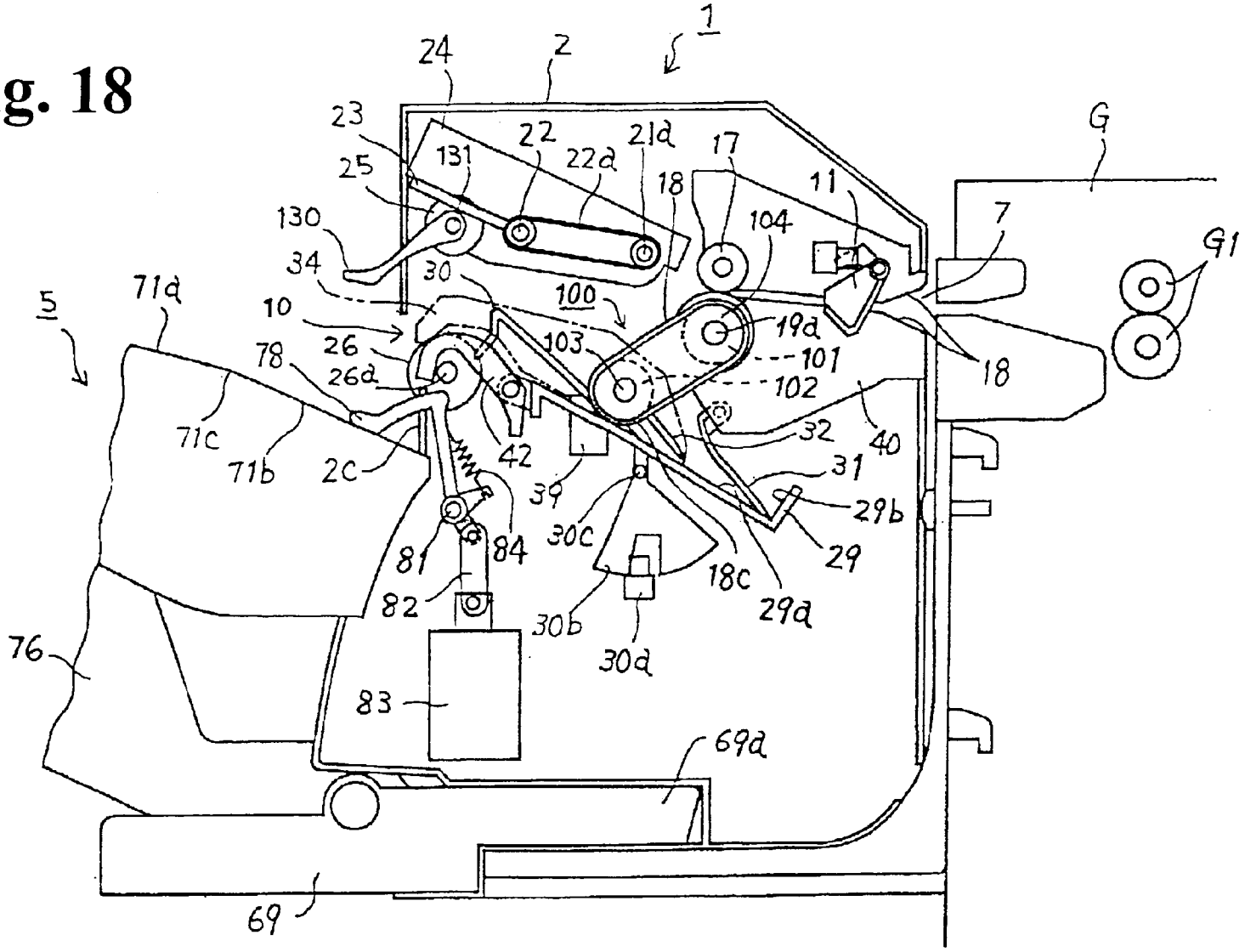
FIG. 18 shows a front sectional view of the internal mechanism of the sheet storage apparatus of the second type of another embodiment of the apparatus shown in FIG. 1.

The differences between the first and second embodiments of the invention are described in general according to FIG. 18.

Firstly, the escape tray 6 that stores the special sized sheet positioned above the stacking tray 5 and the fourth transport path P4 are eliminated. Therefore, the special sheet is discharged from the image forming apparatus in advance, to make the finisher apparatus 1 as the sheet stacking apparatus more compact.

Secondly, in the first embodiment, the sheet stacking portion side (18*c*) of the endless transport belts 18 which transports the sheet S into the processing tray 29 along the third transport path P3 is free, but in the second type of apparatus, it is supported by a follower pulley on the sheet stacking portion side (18*c*).

Thirdly, the elevator drive of the sheet storage portion 71 on the stacking tray 5 is provided with the coil springs 77, but the aforementioned elevator drive is provided with a motor in this embodiment and it detects the uppermost surface of the sheet stacked upon the sheet storage portion 71, the raising and lowering the sheet storage portion 71 being made by the signal therefrom. Also, a self-weighted flapper 130 is disposed on the same shaft as the discharge follower roller 25 on the rotating unit 24, so that the sheet discharged from the discharge roller 26 is quickly dropped into the sheet storage portion.

Figure 19:
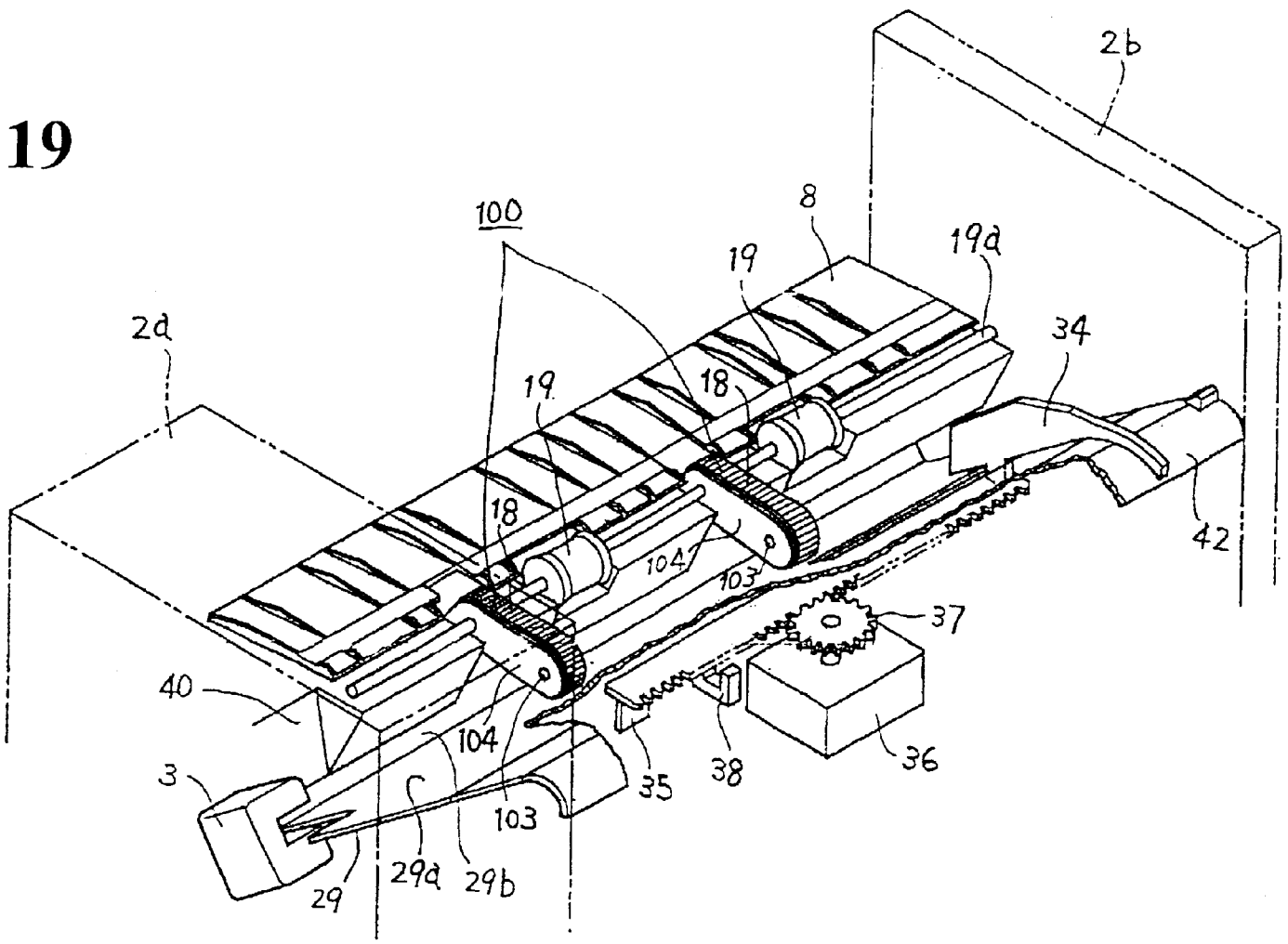
FIG. 19 is perspective view showing the internal mechanism of the temporary stacking tray omitting a part of the apparatus shown in FIG. 13.
Figure 20:
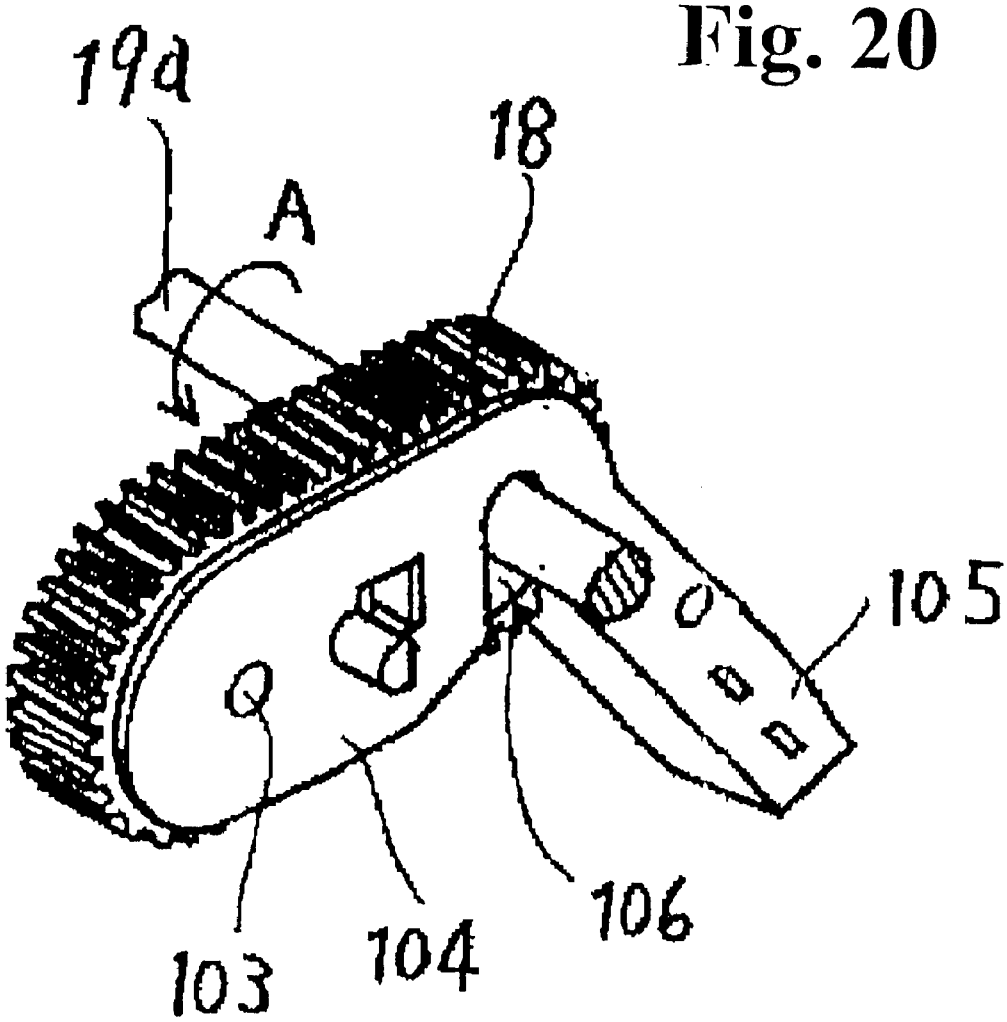
FIG. 20 is a perspective view of a feed belt unit shown in FIG. 18.

Next, each of the aforementioned points will be explained. The apparatus of the second embodiment shown in FIG. 18 and FIG. 19 is equipped with a feed belt unit 100 having the endless transport belts 18 as the sheet feeding means to transfer the sheet S into the processing tray 29 along the third transport path P3. The feed belt unit 100, including an explanation of FIG. 20, is composed of drive pulleys 101 that rotate along with the drive shaft mounted to the belt drive shaft 19*a,* follower support pulleys 102 positioned on the sheet stacking surface 29*a* having a predetermined gap with the drive pulley 101, support plates 104 mounted to both sides of the pulleys to maintain the gap between the drive pulley 101 and the follower support pulley 102, and the endless transport belts 18 each being disposed between the drive pulley 101 and the follower support pulley 102. The support plate 104 rotationally supports the rotating shaft 103 on the follower support pulley 102.

Therefore, when the belt drive shaft 19*a* is drivingly rotated, the drive pulleys 101 fastened to this shaft 19*a* also rotate, and the endless transport belts 18 and follower support pulleys 102 move while rotating.

The support plate 104 comprises an up-side-down U-shaped mounting portion 106. Because the mounting portion is fastened to the belt drive shaft 19*a,* the support plate 104 comprising the follower support pulley 102 is swingably supported by using the belt drive shaft 19*a* as its shaft pivot. Furthermore, the support plate 104 is mounted with a weight balance 105 on the side opposing the follower support pulley 102, as can be seen in FIG. 20. This weight balance causes the sheet drawing portion 18*c* on the endless transport belt 18 on the follower support pulley 102 side to touch the sheet S with substantially a constant touching force.

Since the structure above employs the drawing unit 100, the sheet drawing portion 18*c* which is the portion contacting the uppermost sheet on the endless transport belt 18 is lifted according to the sheet thickness when there are many sheets stacked on the processing tray 29. In other words, the support plate 104 swings around the belt drive shaft 19*a*. The direction of the swing is opposite to the direction of the rotation A of the belt drive shaft 19*a*.

Because the aforementioned endless transport belts 18 are backed up by the follower support pulleys 102, it swings according to the number of sheets on the sheet stacking portion 29*a* on the processing tray 29, but as the number of the sheets on the processing tray 11 increases, the area of contact on the sheet S will not vary. In other words, there is no variation in the transporting force depending on the number of the sheets S stacked. For that reason, even if the number of the sheets stacked upon the sheet stacking portion 29*a* increases, it does not press further the sheet S that strikes the sheet leading restricting portion 29*b,* thereby not bending the sheet S.

Also, in the same way as the endless transport belt 18 in the first embodiment of the invention, the sheet drawing portion 18*c* on the endless transport belt 18 is arranged to a position that overlaps the alignment plate 34. Because it is backed up by the follower support pulley 102, it is possible to accurately align the sheet S even when moving the sheet S in the width direction using the alignment plate 34.

Furthermore, the feed belt unit 100 has the weight balances 105, but it is possible to adjust the pressing force against the sheet S on The endless transport belts 18 by adjusting the moments of rotation by the weight balances 105.

However, if the weight of the support plate 104 is small, the weight balance 105 is unnecessary. Also, instead of the aforementioned weight balance 105, it is acceptable to use a spring member or the like to adjust the pressing force.

Figure 21:
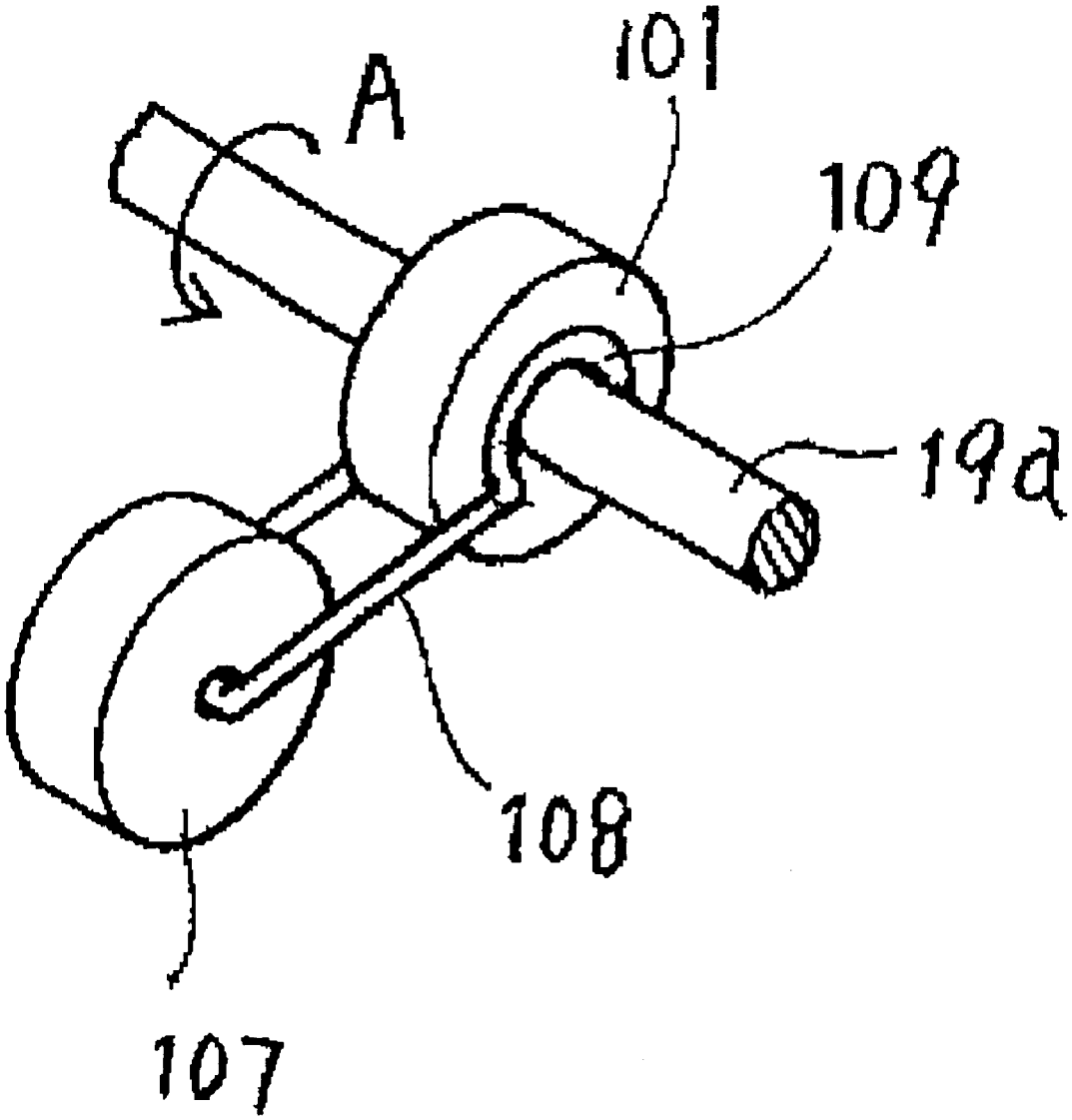
FIG. 21 is a perspective view of another embodiment of the feed belt and the unit shown in FIG. 20.

Furthermore, as illustrated in FIG. 21, it is acceptable to omit the structure for the support plate 104 on the feed belt unit 100 and to rotationally support a follower support pulley 107 on a wire-shaped support arm 108 and hang the up-side-down U-shaped swinging end on the side opposing this follower support pulley 107 to the belt drive shaft 19*a*.

Figure 30A:
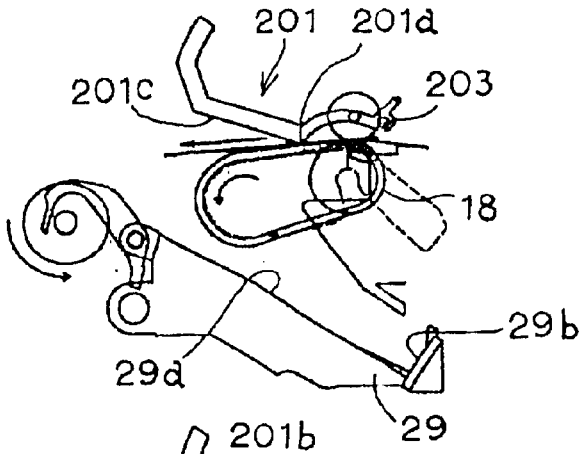
FIGS. 30(A)–30(D) are sectional views for showing the movement of the weight member and the endless transport belt.
Figure 30B:
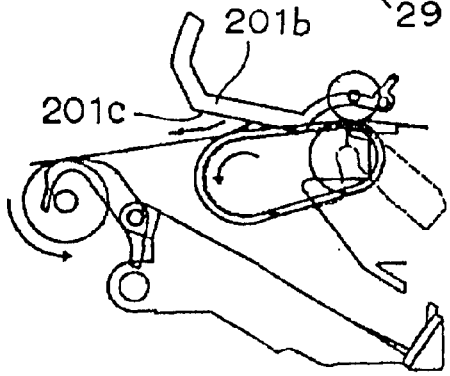
Figure 30C:
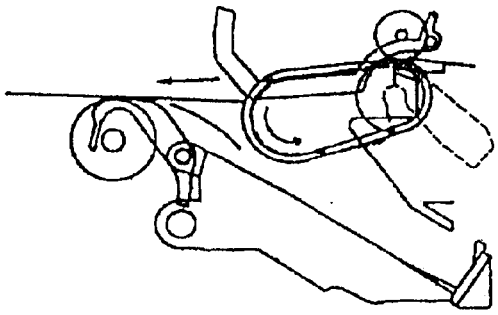
Figure 30D:
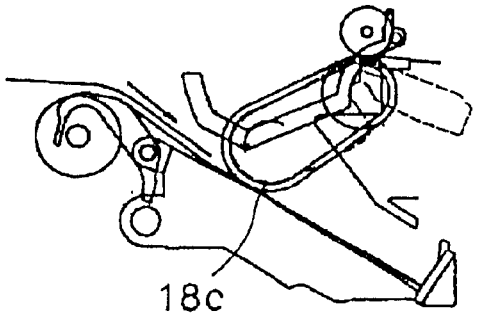

Because there is the possibility of the leading edge of the sheet striking the sheet stacking portion 29*a* on the processing tray 29 or the sheet on the sheet stacking portion 29*a,* to be bent when the sheet is discharged to the processing tray 29 while the support plate 104 swings around the belt drive shaft 19*a* and the endless transport belts 18 are in the state shown in FIG. 18 and FIG. 30(D), it is possible to have the angle of discharge of the endless transport belts 18 facing further upward than the state shown in FIG. 18 and FIG. 30(D) to prevent the leading edge of the sheet from ramming into the processing tray 29 when starting to discharge the sheet to the processing tray 29 as is illustrated for example in FIG. 30(A) to FIG. 30(C). Later, at a prescribed timing, such as the exiting of the trailing edge of the sheet from the endless transport belts 18, the endless transport belts 18 move to a downward position shown in FIG. 18 and FIG. 30(D). By facing the angle of discharge lower than that when starting to discharge the sheet to the processing tray 29, the sheet drawing portions 18*c* on the endless transport belts 18 can move the sheet to the sheet leading edge restricting member 29*b* for alignment.

Specifically, it is acceptable (1) that the support plate 104 whose position is generally determined by a spring member, not shown in the drawings, at the upward position shown in FIG. 30(A), is moved by drive means, such as a solenoid, also not shown in the drawings, to a downward position as depicted in FIG. 18 and FIG. 30(D) to thereby move the endless transport belts 18. Conversely, it is acceptable (2) that the support plate 104 whose positioning is generally determined by a spring, not shown in the drawing, at the downward position shown in FIG. 18 and FIG. 30(D), is moved by drive means, such as a solenoid, also not shown in the drawings, to an upward position as depicted in FIG. 30(A) to thereby move the endless transport belts 18.

In this case, to move the endless transport belts 18, as a timing control to switch the swinging of the support plate 104, in the example (1), the solenoid is activated based upon the detection after a prescribed number of pulses or a prescribed amount time from when the sheet inlet sensor 11 detects the leading edge of the sheet until before the trailing edge of the sheet is completely discharged from the processing tray 29. In the case of (2), it is conceivable to have a control to switch the activation of the solenoid based upon the detection of a prescribed number of pulses or a prescribed amount of time from when the sheet inlet sensor 11 detects the leading edge of the sheet until the trailing edge of the sheet is completely discharged from the processing tray 29.

These control means can be formed on either the image forming apparatus G or the sheet finishing apparatus 1.

Thus, as described above, it is possible to accurately finish processes including binding with a staple on a sheet bundle because the endless transport belts 18 are moved to the downward position shown in FIG. 18 and FIG. 30(D) from the upward position when starting to discharge the sheets to the processing tray 29, and by using the sheet feeding portions 18*c* on the endless transport belts 18 to move the sheets to the sheet leading restricting portion 29*b,* then aligning the sheets in the direction traversing the direction of discharge to the processing tray 29 or stapling the aligned sheets using the staple unit 3 shown in FIG. 19 and maintaining the optimum attitude of the sheet bundle for binding at the downward position of the endless transport belts 18.

Note that according to this embodiment of the invention, when the sheets are discharged to the processing tray 29 and aligned by the sheet leading restricting portion 29*b,* they are moved in the direction opposite of the direction of transport to the processing tray 29 by the sheet drawing portions 18*c* on the endless transport belts 18. However, as shown in FIGS. 30(A) and 30(B), it is acceptable to form the sheet leading restricting portion 29*b* in the downstream side in the direction of sheet discharge to the processing tray and to move the sheet to the processing tray 29 in the same direction as the direction of sheet transport by the sheet drawing portions 18*c* on the endless transport belts 18.

In this case, as can be seen in FIG. 30(A) to FIG. 30(C), after the sheet has been completely discharged to the processing tray 29, the endless transport belts 18, while they continue their driving in the direction of transport to the processing tray or stops their driving, move to the downward position for the discharge, and in order to move the sheet to the sheet leading restricting portion 29*b,* drive in the opposite direction to that of the drive in the direction of sheet discharge to the processing tray, as can be seen in FIG. 30(D). As an example of the timing to switch the up and down movements or to cut the drive to the endless transport belts 18, the sheet inlet sensor 11 detects the number of pulses or a predetermined time necessary to discharge the sheet from detecting the sheet trailing edge to the complete discharge thereof, and the endless belt is moved by a solenoid, not shown in the drawings, downward and to reverse the drive thereto.

Figure 22:
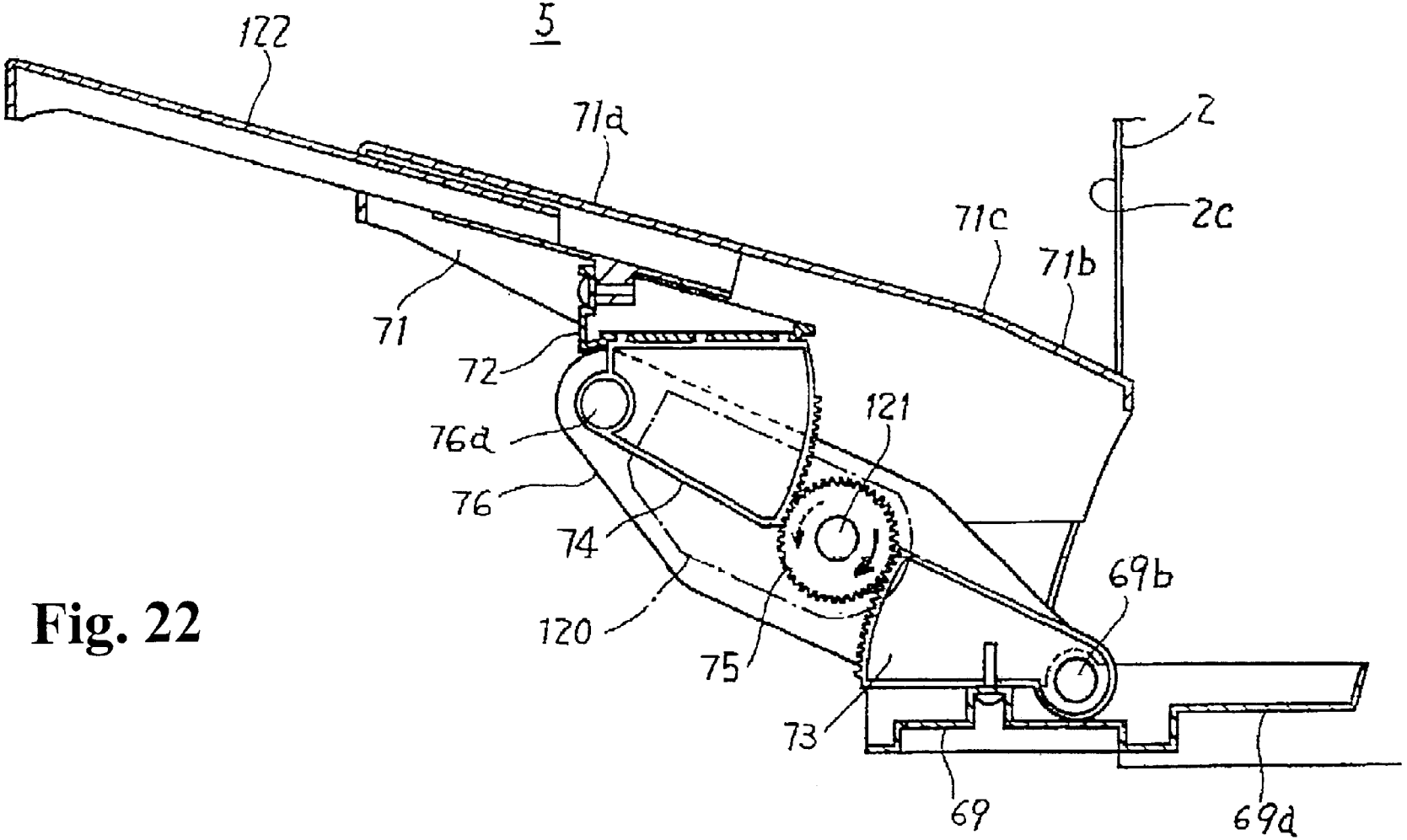
FIG. 22 is a front perspective view of the stacking tray mounted to the apparatus shown in FIG. 18.

The following describes the second type of the stacking tray 5 according to FIG. 22. This stacking tray 5 employs a motor unit 120 that comprises a motor as the elevator mechanism of the sheet storage portion 71. The motor unit 120 is mounted to a shaft arm 76 that supports the moving gear 74 and the planetary gear 75 and connects a motor shaft 121 from the motor unit 120 to the planetary gear 75. This motor rotates the motor shaft 121 in the clockwise direction to raise the sheet storage portion 71 and in the counterclockwise direction to lower the sheet storage portion 71.

Therefore, the uppermost surface of the sheet stacked on the sheet storage portion 71 is detected. That signal is sent to the motor unit 120 whereby the motor is controlled to run in forward or reverse to enable a constant and accurate sheet surface level.

Figure 23:
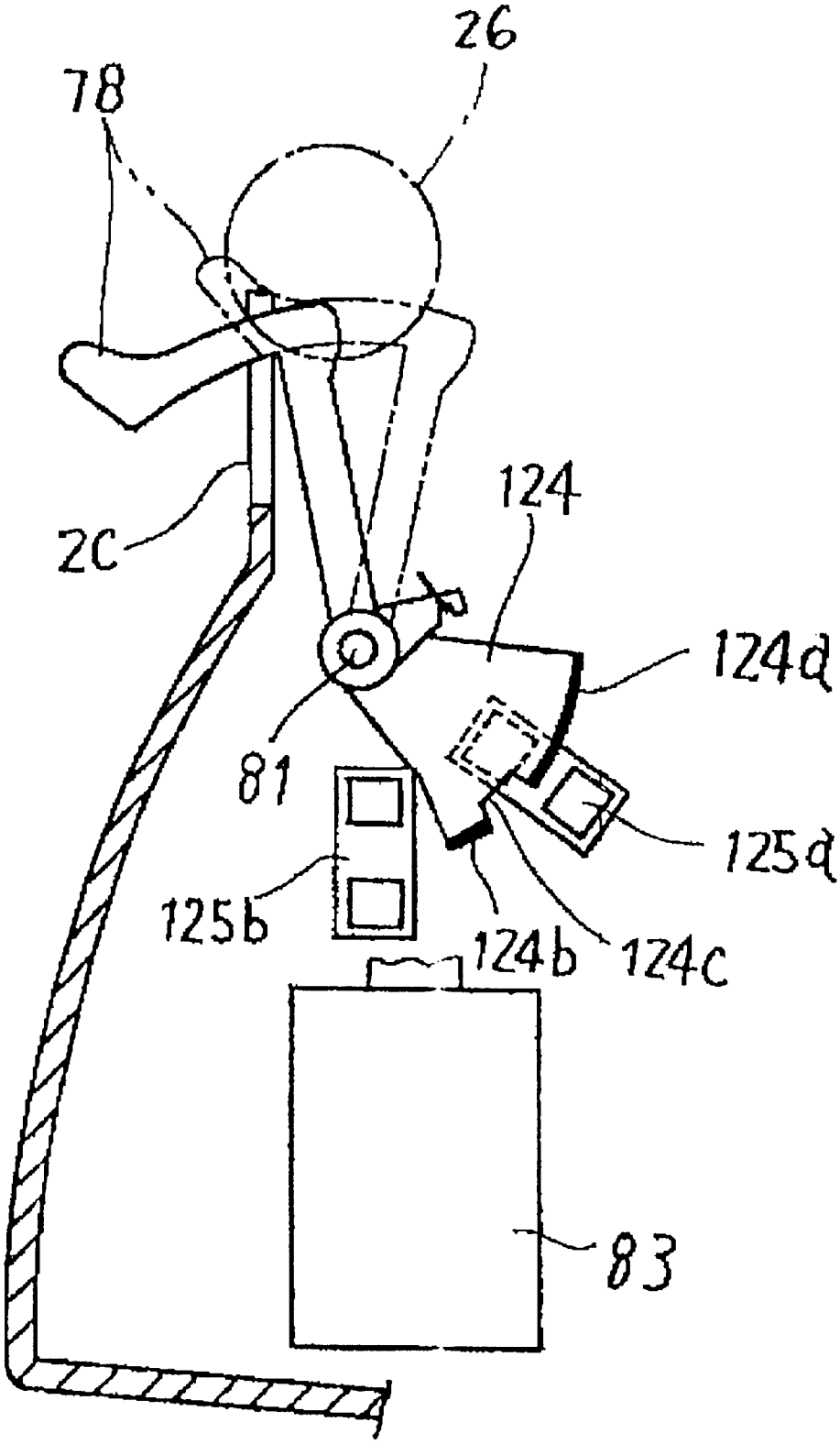
FIG. 23 is a partial sectional view of the mechanism to detect the position of the pressing lever that presses sheets into the stacking tray of the apparatus shown in FIG. 18.

The aforementioned sheet surface level detection mechanism, shown in FIG. 23, detects the level by using the sheet holding lever 78 that rotates around a shaft pivot 81 and transmissive type sensors 125*a* and 125*b* for detecting a detection flag 124 formed with the sheet holding lever 78 as one unit. The detection flag 124 comprises a first flag portion 124*a* and a second flag portion 124*b* and is equipped, between these flags, with a notch portion 124*c* that does not affect the sensor.

FIGS. 23(A) and 23(B) depict the sheet holding lever in the position to appropriately hold the sheet S wherein the first sensor 125*a* is interrupted by the first flag portion 124*a* to turn it ON. On the other hand, the second sensor 125*b* is not detecting the second flag portion 124*b* and is therefore OFF. This is the position where the sheet storage portion 71 on the stacking tray 5 is set to the appropriate position. As the sheet S is discharged sequentially to the sheet storage portion 71, the sheet holding lever 78 reciprocates in the positions of the dotted and solid lines shown in FIGS. 23(A) and 23(B). Each time the sheet S is stacked onto the sheet storage portion, the detection flag moves in the clockwise direction and the second flag portion 124*b* is detected by the second sensor 125*b* and turns ON while the other first flag portion 124*a* is detected by the first sensor 125*a* and is turned ON. When both the first sensor 125*a* and the second sensor 125*b* ON output the signals, it outputs a signal to the stacking tray 5 to lower the sheet storage portion 71. This signal causes the motor drive shaft 121 to rotate in the counter-clockwise direction to lower the sheet storage portion 71 for a prescribed amount.

This positions the uppermost surface of the sheet S stacked on the sheet storage portion 71 at a constant height.

Note that the aforementioned sheet storage portion 71 does not move up or down each time a conventional sheet is discharged, but it is made to lower the position when the uppermost surface of the sheets exceeds a prescribed height, so that this alleviates the complexities of actions each time a sheet is discharged.

Furthermore, when the notched portion 124*c* is positioned at the first sensor 125*a* to turn it OFF and the second sensor 125*b* OFF, it is determined that the sheet storage portion 71 is in a position lower than the prescribed height and it is to be raised. When the first sensor 124*a* is OFF and the second sensor is ON, the sheet holding lever 78 is determined to be retracted into the sheet restricting surface 2*c*. Also, when the sheet storage portion 71 is positioned in the downward position and the first sensor 124*a* and the second sensor 124*b* are both ON, it is determined that the sheet storage portion 71 is full of sheets and it stops the stacking operation on the sheet stacker.

This describes the configuration for detecting the sheet surface level on the stacking tray 5. However, the second type of apparatus is equipped with a sheet flapper 130 rotatably mounted to a support shaft 131 on the follower discharge roller 25 maintained by the rotating unit 24 to accurately stack the sheets to this stacking tray, as can be seen in FIG. 18.

This sheet flapper 130 moves up and down according to the discharge of the sheet to securely drop the trailing edge of the sheet S into the sheet storage portion.

Figure 24A:
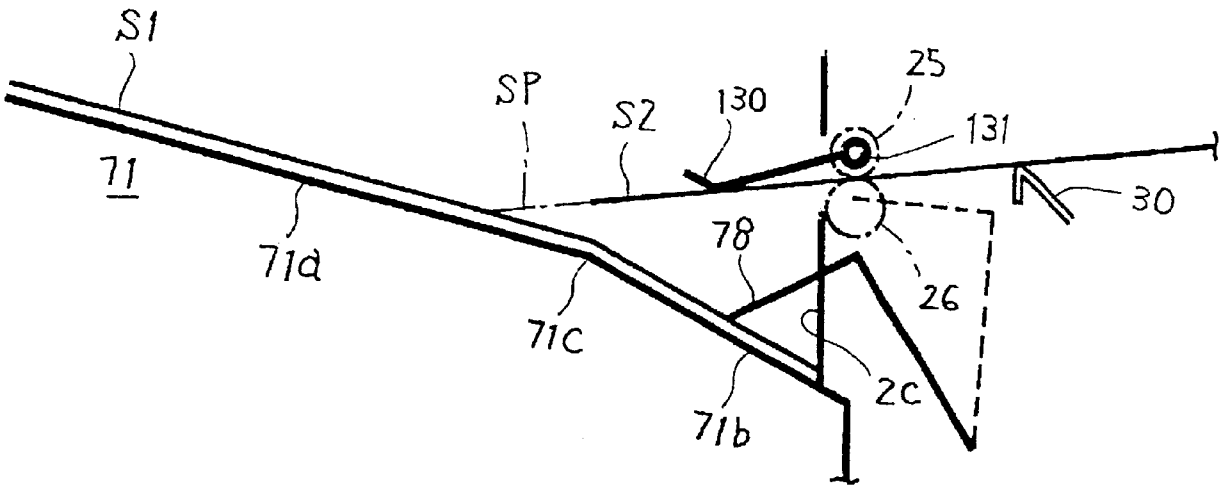
FIGS. 24(A) and 24(B) are explanatory views showing the operation of the sheet stacking on the stacking tray.
Figure 24B:
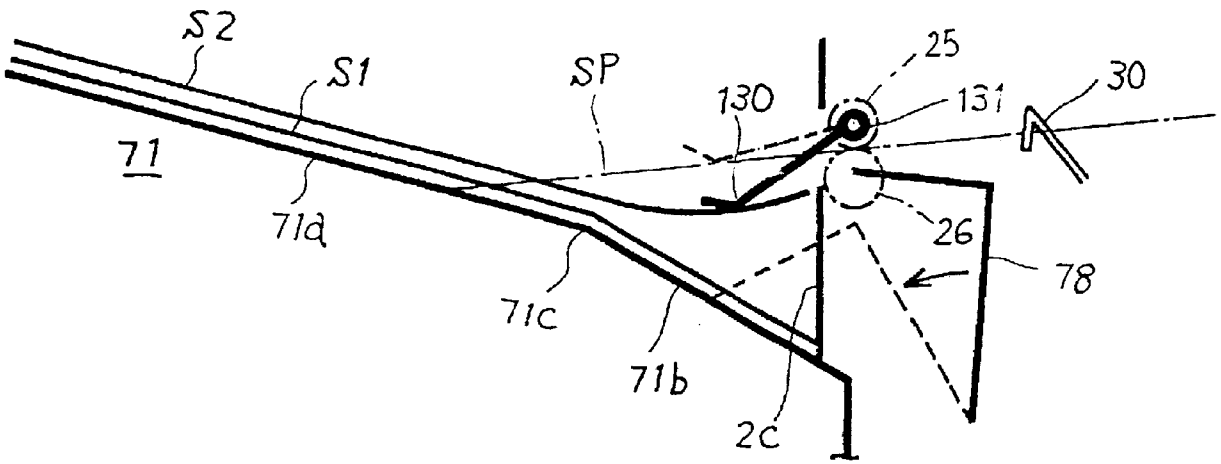
Figure 25:
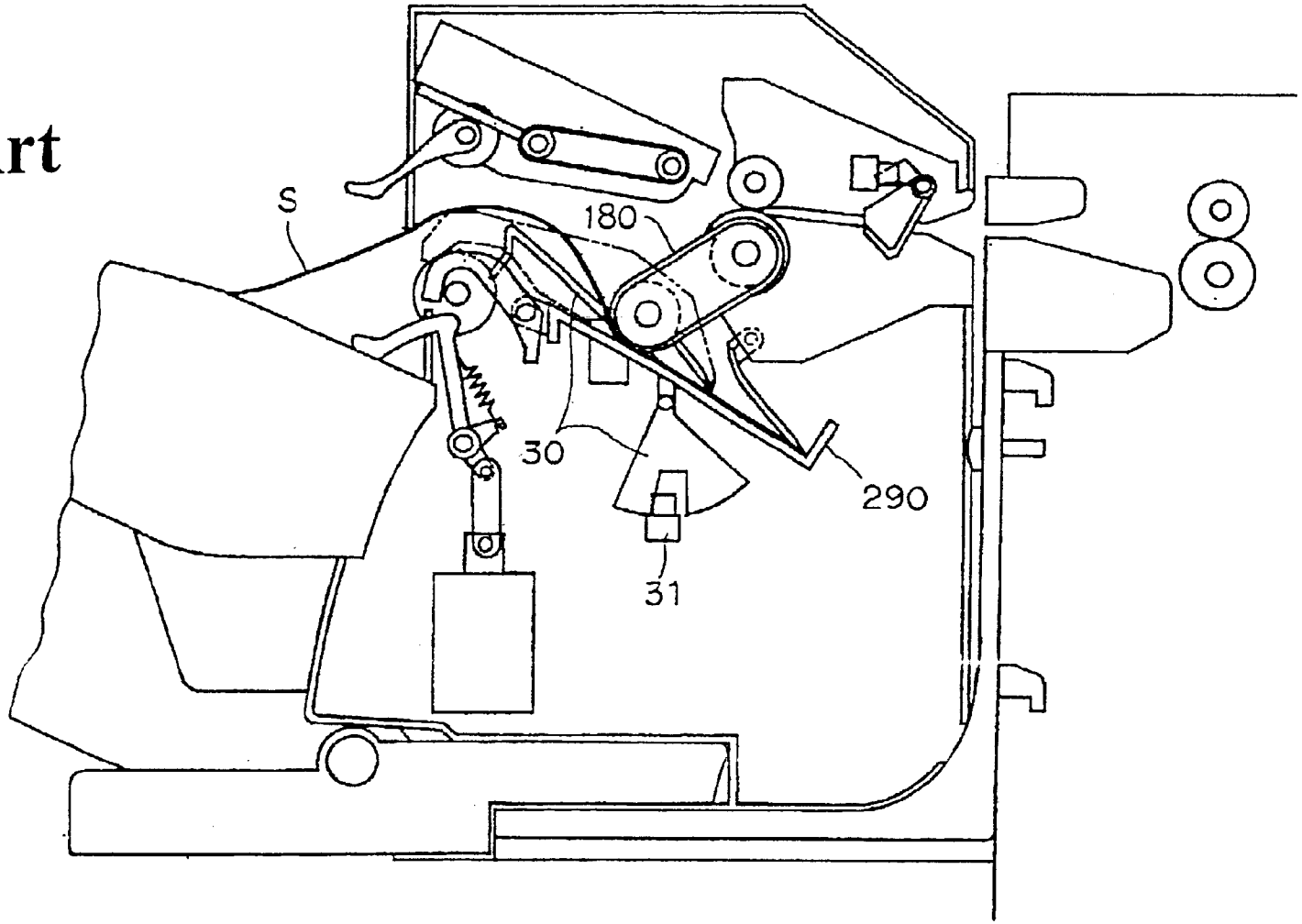
Fig. 25 Prior Art
FIG. 25 is a front sectional view of the internal structure of the conventional sheet storage apparatus.
Figure 26:
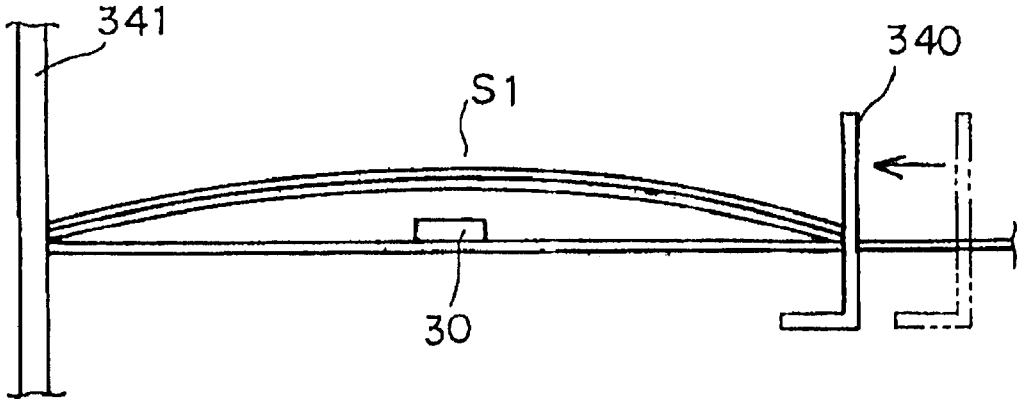
Fig. 26 Prior Art
FIG. 26 is a sectional view of the aligning mechanism of the conventional sheet storage apparatus.
Figure 27:
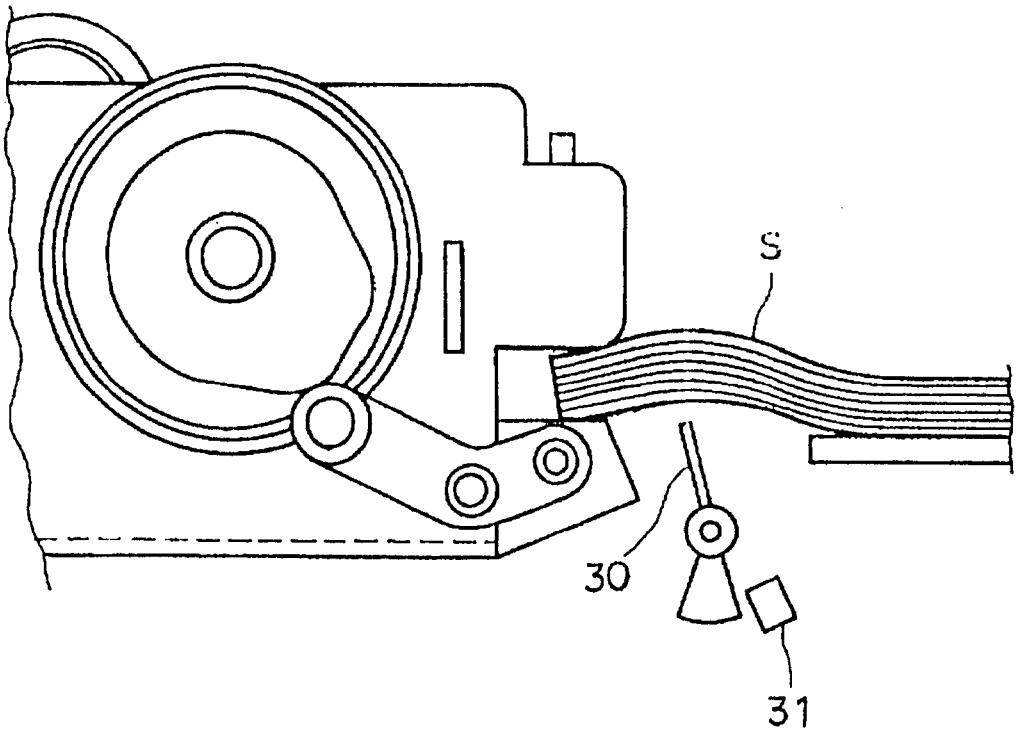
Fig. 27 Prior Art
FIG. 27 is a sectional view of the stapling mechanism of the conventional sheet storage apparatus.

The action of the sheet flapper 130 is described in accordance with FIGS. 24(A) and 24(B). The actions and operations of the sheet holding lever 78 to hold the sheet on the sheet storage portion 71 are the same as those described in FIGS. 14(A) to 15(B), so the following description is focused on the sheet flapper 130 for dropping the sheet S, which is discharged in cooperation with the sheet holding lever 78, onto the sheet storage portion 71.

FIG. 24(A) depicts the rotating unit 24 positioned downward and the sheet S is discharged by the discharge roller 26 and the follower discharge roller 25 along the sheet discharge direction line extension SP. In this state, the sheet flapper 130 is simply hanging downward on a support shaft 131 on the follower discharge roller 25, so that the sheet is firmly held because of the sheet being nipped by the discharge roller 26 and the follower discharge roller 25, thereby lifting the sheet flapper while being discharged. This state continues until the trailing edge of the sheet S2 separates from the nip of the discharge roller 26 and the follower discharge roller 25.

When the trailing edge of the sheet S2 separates from the nipping by the discharge roller 26 and the follower discharge roller 25, the trailing edge of the sheet S is pushed down along the sheet restricting surface 2*c* by the weight of the sheet flapper 130, as is depicted in FIG. 24(B). Simultaneously with the falling of the sheet, the sheet holding lever 78 rotates clockwise in the direction of the arrow in the drawing to push the trailing edge of the sheet S2 onto the sheet storage portion 71. Therefore, even if the trailing edge of the sheet S has a large curl upward toward the discharge roller, it is fixed by the downward rotation of the sheet flapper under its own weight to alleviate the problem of the leading edge of subsequently discharged sheet S from striking the curl and cause a jam.

The positional relationships of the sheet holding levers 78 and the sheet flappers 130 in the width direction (the direction traversing the direction of sheet transport) are made to have the sheet holding levers 78 located in three positions (see FIG. 1) and to arrange a plurality of the sheet flappers therebetween (two in this embodiment) to avoid collisions between the sheet holding levers 78 and the sheet flappers 130. Furthermore, the sheet flapper 130 according to this embodiment is to rotate or move the sheet flapper 130 to push the trailing edge of the sheet S under its own weight, but it is also perfectly acceptable to drive the flapper up and down using drive means, such as a solenoid, operated at a timing of the discharge of the sheet S.

The following explains the embodiment that improves the second type. In the improved embodiment of the second type, each sheet that passes through the follower roller 17 and the drive pulley 101 receives the force of transport by the follower discharge roller 25 and the discharge roller 26 when being discharged directly to the sheet storage portion 71. However, in other cases, as can be seen in FIG. 30(A) to FIG. 30(D), each sheet that passes through the follower roller 17 and the drive pulley 101 receives the load of a weight member 201 and is transported and discharged into the downstream processing tray 29 by the endless transport belts 18 while being pushed by that belts.

Figure 28:
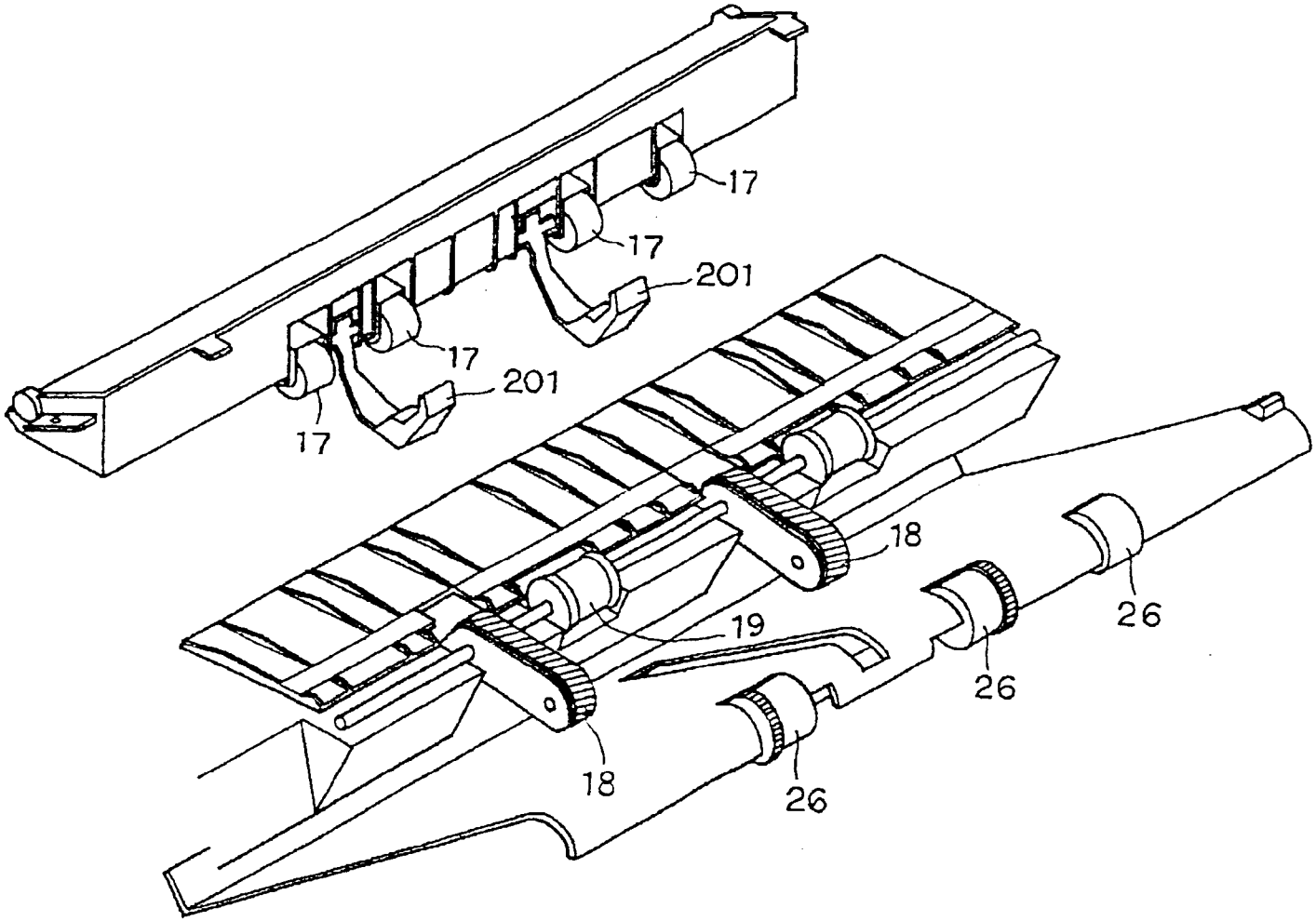
FIG. 28 is a perspective view of the relationship of the arrangement of a weight member and an endless transport belt.
Figure 29:
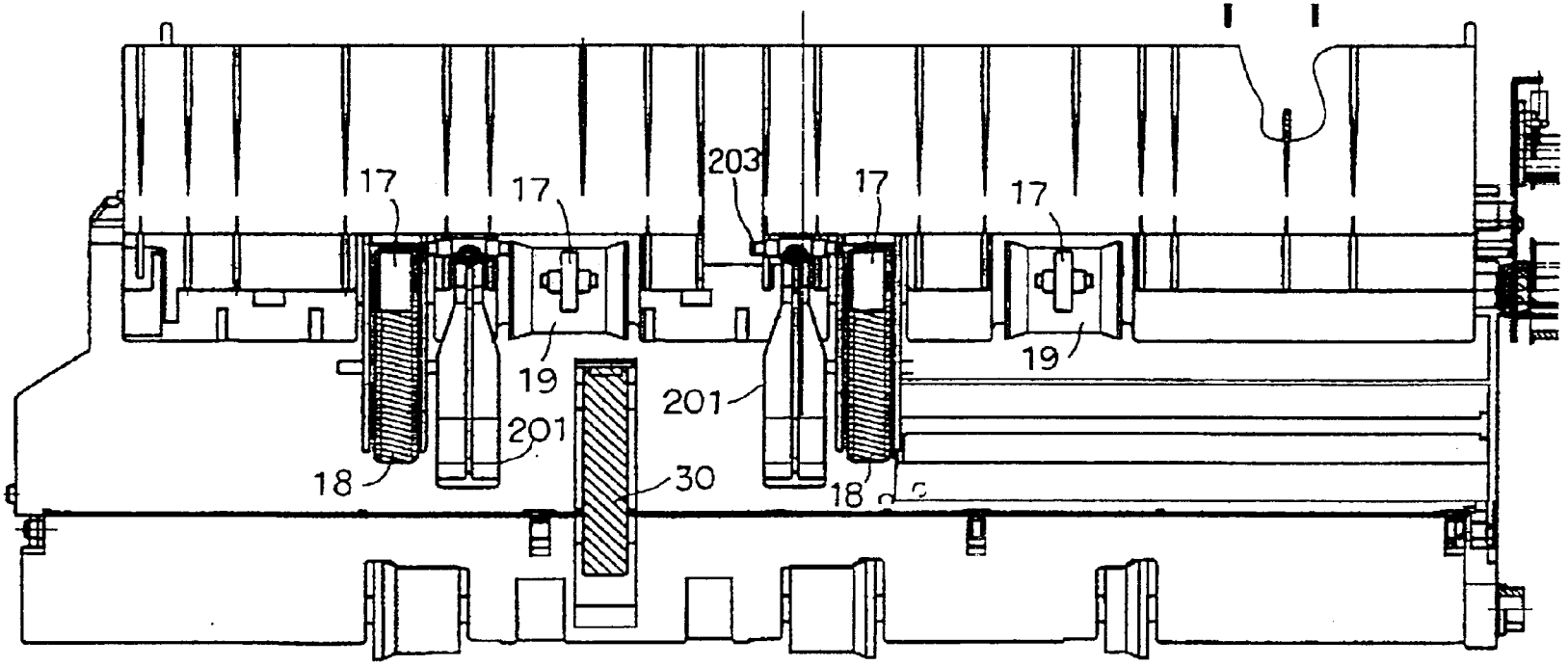
FIG. 29 is a plan view of the relationship of the arrangement of the weight member and the endless transport belt.

In this way, the weight member 201 which presses each sheet to the endless transport belts 18 is swingably supported by a support shaft 203 located above the endless transport belts 18, as can be seen in FIG. 30(D), FIG. 28 and FIG. 29. It is arranged in a position closer to the sensor lever 30 (the sheet presence sensor 30*a*) than the endless transport belts 18 in the direction traversing the direction of sheet transport and discharge (the sheet width direction) toward the downstream processing tray 29.

Note that the sheets are moved to the sheet leading restricting portion 29*b* by the sheet drawing portions 18*c* and that there are oblique grooves in the aligning direction, shown in FIG. 28 and FIG. 29 on the surface of the endless transport belts 18 for aligning the sheets in the sheet transport and discharge directions. These grooves act to move the sheet in a direction traversing the direction of sheet transport and discharge (the sheet width direction) to align the sheet along with the rotation of the endless transport belts 18.

So, by arranging the weight member 201 in a position nearer the sensor lever 30 (sheet presence sensor 30*a*) than the endless transport belts 18 and preventing the bending of the sheet near the sensor lever 30, when the sheet is transported and discharged to the processing tray 29, or aligned by the alignment plate 34 on the processing tray 29, it operates to align in the sheet width direction.

The Sheet is pushed securely toward the sensor lever 30 to be securely detected which results in alleviating the problem of the sheet from subsequent job after being discharged regardless of whether there is still a sheet on the processing tray 29.

Setting the sensor lever 30 and the weight member 201 to positions separated in the direction of sheet transport and discharge may not provide the effect of holding the bend in the sheet by the weight member 201 up to the sheet at the sensor lever 30 position, so that the weight member 201 and the sensor lever 30 are positioned to overlap each other at least in the direction of sheet transport and discharge, as shown in FIG. 29, to securely allow the weight member 201 to hold the sheet at the sensor lever 30 position.

Furthermore, by positioning the endless transport belts 18, the weight member 201 and the sensor lever 30 to overlap at least each other in the direction of the sheet transport and discharge, the space is saved to enable the apparatus itself to be more compact.

Note that as sheet presence detection means, an optical type, other than the lever type used above, can be used in the aforementioned invention.

As shown in FIG. 30(A), the weight member 201 comprises a pressing portion 201*a* that contacts the upper surface of the sheet when the sheet is being pushed to the endless transport belts 18 under its own weight when it is nipped with the endless transport belts 18, and a pressing portion 201*b* located further downstream in the direction of transport than the pressing portion 201*a,* to press the trailing edge of the sheet by the swinging of the weight member 201 around the shaft 203 after the trailing edge of the sheet has passed the pressing portion 201*a,* and the pressing portion 201*b* includes a pressing surface 201*c* to press the sheet further. On the weight member 201, the upstream side for nipping the pressing portion 201*b* and the downstream side having the pressing portion 201*b* face different directions toward the sheet.

The following is a detailed description of the action of the pressing portion 201*b.* As shown in FIG. 30(B), by the trailing edge of the sheet passing through the pressing portion 201*a,* the pressing portion 201*a* looses the sheet toward the endless transport belts 18 and the entire weight member 201 swings downward around the support shaft 203.

The swinging downward of the entire weight member 201 maintains the abutment of the pressing portion 201*c* on the pressing portion 201*b* and the trailing edge of the sheet, and acts to push the trailing edge of the sheet in the direction of discharge while varying its displacement of the abutment with the trailing edge of the sheet.

Note that in this embodiment, with the sheet nipped by the pressing portion 201*a* and the endless transport belts 18, the directions toward the sheet upstream from the pressing portion 201*a* including the pressing portion 201*b* are different, and the downstream length including the pressing portion 201*b* is set to be longer than the upstream side from the pressing portion 201*a* (the length up to the support shaft 203). Also, the pressing portion 201*a* is positioned upstream of the endless transport belts 18 while the pressing portion 201*b* is positioned to cross the width of the endless transport belts 18.

This enables the weight of the pressing portion 201*b,* which is set to be longer, or the weight member 201 lighter and smaller but to efficiently place the weight to press the sheet, because the pressing portion 201*b* applies the pushing pressure to the sheet around the pivot of the pressing portion 201*a.*

Also, when the pressing portion 201*b* pushes the trailing edge of the sheet in the aforementioned structure, the weight member 201 itself is smaller and lighter but efficiently presses the sheet. Also, by forming the pressing portion 201*b* to cross the width of the endless transport belts 18, it is possible to securely discharge the trailing edge of the sheets from the endless transport belts 18.

Figure 31A:
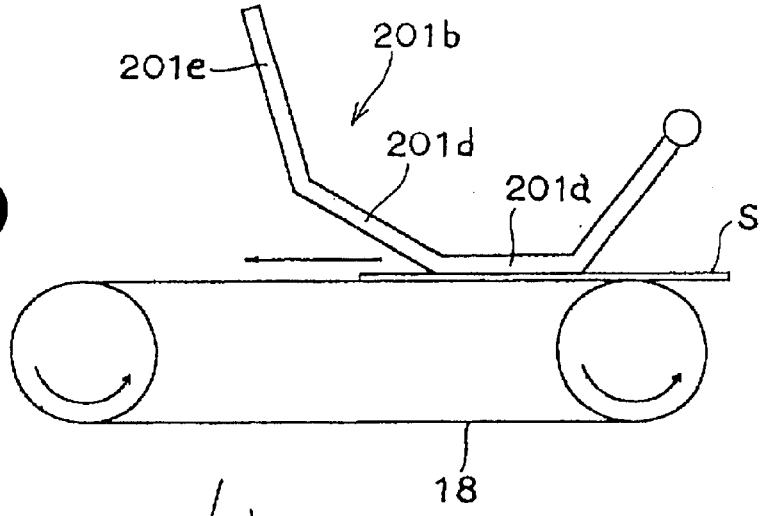
FIGS. 31(A)–31(C) are sectional views of another embodiment relating to the weight member.
Figure 31B:
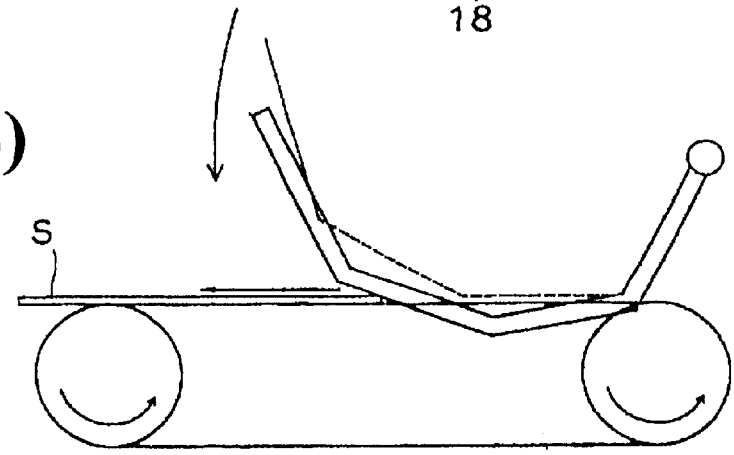
Figure 31C:
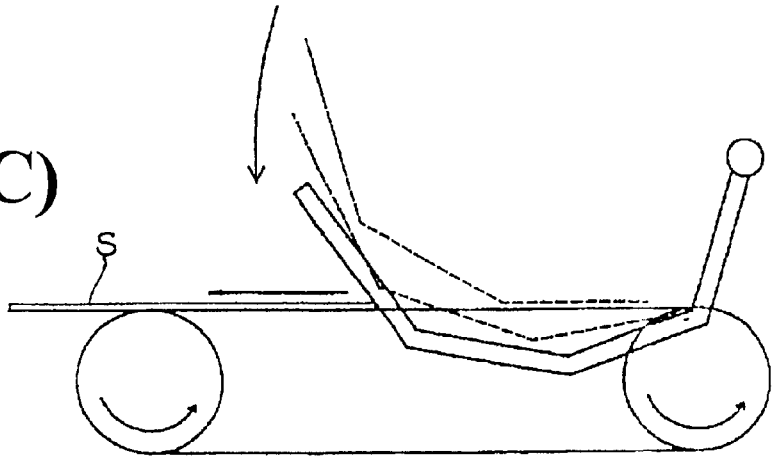

FIG. 31(A) to FIG. 31(C) shows this transformation. The pressing portion 201*a* is not limited to contact with the sheet shown in FIG. 30(A) to FIG. 30(D). It is also perfectly acceptable to use a type wherein the sheet is pressed to the endless transport belts 18 while being in contact with the sheet surface, as shown in FIG. 31(A) to FIG. 31(C). Furthermore, in the same drawing, the pressing portion 201*b* is composed of the oblique portions 201*d* and 201*e* whose oblique angles are different. A structure forming the pressing portion 201*b* in a plurality of oblique portions allows variations in the pressing speed and force of the pressing portion 201*b.* As shown in FIG. 31(A) to FIG. 31(C), by making the angle of the oblique portion 201*e* steeper than that of the oblique portion 201*d,* the trailing edge of the sheet can be transported slowly at the trailing edge position discharged from the endless transport belts 18 while maintaining good positioning when discharged. As can be seen in FIG. 31(C), the trailing edge of the sheet is securely fed by the steep angle of the oblique portion 201*e* thereby preventing the trailing edge of the sheet to become nipped between the endless transport belts 18 and the oblique portion 201*e* and getting jammed.

Figure 32A:
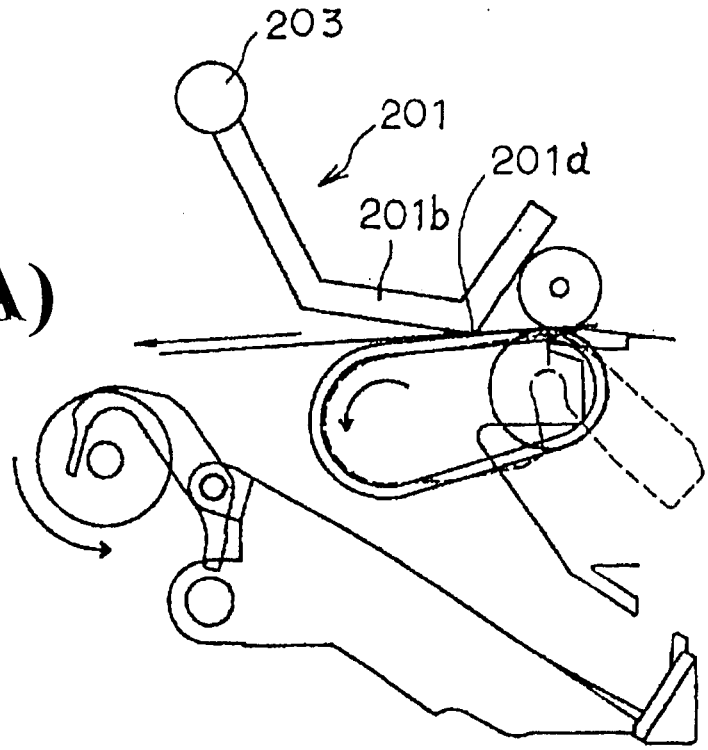
FIGS. 32(A) and 32(B) are sectional views of another embodiment relating to the weight member.
Figure 32B:
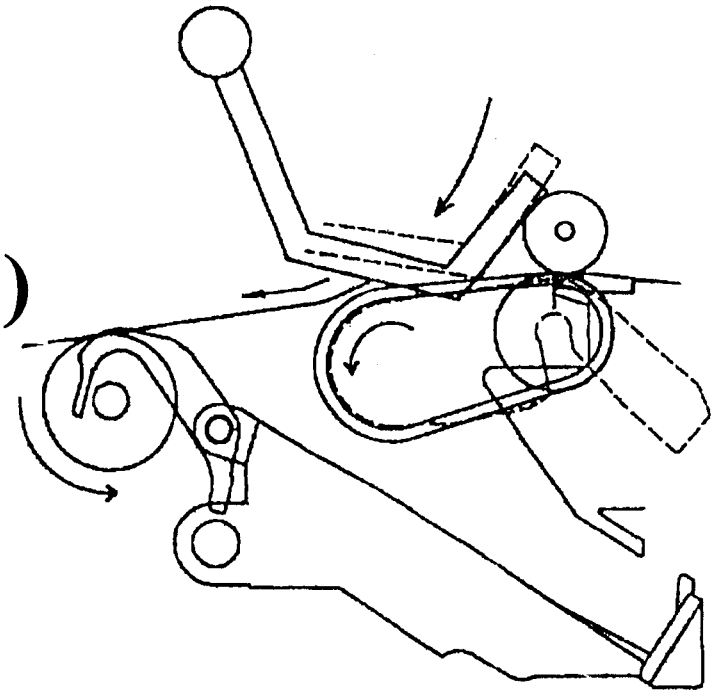
Figure 33A:
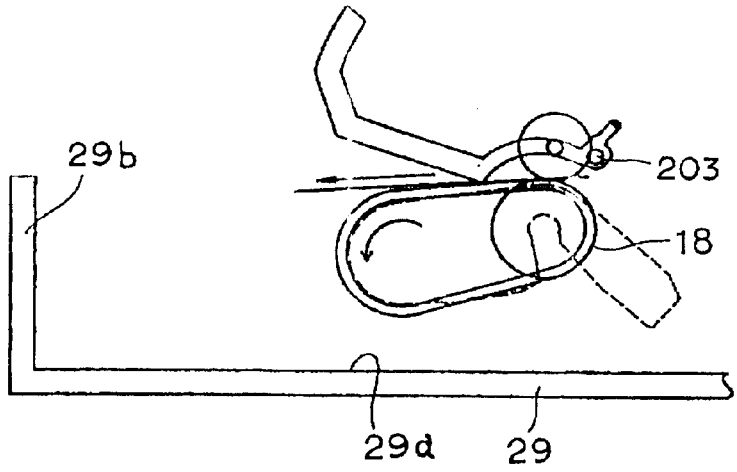
FIGS. 33(A)–33(D) are sectional views of another embodiment relating to the movement of the weight member and the endless transport belt.
Figure 33B:
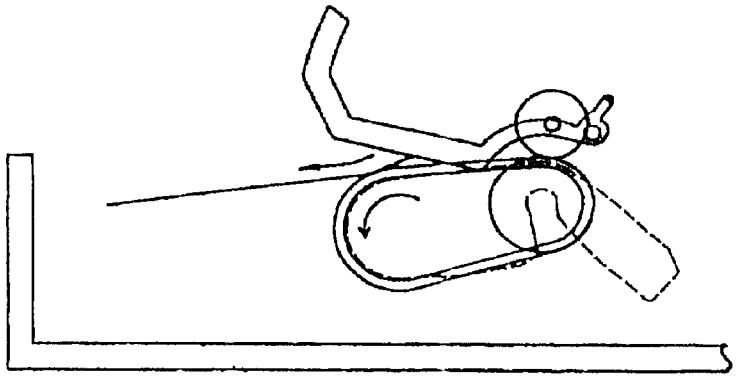
Figure 33C:
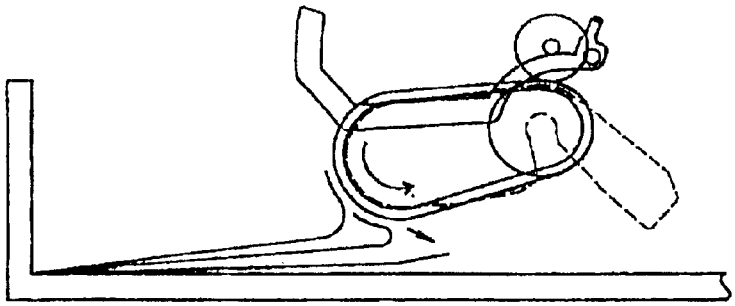
Figure 33D:
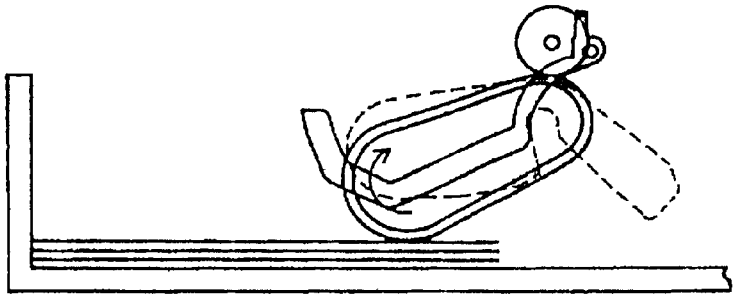

Furthermore, it is also acceptable for the support shaft 203 that supports the weight member 201 to be formed above the downstream side of the endless transport belts 18 rather than above the upstream side, as shown in FIG. 32(A) and FIG. 32(B). This makes the direction that the weight member 201 swings different from the embodiment of FIG. 30(A) to FIG. 30(D). Note that the length of the pressing portion 201*b* is the same as the apparatus of FIG. 30(A) to FIG. 30(D) in view of the point that it is formed longer than the pressing portion.

Figure 34A:
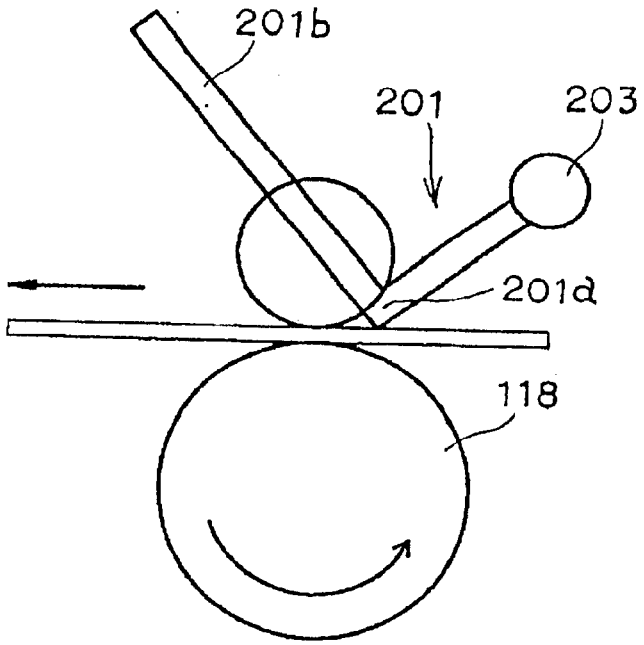
FIGS. 34(A) and 34(B) are sectional views of another embodiment relating to the weight member.
Figure 34B:
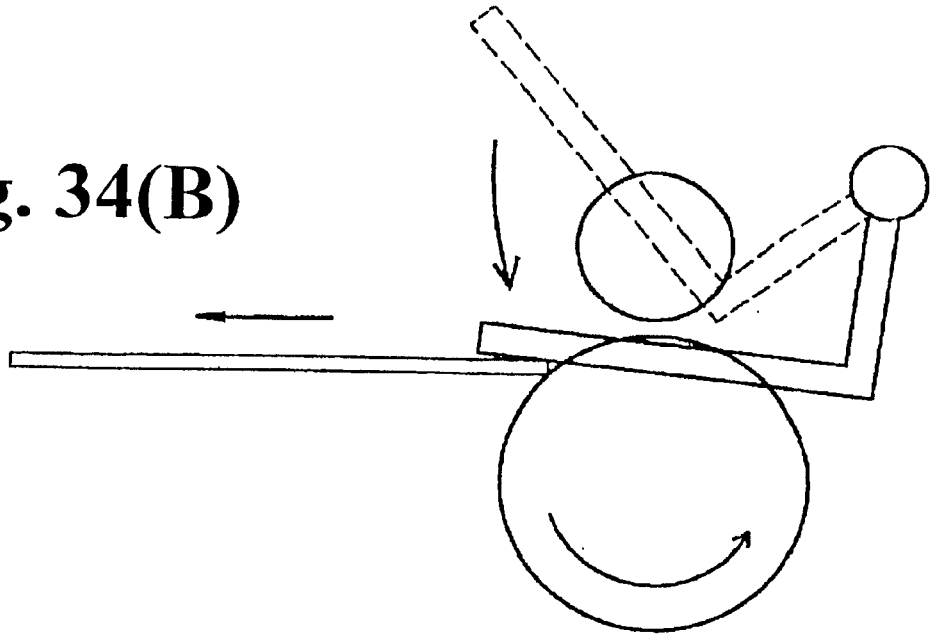

In each of the aforementioned embodiments, the endless transport belts 18 are used as the transport means opposing the weight member 201, but it is also acceptable to use the transport roller 118, shown in FIG. 34(A) and FIG. 34(B), when feeding a thick original, such as card or media of a strong nature.

The control depicted in FIG. 35 to FIG. 39 has been described for the first embodiment depicted in FIG. 1 to FIG. 17, but it can also be applied to the second embodiment depicted in FIG. 18 to FIG. 24(B).

While the above description has been provided to some detail for the embodiments of the present invention, they are details for the structures for the preferred embodiments. They do not prevent a variety of modifications that do not change the scope or the spirit of the arrangements or combinations of the composing elements.

What we claim is:

1. A sheet discharge apparatus comprising:

sheet storage means for receiving a sheet;

discharge means for discharging the sheet transported from a processing apparatus to the sheet storage means;

sheet detection means disposed on the sheet storage means for detecting a presence or absence of the sheet on the sheet storage means;

aligning means disposed above the sheet storage means for aligning the sheet discharged on the sheet storage means; and control means electrically connected to the sheet detection means and the aligning means for controlling an operation of the sheet discharge apparatus, said control means ignoring a detection result by the sheet detection means when aligning by the aligning means.

2. A sheet discharge apparatus according to claim 1, wherein said sheet detection means outputs a signal used in controlling a discharge of the sheet from the processing apparatus.

3. A sheet discharge apparatus according to claim 1, wherein said sheet detection means outputs a signal used in stopping the sheet discharge apparatus or the processing apparatus.

4. A sheet finishing apparatus comprising:

sheet storage means for receiving a sheet;

discharge means for discharging the sheet transported from a processing apparatus to the sheet storage means;

sheet detection means disposed on the sheet storage means for detecting a presence or absence of the sheet on the sheet storage means;

aligning means disposed above the sheet storage means for aligning the sheet discharged to the sheet storage means;

finishing means situated adjacent to the sheet storage means for executing a prescribed process on the sheet aligned by the aligning means; and control means electrically connected to the sheet detection means for controlling the sheet finishing apparatus, said control means ignoring a detection result by the sheet detection means when aligning by said aligning means or finishing by said finishing means.

5. A sheet finishing apparatus according to claim 4, wherein said sheet detection means outputs a signal used in controlling a discharge of the sheet from the processing apparatus.

6. A sheet finishing apparatus according to claim 4, wherein said sheet detection means outputs a signal used in stopping said sheet finishing apparatus or the processing apparatus.

7. An image forming apparatus comprising:

a sheet discharge apparatus having sheet storage means for receiving a sheet; discharge means for discharging the sheet transported from a processing apparatus to the sheet storage means; sheet detection means disposed on the sheet storage means for detecting a presence or absence of the sheet on the sheet storage means; and aligning means disposed on the sheet storage means for aligning the sheet discharged to the sheet storage means; and control means electrically connected to the sheet detection means for controlling the sheet discharge apparatus, said control means ignoring a detection result by the sheet detection means when aligning the sheet by the aligning means.

8. An image forming apparatus according to claim 7, wherein said sheet detection means outputs a signal used in controlling a discharge of the sheet from the processing apparatus.

9. An image forming apparatus according to claim 7, wherein said sheet detection means outputs a signal used in stopping the sheet discharge apparatus or processing apparatus.

10. An image forming apparatus comprising:

an image forming device for forming an image on a sheet;

a finishing apparatus having sheet storage means for receiving the sheet; discharge means for discharging the sheet transported from the image forming device to the sheet storage means; sheet detection means disposed on the sheet storage means for detecting a presence of the sheet on the sheet storage means; aligning means disposed above the sheet storage means for aligning the sheet discharged to the sheet storage means; and finishing means for executing a prescribed finishing process on the sheet aligned by the aligning means; and control means electrically connected to the aligning means and the finishing means for controlling the finishing apparatus, said control means ignoring a detection result by the sheet detection means when aligning by the aligning means or when finishing by the finishing means.

11. An image forming apparatus according to claim 10, wherein said sheet detection means outputs a signal for controlling a discharge of the sheet from the image forming device.

12. An image forming apparatus according to claim 10, wherein said sheet detection means outputs a signal for stopping the image forming device or the finishing apparatus.

* * * * *